US005976755A

United States Patent [19]

Yoshida et al.

[11] Patent Number: 5,976,755

[45] Date of Patent: Nov. 2, 1999

[54] IMAGE FORMING METHOD FEATURING A RESIDUAL CHARGE CONTROL PROPERTY RESULTING FROM A SELECTED TONER FORMULATION

[75] Inventors: Satoshi Yoshida, Mishima; Tsutomu Kukimoto, Yokohama; Manabu Ohno; Yasukazu Ayaki, both of Numazu; Satoshi Handa, Shizuoka-ken; Akira Hashimoto, Numazu, all of Japan

[73] Assignee: Canon Kabushiki Kaisha, Tokyo, Japan

[21] Appl. No.: 09/066,838

[22] Filed: Apr. 28, 1998

[30] Foreign Application Priority Data

Apr. 30, 1997 [JP] Japan ..... 9-111988
Apr. 30, 1997 [JP] Japan ..... 9-111991

[51] Int. Cl.[6] ..... G03G 13/22

[52] U.S. Cl. ..... 430/126; 430/106; 430/110; 430/111

[58] Field of Search ..... 430/106, 110, 430/111, 126

[56] References Cited

U.S. PATENT DOCUMENTS

| | | | |
|---|---|---|---|
| 4,623,606 | 11/1986 | Ciccarelli | 430/110 |
| 5,439,770 | 8/1995 | Taya et al. | 430/106 |
| 5,612,159 | 3/1997 | Sato et al. | 430/110 |
| 5,659,857 | 8/1997 | Yamazaki et al. | 399/252 |
| 5,856,055 | 1/1999 | Ugai et al. | 430/110 |

FOREIGN PATENT DOCUMENTS

| | | |
|---|---|---|
| 36-10231 | 7/1961 | Japan . |
| 56-013945 | 2/1981 | Japan . |
| 59-133573 | 7/1984 | Japan . |
| 61-279864 | 12/1986 | Japan . |
| 62-206182 | 9/1987 | Japan . |
| 63-133179 | 6/1988 | Japan . |
| 63-149669 | 6/1988 | Japan . |
| 63-235953 | 7/1988 | Japan . |
| 1-020587 | 1/1989 | Japan . |
| 1-191156 | 1/1989 | Japan . |
| 1-112253 | 4/1989 | Japan . |
| 2-123385 | 5/1990 | Japan . |
| 2-284158 | 11/1990 | Japan . |
| 2-302772 | 12/1990 | Japan . |
| 3-181952 | 8/1991 | Japan . |
| 3-259161 | 11/1991 | Japan . |
| 4-162048 | 6/1992 | Japan . |
| 5-2287 | 1/1993 | Japan . |
| 5-2289 | 1/1993 | Japan . |
| 5-53482 | 3/1993 | Japan . |
| 5-61383 | 3/1993 | Japan . |
| 5-188752 | 7/1993 | Japan . |
| 5-188765 | 7/1993 | Japan . |
| 7-209952 | 8/1995 | Japan . |
| 7-281485 | 10/1995 | Japan . |

OTHER PUBLICATIONS

Watanabe et al., "Compact Page Printer", Fujitsu Sc. Tech. J., 28, 4, pp. 473–480 (Dec. 1992).

Hosoya, M. et al., "Contact–Type Development System Using Monocomponent Nonmagnetic Toner", Japan Hard Copy '89 Papers, p. 25–28.

Database WPI, Section Ch, Week 9226, Derwent, XP–002086119 for JP04–139460, May 1992.

Database WPI, Section Ch, Week 8727, Derwent, XP–002086120 for JP62–116946, May 1989.

*Primary Examiner*—Roland Martin

*Attorney, Agent, or Firm*—Fitzpatrick, Cella, Harper & Scinto

[57] ABSTRACT

An image forming method includes charging an image carrier for carrying an electrostatic latent image;

forming an electrostatic latent image on the charged image carrier;

developing the electrostatic latent image with a toner by contacting a toner layer on a surface of a toner carrier with a surface of the image carrier to form a toner image thereon;

copying the toner image formed on the surface of the image carrier onto a copy medium;

wherein the toner has toner particles containing at least a bonding resin, carbon black and an azo-based iron compound and inorganic fine powder;

the carbon black having an average primary particles size within a range of from 25 to 80 nm; and the azo-based iron compound having a specific structure.

54 Claims, 9 Drawing Sheets

IMAGE FORMING METHOD FEATURING A RESIDUAL CHARGE CONTROL PROPERTY RESULTING FROM A SELECTED TONER FORMULATION

BACKGROUND OF THE INVENTION

1. Field of the Invention

The present invention relates to an image forming method using the electrophotographic method, the electrostatic recording method, or the magnetic recording method. More particularly, the present invention relates to an image forming method applicable to an image forming apparatus, such as a copying machine, a printer, or a facsimile machine, for forming an image by copying a toner image onto a copy medium after forming the toner image on a photosensitive member.

2. Description of the Related Art

Many conventionally known electrophotographic methods are generally based on a process comprising the steps of forming an electrical latent image on a photosensitive member by various means generally by the use of a photosensitive material, developing the electrical latent image with a toner into a visual image, transferring as required the toner image onto a transfer medium such as a sheet of paper, and then applying fixing heat or pressure, thereby obtaining a fixed image. In this process, the toner remaining on the photosensitive member, which is not transferred to the transfer medium after transferring, is cleaned off by various methods.

Known methods for visualizing the electrical latent image include the cascade developing method, the magnetic brush developing method, the non-magnetic one component developing method, and the pressurizing method. Further, a method known as the magnetic one component developing method is in use, which uses a magnetic toner, and causes an image to fly on an electric field between a photosensitive member and a sleeve by the use of a rotary sleeve having a magnetic pole arranged at the center.

LED and LBP printers primarily constitute the current printer market, and the technical tendency is toward a higher resolution, i.e., from the conventional 240 dpi or 300 dpi toward 400 dpi, 600 dpi or 1,200 dpi. A higher accuracy is accordingly demanded also for the developing method. General attention is attracted by the efforts to achieve a higher performance also in the area of copying machines, and the trend is directed toward more digitalized machines. Because a method of forming an electrostatic image by a laser is mainly adopted in the digital method, resolution is becoming higher, and accordingly, a developing method of a higher resolution and a higher accuracy in keeping with demands as in the area of printers is being realized.

Efforts are therefore directed toward achievement of a toner of a smaller particle size. A toner of a small particle size of a specific particle size distribution is proposed in Japanese Patent Application Laid-Open No. 1-112,253, No. 1-191,156, No. 2-284,6156, No. 2-284,158, No. 3-181,952, and No. 4-162,048.

There is at present proposed a method known as the contact one component developing method of conducting development with a configuration in which a semiconductive developing roller or a developing roller having a dielectric layer form on the surface thereof is pressed against a photosensitive surface layer.

When the photosensitive member is distant from the toner carrying member in the one component developing method, the electric force lines concentrate onto edge portions of the electrostatic latent image on the photosensitive member, and the toner is developed along the electric force lines, thus leading to an increased decrease in grade of the image caused by an edge effect in which the image is developed with the toner partial to the edge portions of the image.

This edge effect is prevented by bringing the photosensitive member and the toner carrying member closer to each other. It is, however, difficult to mechanically set a gap between the photosensitive member and the toner carrying member, i.e., to achieve a gap smaller than the thickness of the toner layer on the toner carrying member.

The edge effect would therefore be prevented by using the contact one component developing method by pressing the toner carrying member against the photosensitive member. However, when the displacement speed of the toner carrying member surface is the same as the displacement speed of the photosensitive member surface, visualization of the latent image on the photosensitive member cannot provide a satisfactory image. In the contact one component developing method, therefore, a part of the toner on the toner carrying member is developed for the latent image on the surface of the photosensitive member by providing a difference in surface displacement speed between the photosensitive member and the toner carrying member, and another part of the toner is stripped off, thus resulting in a developed image, free from the edge effect, resulting in a developed image that is highly true to the latent image.

In the application of the contact one component developing method, it is essential to provide a configuration permitting rubbing of the photosensitive member surface by the toner and the toner carrying member. As a result, the use of such a method for a long period of time tends to cause deterioration of toner, deterioration of the toner carrying member surface, and deterioration or wear of the photosensitive member surface, resulting in degradation of durability. There has therefore been a demand for an improved method. For there reasons, the contact one component developing method has essential problems including the necessity of improving durability, and difficulty of achieving a higher speed because of a larger load on the equipment.

Studies on the contact one component non-magnetic developing method are reported in the Japan Hardcopy '89 Papers, pages 25–28, without reference to durability.

An overview of a printer using the one component contact developing method is reported in the FUJITSU Sci. Tech., 28, 4, pp. 473–480 (December 1992). There remains, however, room for improvement regarding durability.

Japanese Patent Application Laid-Open Nos. 5-188,765 and 5-188,752 disclose techniques regarding a one component contact developing method, but does not disclose a technique for improving durability.

A toner image formed on the photosensitive member during the developing step is transferred, on the other hand, onto a transfer medium during the transferring step, while the toner remaining after transferring on the photosensitive member is cleaned during the cleaning step, and the toner is stored in a waste toner container. For the cleaning step, it has been the conventional practice to use a cleaning method such as blade cleaning, fur brush cleaning, or roller cleaning. All these cleaning methods comprise the steps of bringing a cleaning member into contact with the surface of the photosensitive member and mechanically scraping off the toner remaining from the photosensitive member, or damming up the residual toner and collecting the same into a waste toner container. As a result, for any of these cleaning methods, it has been inevitable to suffer the problems caused by the pressing of the cleaning member against the surface of the photosensitive member, for example, wear of the photosensitive member caused by the strong pressing of the cleaning member and the resultant shorter service life of the photosensitive member. From the point of view of equipment, incorporation of such a cleaning unit has naturally led to a large apparatus, and this has formed a bottleneck why trying to achieve a more compact apparatus.

From an ecological point of view, furthermore, a system not generating waste toner for effective utilization of toner, and a system having excellent fixability and offset resistance properties for energy saving have been demanded.

The disclosure of a technique conventionally known as development-simultaneous cleaning technique or cleanerless technique, as in Japanese Patent Application Laid-Open No. 5-2287, places a data point on a positive memory and a negative memory under the effect of toner remaining after transferring on an image. Now that electrophotography is widely in use, however, it is becoming necessary to transfer the toner image onto various transfer media, and in this respect, the disclosed technique does not satisfy the requirements of various transfer media.

The prior arts disclosing techniques relating to the cleanerless technique include Japanese Patent Application Laid-Open Nos. 59-133,573, 62-206,182, 63-133,179 64-20,587, 2-302,772, 5-2,289, 5-53,482 and 5-61,383. None of these techniques describes neither a desirable image forming method nor a toner composition.

Further, for development-simultaneous cleaning essentially not having a cleaning unit, a configuration for rubbing the surface of the photosensitive member with the toner and the toner carrying member is required, this tending to cause deterioration of toner, deterioration of the surface of the toner carrying member, degradation or wear of the surface of the photosensitive member caused by the use for a long period of time, and deterioration of durability. As these defects were not sufficiently solved by the conventional technology, simultaneous satisfaction of fixability and durability properties has been demanded. Now that there is a demand for a higher speed of image formation in parallel with this, the conventional technology cannot sufficiently solve problems in charging control of residual toner after transferring before collection for achieving a higher collectivity of the residual toner in development, or in keeping stability of development when reusing the collected toner in development-simultaneous cleaning technique in an apparatus having a high process speed.

Japanese Patent Application Laid-Open No. 3-259,161 provides a non-magnetic, one component developing agent by setting forth a shape factors, a specific surface area, and a particle size. The developing agent defined in this prior art does not, however, provide sufficient durability properties.

Japanese Patent Application Laid-Open No. 61-279,864 proposes a toner by setting forth values of shape factors SF-1 and SF-2. This prior art does not, however, describe copying apparatus. Moreover, a followup test of the examples revealed a low transferring efficiency and the necessity of further improvement.

Japanese Patent Application Laid-Open No. 63-235,953 processes a magnetic toner spheroidized by a mechanical impact. This prior art achieves, however, only an insufficient transferring efficiency, leaving room for further improvement.

Recently, from the point of view of environmental protection, the contact charging method of conducting charging by bringing a charging member into contact with the surface of a photosensitive member in a primary charging step and a transferring step utilizing corona discharge used conventionally, and the contact transferring method performing transferring by bringing a transferring member into contact via a transfer medium with the surface of the photosensitive member are currently receiving the main attention in the industry.

Such a contact charging method and a contact transferring method are proposed in Japanese Patent Application Laid-Open Nos. 63-149,669 and 2-123,385. These methods comprise the steps of bringing a conductive elastic roller into contact with the photosensitive member, uniformly charging the photosensitive member while applying a voltage to the conductive roller, then obtaining a toner image through subsequent exposure and developing steps, pressing another conductive roller applied with a voltage against the photosensitive member, passing a transfer medium between the photosensitive member and the conductive roller while pressing, and transferring a toner image on the photosensitive member onto the transfer medium, thereby obtaining a transferred image through a fixing step.

In the contact transferring method as described above, however, in which the transferring member is brought into contact via the transfer medium with the photosensitive member during transferring, the toner image is pressed during transferring of the toner image onto the transfer medium, thus causing a problem of a partially defective transfer known as a hollow character.

Further, as the particle size of toner becomes smaller, adherence of the toner particles to the photosensitive member (image force or van der Waals force) becomes larger as compared with the Coulomb force acting on the toner particles during transferring, thus tending to result in an increased residual toner after transferring.

The toner and the photosensitive member used in this image forming method have therefore been required to have excellent strippability properties. With a view to improving strippability of the toner from the photosensitive member and improving transferring property of the toner, use of a toner having a particle shape approximating a sphere, manufactured by the suspension polymerization method is disclosed in Japanese Patent Application Laid-Open No. 7-209,952 (corresponding to U.S. Pat. No. 5,659,857).

The toner manufactured by the suspension polymerization method has been proposed some years ago (for example, Japanese Patent Publication No. 36-10,231). The suspension polymerization method comprises the steps of preparing a monomer composition by uniformly dissolving or dispersing a polymerizable monomer and a coloring agent (and as required, a polymerization initiating agent, a binder agent, a charge control agent, and other additives), dispersing the prepared monomer composition in a continuous layer (for example, an aqueous phase), containing a dispersion stabilizing agent by means of an appropriate stirrer, and causing a polymerizing reaction, thereby obtaining toner particles having a desired particle size.

In this suspension polymerization method, in which liquid drops of the monomer composition are generated in a dispersion medium having a large polarity such as water, components having polar groups contained in the monomer composition tend to be present in the surface layer portion forming the interface with the aqueous phase, and nonpolar components are nonexistent in the surface layer portion, thereby permitting manufacture of a spherical toner having a structure known as the core-shell structure or the so called "domain-matrix" structure.

The toner based on the polymerization method now permits simultaneous achievement of low-temperature fixability, blocking resistance, and high-temperature offset resistance, which are properties contrary to each other, under the effect of inclusion of the wax component serving as a release agent.

Use of such a toner provides an advantage that the coloring agent is hardly exposed to the surface and a uniform friction charging property can be achieved. Further, because it is possible to omit the classification step, there are available such remarkable cost curtailing effects such as energy saving, reduction of time, and improvement of process yield.

However, since the toner obtained by this method has substantially a true spherical shape, defective cleaning caused by passing-through of the toner particles occurs during cleaning, particularly during blade cleaning, and this may seriously damage the quality of the transferred image.

Especially in nonmagnetic one component, the amount of charge of the toner developed on the photosensitive member leads to a large adherence (image force) of the toner particles to the photosensitive member, resulting in an increasing tendency of residual toner after transferring. The amount of charge of the residual toner after transferring tends to become larger, causing the problem of easy occurrence of defective cleaning in cleaning because of an increased adherence of the toner particles to the photosensitive member.

Also in the development-simultaneous cleaning method of conducting the cleaning step for removing residual toner after transferring simultaneously with the developing step, when using a spherical toner, use for a long period of time causes the covering additive to easily be buried in the toner surface, leading to a decreased charging property of the toner, and hence to deterioration of the image quality in many cases. This phenomenon is particularly remarkable as the process speed of the developing roller becomes higher.

It is widely known to add carbon black as a black coloring agent into the toner. Dispersibility of carbon black is largely affected by physical properties such as primary particle size, specific surface area, structure and surface quality (functional group on the surface and the like). When adding carbon black to the toner, therefore, the selection thereof exerts an important effect on the toner properties.

For example, carbon black has a smaller primary particle size and a large specific surface area as compared with the other pigments, and is hardly dispersed because of a unique structure. Insufficient dispersibility of carbon black in toner particles impairs charging property of the toner, leading to an adverse effect of causing fogging during development. In addition, the decrease in coloring ability of toner particles results in another adverse effect of a lower image concentration or greater toner consumption.

Manufacture of a toner by the use of carbon black as a pigment in the application of the foregoing polymerization method causes further problems as follows.

First, because carbon black has a functional group impairing polymerizability of a monomer such as a quinone group on the surface, the manufacture of a toner by the polymerization method leads to a lower polymerization rate with a degree of polymerization not increasing sufficiently, results in instable particles during granulation, aggregations and bonding, thus making it difficult to take out particles.

Secondly, when preparing a monomer composition by uniformly dissolving or dispersing a polymerizable and carbon black (and further, as required, a polymerization initiating agent, a crosslinking agent, a charge control agent, and other additions), carbon black is hardly dispersed in the monomer composition. When manufacturing toner particles by suspension-dispersing the monomer composition in an aqueous medium, carbon black is maldistributed, or toner particles not containing carbon black are easily produced.

Thirdly, since carbon black is conductive, a charge on the toner surface easily leaks, thus exerting an important effect on charging property of the toner. Dispersion of carbon black content, dispersibility, and aggregation between the each toner particles causes dispersion of the charging property of the toner particles, and leads to a lower developing efficiency and more serious fogging.

Such variations in carbon black content, dispersion, and aggregation between the toner particles and localization within a particle result in generation of toner particles having a high charging amount far larger than the desired one and toner particles of a low charging amount, thus causing instable charging property of the toner. Particularly in nonmagnetic one component contact developing, the presence of more toner particles of a low charging amount leads to toner splashing without adhering to, or being retained by, electrostatically the toner carrying member and contaminates the interior of the apparatus and the image: easy occurrence of toner splashing or fogging of the image. Toner particles having an unnecessarily high charging amount results in a larger adherence (image force) to the photosensitive member, which tends to cause an increase of residual toner after transferring a higher charging amount of residual toner after transferring, thus leading to easier occurrence of defective cleaning during the cleaning step. This further cause a decrease in a charging amount for the toner as a whole through prevention of charging of the other toner particles, and tends to result in toner splashing and fogging.

It is also known to add an azo-based iron complex as a charge control agent to the toner.

Japanese Patent Laid-Open No. 7-281,485 proposes use of a suspension-polymerized toner having a charging property improved by adding a specific azo-based iron complex to the toner in the non-magnetic one component developing method. This publication does not, however, describe consideration on carbon black, which has an important effect on polymerizability and charging property of the toner.

Further, in the image forming method based on development-simultaneous cleaning, no conventional art has ever solved sufficiently these problems encountered when using a toner containing carbon black.

SUMMARY OF THE INVENTION

The present invention has therefore an object to provide a technique for avoiding deterioration of toner in an image forming method using the contact one component developing method, which comprises the steps, when developing an electrostatic latent image formed on a photosensitive member, of contacting a toner layer on a toner carrying member with the surface of the photosensitive member, thereby accomplishing development of the electrostatic latent image.

An object of the invention is to disclose a technique for preventing deterioration of the surface of the toner carrying member.

An object of the invention is to provide an image forming method which does not cause a defective cleaning even in blade cleaning.

An object of the invention is to provide an image forming method permitting achievement of a higher speed of the apparatus.

An object of the invention is to provide an image forming method, which permits improvement of fixability and offset resistance, and simultaneously, improvement of durability stably ensuring a high-quality image for a long period of time.

A further object of the invention is to provide an image forming method, which ensures availability of a stable image for a long period of time without causing a defective charging even when applying a charging method using a contact charging member.

Another object of the invention is to provide an image forming method, which uses the contact one component developing method and does not use substantially a cleaning unit.

An object of the invention is to provide an image forming method, which, in an image forming method using the contact one component developing method and a developing simultaneous cleaning configuration, permits design of a system having satisfactory transferring property even for various transfer media such as an plane paper, a cardboard, and a transparent film for overhead projector, i.e., having a broad lattitude of the transferring step.

An object of the invention is to provide an image forming method, which is excellent in transferring property, gives a little amount of residual toner after transferring, and does not cause a hollow character even in the application of the contact transferring method or can inhibit such a phenomenon.

An object of the invention is to provide an image forming method, which, even in the application of a higher-speed image forming process, permits smooth collection of residual toner after transferring during development, stable achievement of a high-quality image for a long period of time as a result of a stable developing performance, and gives a high durability.

An object of the invention is to provide an image forming method, which, even in the application of a contact charging method using a contact charging member, does not cause a defective charging, and gives a stable image for a long period of time.

An object of the invention is to provide an image forming method comprising the following steps:

charging an image carrying member for carrying an electrostatic latent image;

forming an electrostatic latent image on the charged image carrying member;

developing the electrostatic latent image with a toner by contacting a toner layer on a surface of a toner carrying member, with a surface of the image carrying member, to form a toner image on the surface of the image carrying member;

transferring the toner image formed on the surface of the image carrying member onto a recording medium via or without via an intermediate transfer member;

wherein the toner comprises toner particles containing at least a binder resin, carbon black and an azo-based iron compound and an inorganic fine powder;

the carbon black has an average primary particle size of from 25 to 80 nm;

the azo-based iron compound comprises a compound expressed by the following general formula (1):

General Formula (1):

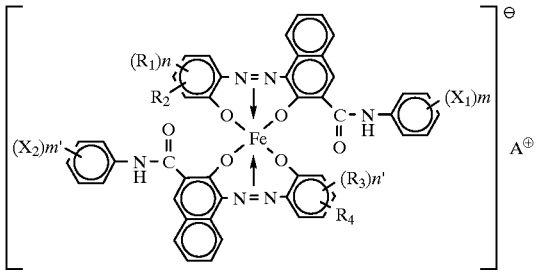

wherein $X_1$ and $X_2$ are each selected from the group consisting of hydrogen atom, lower alkyl group, lower alkoxy group, nitro group and halogen atom; $X_1$ and $X_2$ are the same or different; m and m' are integers from 1 to 3; $R_1$ and $R_3$ are each members selected from the group consisting of hydrogen atom, $C_1$–$C_{18}$ alkyl groups, $C_2$–$C_{18}$ alkenyl groups, sulfonamide group, mesyl group, sulfonic acid group, carboxyester group, hydroxy group, $C_1$–$C_{18}$ alkoxy groups, acetylamide group, benzoylamino group and halogen atom; $R_1$ and $R_3$ are the same or different; n and n' are integers from 1 to 3; $R_2$ and $R_4$ are each hydrogen atom or nitro group; and A+ is a cation selected from the group consisting of ammonium ion, hydrogen ion, sodium ion, potassium ion and ion mixtures thereof.

DETAILED DESCRIPTION OF THE INVENTION

Figure 1:
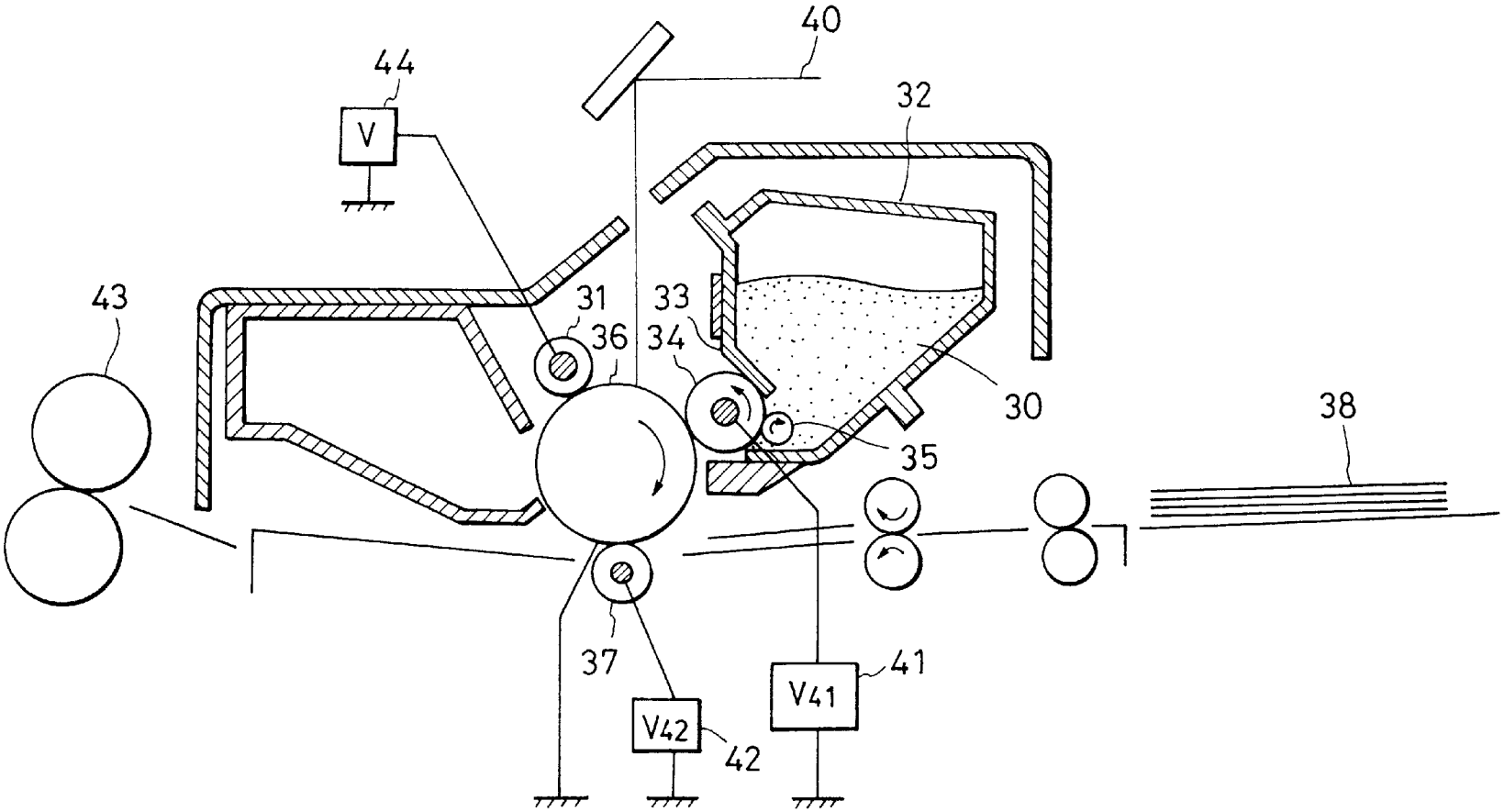
FIG. 1 is a schematic diagram illustrating an image forming apparatus using a contact one component developing unit and adopting the developing-simultaneous cleaning method, used in an embodiment of the image forming method of the present invention.

According to the present invention, rapid riseup of toner charging becomes possible and a high-quality image is available by applying a toner using toner components including a specific azo-based iron compound and carbon black having specific physical properties to an image forming method of a configuration of the one component contact developing method, and when using the pre-development cleaning method in which a cleaning step for removing residual toner after transferring from the surface of an image carrying member is placed before the developing step, it is possible to obtain a stable cleaning property. When using the development-simultaneous cleaning method of conducting the cleaning step for removing residual toner after transferring from the surface of the image carrying member, simultaneously with the developing step at the developing section, it is possible to improve transferring efficiency, sufficiently inhibit impairment of charging of the image carrying member caused by residual toner after transferring, and smoothly collect residual toner after transferring during development, thereby obtaining a stable developing performance.

An example of the developing unit used in the image forming method of the invention is a developing unit based on a process comprising the steps of using an elastic roller as a toner carrying member for carrying the toner serving as a one component developing agent, coating a toner onto the surface of the developing roller, forming a toner layer and bringing the toner layer into contact with the surface of the photosensitive member serving as an image carrying member. It is important in this case that the toner layer is in contact with the surface of the photosensitive member, whereas the toner may be either magnetic or nonmagnetic. The toner carrying member is substantially in contact with the surface of the photosensitive member. This means that, when the toner layer is removed from the toner carrying member, the toner carrying member is in contact with the surface of the photosensitive member. In order to obtain an image free from the edge effect by an electric field acting between the photosensitive member and an elastic roller opposite to the surface of the photosensitive member through the toner, it is necessary that the surface of the elastic roller or the proximity thereof has a potential and an electric field is formed between the surface of the photosensitive member and the surface of the toner carrying member. This may be accomplished by resistance-controlling an elastic layer formed of an elastic roller on the surface of a low-resistance core of the elastic roller within a medium resistance region to keep an electric field while preventing conduction with the surface of the photosensitive member, or providing a thin dielectric layer on the surface layer of the low-resistance conductive roller. It is also possible to adopt a configuration in which the surface side of the conductive roller opposite to the surface of the photosensitive member is covered with an insulating material, or a configuration in which a conductive layer is provided on the inner side not facing the photosensitive member by means of an insulating sleeve.

When using the one component contact developing method, the surface of the developing roller serving as the toner carrying member carrying the toner and the surface of the photosensitive member may be rotated in the same direction or counter to each other. When the rotating directions are the same, the circumferential speed of the surface of the developing roller should preferably be higher at a circumferential speed ratio of larger than 100% relative to the circumferential speed of the photosensitive member. At a ratio smaller than 100%, problems are caused in the image quality such as a poor distinctiveness of lines. A higher circumferential speed ratio leads to a larger amount of toner supplied to the developed portions and a higher depositing frequency of toner to the latent image. A repeated cycle of scrubbing of unnecessary portions and deposition at necessary portions results in an image accurately copying the latent image.

The image forming method of the present invention does not include the image forming method based on the two-component developing method using a magnetic brush composed of a toner and a carrier.

A favorable feature of the invention is that the method has a cleaning step for removing residual toner after transferring remaining on the surface of the image carrying member without being consumed in the transferring step. This cleaning step is carried out either by the pre-development cleaning method of conducting cleaning by bringing a cleaning member into contact with the surface of the image carrying member after the transferring step and before the developing step, or by the development-simultaneous cleaning method conducting cleaning simultaneously with developing during the developing step.

In the pre-development cleaning method, a cleaning section comprising a cleaning member for removing residual toner after transferring in contact with the surface of the image carrying member and present on the surface of the image carrying member should preferably be provided between the transferring section and the charging section, because of the possibility to minimize the influence of residual toner after transferring on the charging member.

In the development-simultaneous cleaning method, a cleaning member for removing residual toner after transferring in contact with the surface of the image carrying member and present on the surface of the image carrying member is not provided between the transferring section and the charging section and between the charging section and the developing section.

A blade, a roller, a fur brush, or a magnetic brush may be used as a cleaning member used in the pre-development cleaning method in the invention. These cleaning members may be used alone or in combinations of two or more.

The present inventors found the possibility, when applying a toner containing carbon black to the image forming method based on the one component contact developing method, to appropriately control the charging amount of the developed toner on the photosensitive member, and therefore to prevent a decrease in cleaning property caused by over-charging of residual toner after transferring, by using a specific carbon black and a specific azo-based iron compound.

More specifically, when residual toner after transferring is charged in excess, the high adhesion of residual toner after transferring to the photosensitive member tends to cause a decrease in the cleaning property. Particularly, when toner particles have an almost spherical shape as that prepared by the polymerization method such as the suspension polymerization, a decrease in scrapability in the cleaning step and passing-through from the cleaning member are easily caused, which is disadvantageous for cleaning, and further, over-charging of residual toner after transferring causes a serious decrease in cleaning property.

Charging of residual toner after transferring largely varies also with, a transferring bias condition and resistance of the transfer medium. For transferring bias, a voltage of a polarity reverse to the charging polarity of toner is usually applied. When a normal image is to be developed (the charging polarity of the photosensitive member is reverse to the charging polarity of the toner), if the transfer medium has a high resistance as in the case of cardboard or an OHT film, toner particles having a high charge are retained by the strong adhesion with the photosensitive member to the cleaning step without being copied with the unchanged charging polarity, thus tending to remain after cleaning.

It is therefore desirable to appropriately control the amount of charge of the toner developed on the photosensitive member, and avoid development of toner of a high charging amount onto the photosensitive member.

To avoid development of high-charging toner on the photosensitive member, it is necessary to inhibit imparting of a charge to the toner or charging property of the toner. With insufficient chargeing of the toner, however, such defects as fogging, toner splashing, and a decrease in transferring property tend to occur.

By using a specific carbon black and a specific azo-based iron compound of the invention, it is now possible to inhibit generation of high charging toner particles of over-charging, and impart an appropriate charging amount to the toner. As a result, a stable performance, excellent in durability, is exhibited even in the developing step. This is attributable to the charge control effect brought about by satisfactory dispersion of carbon black provided by the simultaneous use of the specific carbon black and the specific azo-based iron compound of the invention, and to the additional charge control effect inhibiting over-charging of the azo-based iron compound itself.

When development is accomplished by several (the photosensitive member charging polarity is the same as the toner charging polarity), use of a transfer medium permeable by an electric field such as a thin sheet of paper causes some toner particles to be strongly charged in the reverse polarity by the transferring bias. These toner particles, strongly charged in the reverse polarity, which have a strong adhesion with the photosensitive member, tend to remain on the photosensitive member.

By using the specific carbon black and the specific azo-based iron compound of the invention, in contrast, it is now possible to inhibit generation of toner particles over-charged in the reverse polarity.

Control of toner charging by transferring bias is also attributable to a synergetic effect of the charge control effect brought about by a satisfactory dispersion of carbon black and the charge control effect of inhibiting over-charging of the azo-based iron compound itself, as a result of simultaneous use of the specific carbon black and the specific azo-based iron compound of the invention.

Although the reason is not always clear, findings by the present inventors suggest that, because the specific azo-based iron compound has an effect of preventing over-charging of the toner (a phenomenon known as "charge-up"), it is difficult for the toner particles to retain a reverse over-charging even if a reverse electric field to the toner polarity is applied during the transferring step, and further the azo-based iron compound serves also as a dispersant causes improvement of dispersibility of the carbon black, resulting in a uniform frictional charge amount of the individual toner particles.

The principle of the development-simultaneous cleaning method is to control the charging polarity and the amount of charge of the toner on the photosensitive member in the individual steps of electrophotography and to use the several developing methods.

For example, when using a negative charging photosensitive member and a negative charging toner, an image visualized by a positive-polarity copying member is copied onto a transfer medium. Under the effect of the kind of transfer medium (difference in thickness, resistance, and permittivity) and the image area, the charging polarity of residual toner after transferring changes from positive to negative. However, the surface of the photosensitive member as well as the residual toner after transferring can be uniformly charged to have a negative charging polarity, even when the polarity has been charged to positive during the transferring step, by means of the negative-polarity charging member upon charging the negatively charged photosensitive member. As a result, even when the toner particles charged uniformly into negative polarity are present on the surface of the photosensitive member during developing, and when reverse development is used for developing, negatively charged residual toner after transferring remains on a bright potential portion where the toner is to be developed. In the dark potential portion where the toner is not to be developed, on the other hand, the residual toner is attracted toward the toner carrying member because of the developing electric field, and does not remain there.

However, when forming an image at a high process speed by the use of the development-simultaneous cleaning method, it becomes difficult to achieve a uniform charging polarity of the residual toner after transferring, simultaneously with charging of the surface of the photosensitive member, as a result of a decrease in the charging time per unit surface area of the photosensitive member. When reverse development is used for developing, therefore, the residual toner after transferring on the dark potential portion where the toner is not to be developed is attracted by the developing electric field toward the toner carrying member, thus making it difficult to collect the toner. Further, even when the toner is mechanically collected onto the toner carrying member by friction, for example, and an adverse effect is exerted on charging property of the toner on the toner carrying member, reducing the developing property, unless the residual toner after transferring is uniformly charged.

The image forming method based on the development-simultaneous cleaning method is established by controlling charge polarity of the residual toner after transferring simultaneously with charging of the photosensitive member. However, when applying the image forming method based on the development-simultaneous cleaning method for forming an image at a high process speed as described above, it is difficult to control charge polarity of residual toner after transferring, easily causing a defective collection during development. Further, charging of residual toner after transferring collected during the developing step largely affects the developing property because of the higher speed of development itself. This poses the problem of easily causing a decrease in developing performance.

In addition, when using the development-simultaneous cleaning method in the formation of an image at a high process speed, contamination of the charging member tends to cause a defective charging.

Studies carried out by the present inventors reveal that, in an image forming method based on the development simultaneous cleaning method at a higher process speed of over 120 mm/sec, or even over 150 mm/sec, improvement of collectability of the residual toner after transferring requires more rapid control of the charging polarity, and maintenance of the developing performance requires certain and uniform control of charging polarity of the residual toner after transferring upon passage through the charging member.

Particularly, in a method known as the contact charging of carrying out charging by bringing the charging member into contact with the photosensitive member, utilization of discharge in conformity to Paschen's law as the charging mechanism results in deterioration of adhesion to the charging member caused by toner degradation under the effect of contact of the charging member with the photosensitive member and discharging energy.

In the pre-development cleaning method, residual toner after copying is cleaned from the surface of the photosensitive member by a cleaning member such as a blade or a fur brush, and studies have conventionally been made without regard to charging of the toner present on the photosensitive member, collectability in the developing unit, and the effect on the developing performance when the toner is collected in the developing unit and reused.

The present inventors carried out extensive studies on various kinds of toner. As a result, they found a close correlation of charging control property upon the toner's passage through the charging member with durability and image quality properties in the image forming method based on the development-simultaneous cleaning method. Particularly, for a toner containing carbon black, charging control property of toner upon passing through the charging member was found to be improved by the simultaneous use of a specific carbon black and a specific azo-based iron compound, and this led them to develop the present invention.

One of the features of the image forming method of the invention is to use a toner comprising carbon black having a particle size within a range of from 25 to 80 nm and a specific azo-based iron compound.

The present inventors obtained the following findings. When applying the image forming method based on the one component contact developing method, use of a toner containing a specific carbon black and a specific azo-based iron compound brings about the following advantages: (i) when using the pre-development cleaning, toner particles overcharged during development decrease, and toner particles strongly charged in a reverse polarity by transferring bias in the transferring step decrease, thereby permitting satisfactory cleaning in the cleaning step; and (ii) when using the development-simultaneous cleaning method, charging polarity control and charge amount control of the residual toner after transferring on the photosensitive member by the charging member can be accomplished more certainly and more uniformly, thus ensuring a more stable collectability (cleaning property) and developing property of the residual toner after transferring in the developing step.

Although the reason is not always clear, findings by the present inventors suggest that, because the specific azo-based iron compound has an effect of preventing overcharging of the toner (the phenomenon known as "charge-up"), it is difficult for the toner particles to retain a reverse over-charging even if a reverse electric field to the toner polarity is applied during the transferring step, and further that the azo-based iron compound serves also as a dispersant causes improvement of dispersibility of the carbon black, resulting in a uniform frictional charge amount of the each toner particles.

When a carbon black having an average primary particle size smaller than 25 nm is used together with the azo-based iron compound of the invention, the fine primary particle size makes it difficult to achieve a sufficient dispersion and hence to obtain advantages of the invention. When manufacturing toner particles by the suspension polymerization method, the toner particle size tends to become coarser, thus making it difficult to fully make use of it.

When the carbon black has an average primary particle size larger than 80 nm, even a satisfactory dispersion gives only a low-concentration image because of an insufficient coloring ability of toner. An inconvenience of an increase in the toner consumption may be encountered.

The average primary particle size of carbon black in the invention should preferably be within a range of from 25 to 55 nm, or more preferably, from 35 to 55 nm. When used together with the specific azo-based iron compound of the invention, a particle size of carbon black within this range ensures certain and uniform control of the charging polarity and charge amount of the residual toner after transferring by the charging member, and is advantageous also in terms of stability of the amount of charge of toner and coloring ability of toner.

The average primary particle size of carbon black in the toner in the invention can be measured by taking an enlarged image on a transmission type electron microscope.

The DBP oil absorption of the carbon black used in the invention should preferably be within a range of from 40 to 150 ml/100 g, or more preferably, from 50 to 140 ml/100 g.

A carbon black with a short structure having a DBP oil absorption of under 40 ml/100 g tends too lead to an excessively low amount of charge of the toner. With a DBP oil absorption of over 150 ml/100 g, on the other hand, a fine dispersion of carbon black is hardly available under the effect of the strong and long structure.

The DBP oil absorption of carbon black is measured in conformity to the "ASTM Method D2414-79".

The carbon black used in the invention should preferably have a specific surface area by nitrogen adsorption within a range a from 30 to 90 $m^2/g$, or more preferably, from 40 to 90 $m^2/g$, and a volatile matter content of under 2%, or preferably, within a range preferably, from 0.1 to 1.7%. The carbon black of the invention has a smaller specific surface area and a lower volatile matter content than those of the carbon black commonly used in a toner.

A specific surface area by nitrogen adsorption of even 100 $m^2/g$ of carbon black tends to easily cause polymerization impairment. A volatile matter content of over 2% of carbon black is not desirable because it causes the presence of many polymerization impairing functional groups on the surface.

The specific surface area by nitrogen adsorption of carbon black is measured in accordance with the "ASTM Method D3037-78".

The volatile matter contact of carbon black is measured in accordance with the "JIS K6221-1982".

More specifically, the measuring process comprises the steps of filling a platinum crucible or a porcelain crucible having a floating cover of the same shape and capacity with carbon black, a sample for measurement, by compacting and shaking up to a depth not exceeding 2 mm below the cover, measuring the mass thereof, placing the covered crucible into an electric furnace, taking out the crucible after heating the same at 950±25° C. accurately for seven minutes, leaving the same to cool in a desiccator to the room temperature, measuring the mass after heating, and then calculating the volatile matter content by the following formula:

$$V = \frac{W_D - W_R}{W_D} \times 100$$

Where,

V: volatile matter content (%)

$W_D$: mass of a dried sample before heating (g)

$W_R$: mass of a dried sample after heating (g)

When manufacturing a toner by the polymerization method, there is carried out a master batch step for preliminarily dispersing the carbon black and the aforesaid azo-based iron compound in a polymerizable monomer. This permits dispersion of carbon black at a higher concentration, hence easier imparting of shearing force and a more remarkable effect of improving dispersibility.

Figure 7:
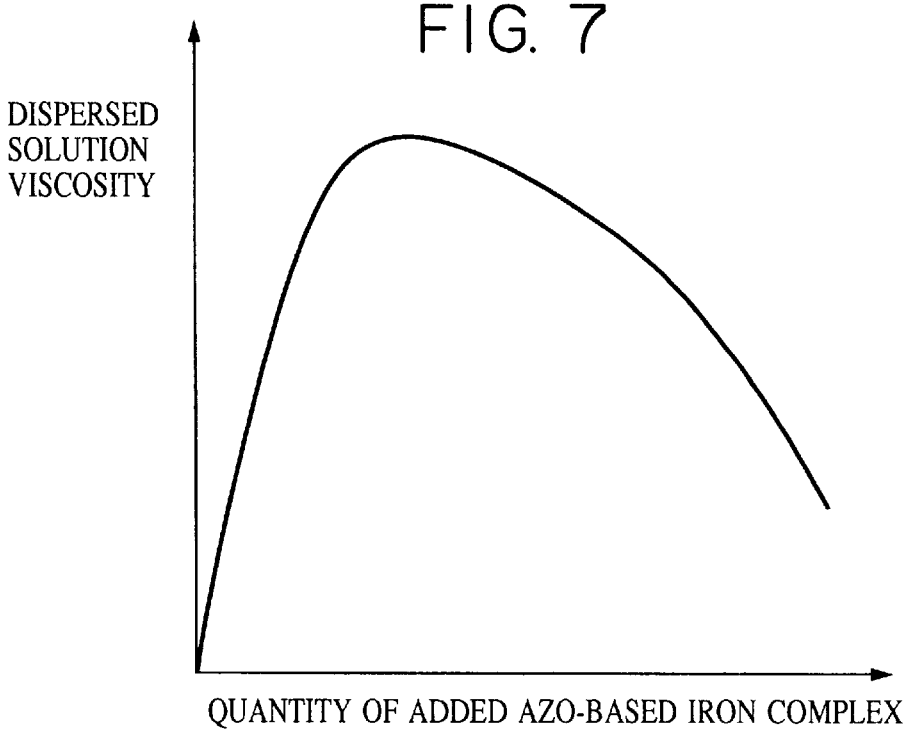
FIG. 7 is a graph illustrating charges in viscosity when dispersing carbon black and an azo-based iron complex of the invention in styrene monomer.

FIG. 7 is a graph illustrating changes in viscosity when dispersing the carbon black and the azo-based iron compound of the invention in a styrene monomer. As is clear from FIG. 7, addition of the azo-based iron compound causes a remarkable increase in viscosity of the dispersed solution, suggesting a stable dispersion of carbon black with a high shearing force.

Figure 8:
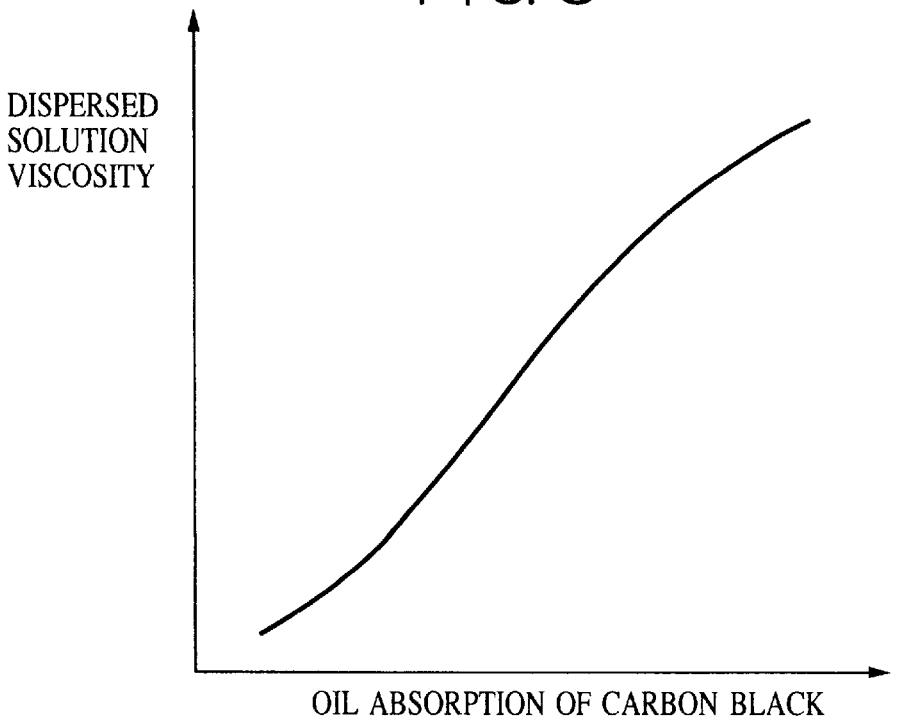
FIG. 8 is a graph illustrating the relationship between oil absorption and viscosity of carbon black when dispersing carbon black of the invention and a certain amount of an added azo-based iron complex in styrene monomer.

FIG. 8 is a graph illustrating the relationship between oil absorption of carbon black and viscosity of the dispersed solution when the azo-based iron compound in a certain amount is added to a carbon black having a particle size within a range of from 25 to 80 nm and the mixture is dispersed in a styrene monomer. FIG. 8 suggests that a carbon black of a high oil absorption of over 40 ml/100 g leads to a higher viscosity of the dispersed solution and a higher dispersibility. With an oil absorption of carbon black of over 150 ml/100 g, viscosity of the dispersed solution becomes excessively high, tending to impair granulability during polymerization.

According to studies carried out by the present inventors, the foregoing carbon black content A [wt. %] and the foregoing azo-based iron compound B [wt. %] relative to the weight of toner particles should preferably satisfy the following condition:

$$2 \leqq A/B \leqq 35$$

or more preferably:

$$3 \leqq A/B \leqq 35.$$

As is clear from FIG. 7, with a low content of azo-based iron compound relative to the carbon black content, an increase in viscosity is prevented, and the stabilized carbon black prevents dispersion. Along with the lapse of time in this case, carbon black precipitates, and a toner prepared with the use of this dispersed solution resulted in an inhibited coloring ability.

A high azo-based iron compound content relative to the carbon black content causes a secondary aggregation of the azo-based iron compound, leading to a decrease in dispersibility, and the resultant secondary aggregate impairs polymerization, thus making it difficult manufacture satisfactory particles.

In the invention, the carbon black content of the toner particles should preferably be within a range of from 0.1 to 30 wt. %, or more preferably, from 1 to 20 wt. %, or more preferably, from 3 to 15 wt. %.

In the invention, the azo-based iron compound content of the toner particles should preferably be within a range of from 0.01 to 20 wt. %, or more preferably, from 0.1 to 10 wt. %, or even more preferably, from 0.1 to 3.0 wt. %. When the carbon black content of the toner particles is under 0.1 wt. %, the coloring ability of the toner is low, and it is difficult to obtain a high image concentration, thus requiring simultaneous use of another coloring agent. When the carbon black content is over 30 wt. %, on the other hand, dispersibility of carbon black does not become sufficiently uniform even using the azo-based iron compound used in the invention, tending to cause fogging or toner splashing. When the content of the azo-based iron compound of the toner particles is under 0.01 wt. %, viscosity of the dispersed solution tends to rise, preventing the dispersibility improving effect of carbon black from being fully displayed. When this content is over 20 wt. %, in contrast, the viscosity of the dispersed solution is reduced and the dispersibility improving effect of carbon black is reduced.

As described above, the present inventors found the possibility to obtain a toner having an improved charge control property of residual toner after copying during passage through the charging member, by simultaneously using a carbon black having an appropriate structure within a specific range of oil absorption, a small specific surface area, and a low volatile matter content together with a specific azo-based iron compound.

By applying the thus obtained toner to the image forming method based on the one component contact developing method it is possible: (i) in the pre-development cleaning method, to satisfactorily remove residual toner after copying from the surface of the photosensitive member in the cleaning step and to form a high-quality image because there is a decrease in the ratio of the presence of toner particles of an excessive amount of charge of the residual toner after transferring, or in the ratio of the presence of toner particles of an excessive amount of charge of a reverse polarity; and (ii) in the development-simultaneous cleaning method having a higher process speed, to obtain a stable collectability in developing through more certain and uniform control of charging polarity during passage through the charging member of the photosensitive member, and even when reusing a portion of the collected residual toner after transferring in the developing step to subsequent development, to stably achieve a high-quality image without affecting the developing property.

The azo-based iron compound used in the invention has a structure as expressed by the following general formula (1):

General Formula (1):

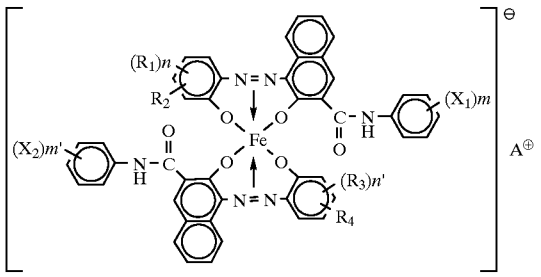

and wherein $X_1$ and $X_2$ are each members selected from the group consisting of hydrogen atoms, lower alkyl group, lower alkoxy group, nitro group and halogen atom; $X_1$ and $X_2$ are the same or different; m and m' are integers from 1 to 3; $R_1$ and $R_3$ are each members selected from the group consisting of hydrogen atom, $C_1$ to $C_{18}$ alkyl groups, $C_2$ to $C_{18}$ alkenyl groups, sulfonamide group, mesyl group, sulfonic acid group, carboxyester group, hydroxy group, $C_1$ to $C_{18}$ alkoxy groups, acetylamide group, benzoylamino group and halogen atoms; $R_1$ and $R_3$ are the same or different; n and n' are integers from 1 to 3; $R_2$ and $R_4$ are each hydrogen atom or nitro group; and A+ is a cation selected from the group consisting of ammonium ion, hydrogen ion, sodium ion, potassium ion and ion mixtures thereof. As employed herein the term "lower" includes $C_1$ to $C_6$ groups.

Typical examples of the azo-based iron compound as expressed by the foregoing general formula include the following compounds.

Azo-based iron compound (1)
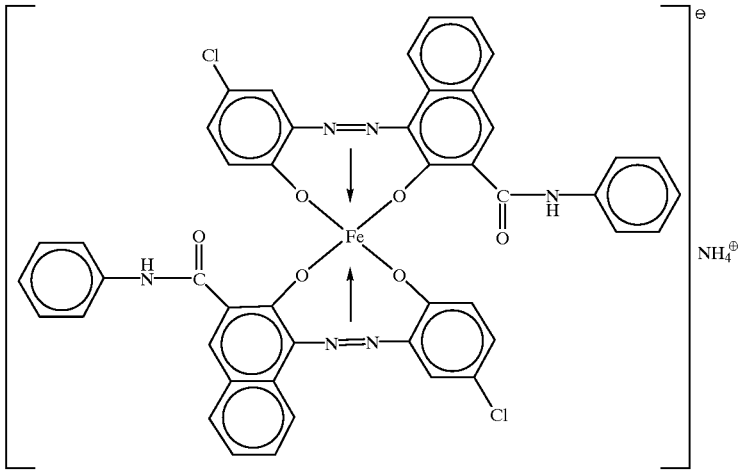
Azo-based iron compound (2)
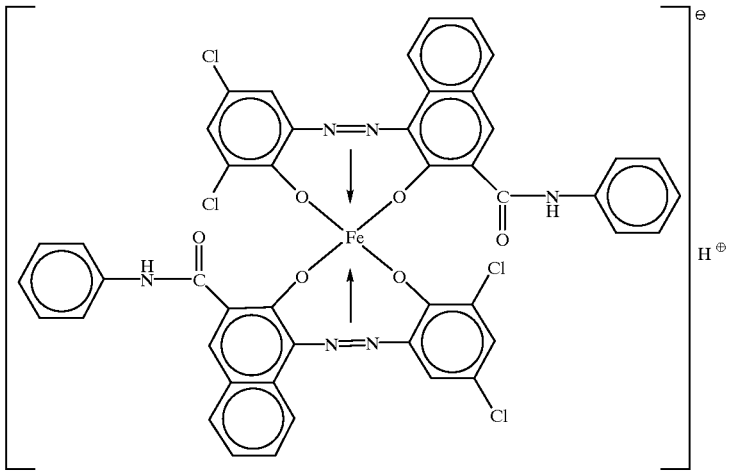
Azo-based iron compound (3)
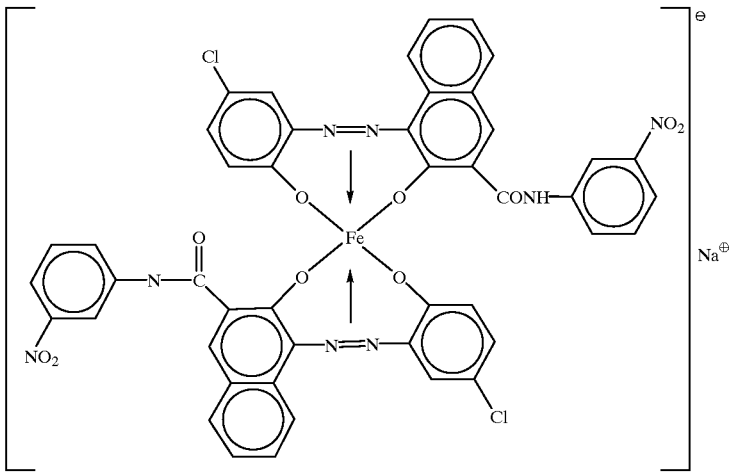

-continued

Azo-based iron compound (4)

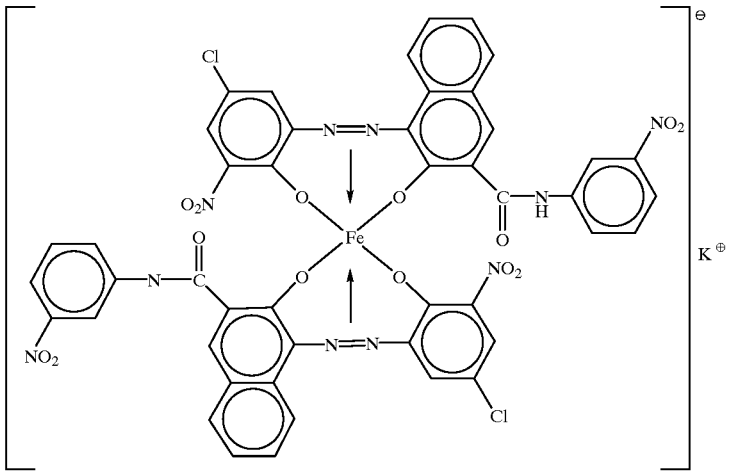

Azo-based iron compound (5)

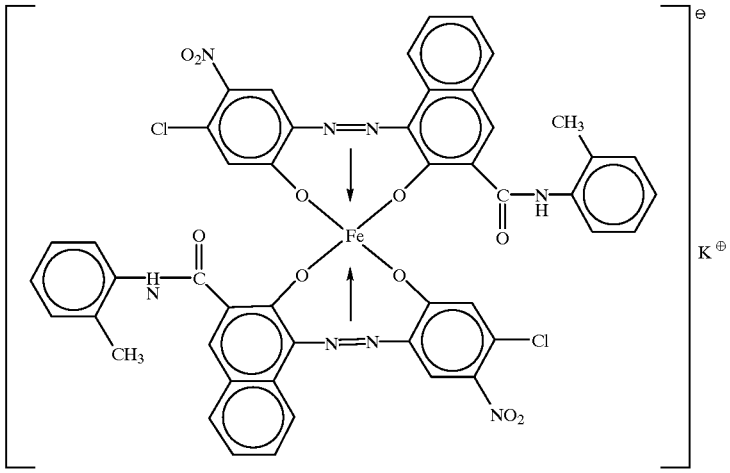

Azo-based iron compound (6)

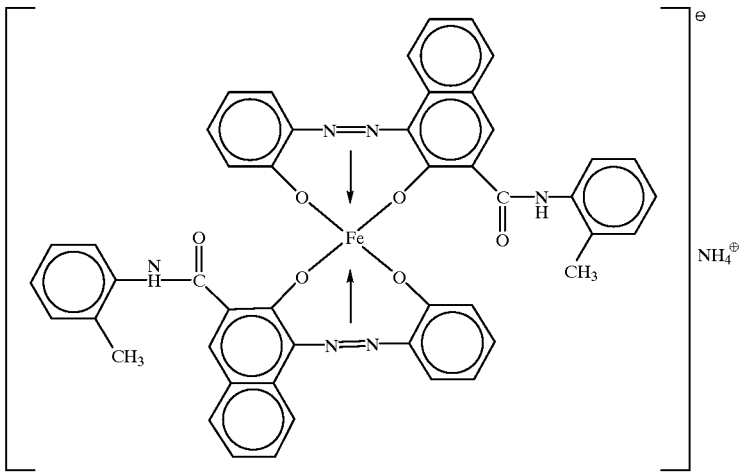

The above-mentioned azo-based iron compounds are applicable also as negative charge control agents and can by synthesized by known methods.

With a view to preventing adherence toner onto the toner carrying member or contamination of the surface of the charging member in forming an image onto a plurality of media, in the invention, the toner particles should preferably have a shape approximating a sphere. The shape factors or shape indices SF-1 and SF-2 representing the toner shape should take a value of 100<SF-1≦160 for SF-1, and 100<SF-2≦140 for SF-2, or more preferably, 100<SF-1≦140 for SF-1, and 100≦SF-2≦120 for SF-2, respectively, for improving the transfer property while maintaining the developing property.

In the invention, values determined using, for example, FE-SEM (S-800) made by Hitachi Limited, sampling at random 100 toners of over 2 μm enlarged to 1,000 magnifications, analyzing image information thereof via an interface in, for example, an image analyzer (Luzex III) made by Nicole Company, and performing a calculation in accordance with the following formulae are defined as shape factors SF-1 and SF-2:

$$SF-1=\frac{(MXLNG)^2}{\text{AREA}}\times\frac{\pi}{4}\times 100$$

$$SF-2=\frac{(PERI)^2}{\text{AREA}}\times\frac{1}{4\pi}\times 100$$

(where, MXLNG is a maximum absolute length of a particle, PERI is a circumferential length of the particle, and AREA is a projected area of the particle.)

The shape factor or index SF-1 represents the degree of roundness of a toner particle and the shape factor or index SF-2 represents the degree of surface irregularities of a toner particle.

With a toner shape factor SF-1 of over 160, the toner shape departs from being sphere-shaped and approaches an amorphous one, which tends to be crushed in the developing unit, is susceptible to easy variation of particle size distribution, easy broadening of charge amount distribution, and easy occurrence of surface fog or reversing fog. A toner shape factor SF-2 of over 140 results in a decrease in copying efficiency of a toner image upon copying the image from the photosensitive member to a copy medium, and results in a hollow character of line image.

With a view to achieving an accurate development of fine latent image dots for a higher image quality, the weight average particle size of the toner particles should be within a range of from 3 to 9 μm, or preferably, from 4 to 8 μm, and the coefficient of variation in the number distribution should be up to 35%, or preferably, up to 25%. When using toner particles having a weight average particle size of under 3 μm, many residual toner particles after transferring are present on the photosensitive member or the intermediate transfer member because of a decreased transferring efficiency, and a nonuniform image tends to be caused by fogging or defective transferring. When the weight average particle size of the toner particles is over 9 μm, adherence to the surface of the photosensitive member or the intermediate transferring member tends to easily occur. A coefficient of variation of over 35% in the number distribution of the toner particles further enhances this tendency.

The coefficient of variation A in the member distribution of toner particles is calculated from the following formula:

Coefficient of variation=$[S/D_1]\times 100$ [where, S is a standard deviation in the number distribution of toner particles, and D1 is a number average particle size (μm) of toner particles.]

For the measurement of the average particle size and the particle size distribution of toner particles, a Coulter counter TA-II or a Coulter multisize (made by Coulter Company) is used, and an interface (made by Nikkaki Company) which provides an output of the number distribution or the volume distribution and a PC9801 personal computer (made by NEC) are connected thereto. A 1% NaCl aqueous solution is prepared as an electrolyte by the use of class-1 sodium chloride. For example, an ISOTON R-II (made by Coulter Scientific Japan, Ltd.) is applicable. The measuring method comprises the steps of adding a surfactant (preferably alkylbenzensulfonate) as a dispersant in an amount of from 0.1 to 5 ml to the aforesaid aqueous electrolyte in an amount of from 100 to 150 ml, further adding a sample to be measured in an amount of from 2 to 20 mg, subjecting the electrolyte formed by suspending the sample to a dispersion treatment for one to three minutes in an ultrasonic dispersing unit, and measuring the volume and the number of toner particles having a size of over 2 μm using a 100 μm aperture by means of the aforesaid Coulter counter TA=II, thereby calculating a volume distribution and a number distribution. Then, a weight average particle size ($D_4$) based on volume determined from the volume distribution and a number average particle size ($D_1$) based on number as derived from the number distribution are determined.

To improve fixability and offset resistance of toner in the invention, it is recommendable to add a release agent to the toner particles.

The compound used as the release agent in the invention should preferably has a main endothermic maximum peak value (melting point) in a DSC curve measured in accordance with ASTM D3418-8 within a range of from 30 to 120° C., or more preferably, from 40 to 90° C. A maximum peak value (melting point) of wax of under 30° C. leads to a weak self-aggregation of the release agent, resulting in a poor high-temperature offset resistance. With a maximum peak value (melting point) of wax of over 120° C., on the other hand, the fixing temperature becomes higher, and it becomes difficult to appropriately smoothen the fixed image surface, thus leading to a decreased color mixing property.

Further, when preparing toner particles by the polymerization method in which granulation and polymerization are accomplished in an aqueous medium, a high endothermic maximum peak value (melting point) causes the release agent to mainly be precipitated during granulation.

For the measurement of a temperature of maximum peak value (melting point) of the release agent, for example, DSC-7 made by Perkin-Elmer Company is employed. Temperature correction at the equipment detector section is carried out by means of melting points of indium and zinc, and melting heat of indium is utilized for temperature correction of the equipment detector section. An aluminum pan is used as a sample, and an empty pan is set as control. Measurement is carried out at a temperature within a range of from 20 to 180° C. at a heating rate of 10° C./min.

Applicable release agents include paraffin wax, polyolefin wax, a polymethylene wax such as Fischer-Tropsch wax, amide wax, high-grade fatty acid, high-grade fatty acid metal salts, long-chain alkylalcohol, ester wax and derivatives thereof (for example, graft compounds thereof or block compounds thereof). Ester wax is particularly preferable because of the possibility of increased fixability since it serves as a plasticizer of a binder resin of a toner such as styrene-acryl copolymer toner upon heating and fixing a toner image.

In the invention, the toner is imparted with a core-shell structure in which the shell portion is formed of a polymer synthesized by polymerization, and the core portion is formed of a wax serving as a release agent. By using the image forming method of the invention, it is possible to prevent deterioration of the toner or contamination of the image forming apparatus, thus permitting maintenance of a satisfactory charging property. It is also possible to form a toner image excellent in its ability to reproduce a dot latent image for a long period of time. Wax exerts a favorable effect efficiently during heating, pressurizing, and fixing, thus permitting improvement of low-temperature fixability and high temperature offset resistance.

The toner having a core-shell structure as used in the invention means a toner having a structure in which the surface of the core portion comprising a wax serving as a release agent is covered with a shell portion formed of a polymer synthesized through polymerization of a polymerizable monomer. In the invention, the core-shell structure can be confirmed through observation of the sectional face of a toner particle.

Figure 9A:
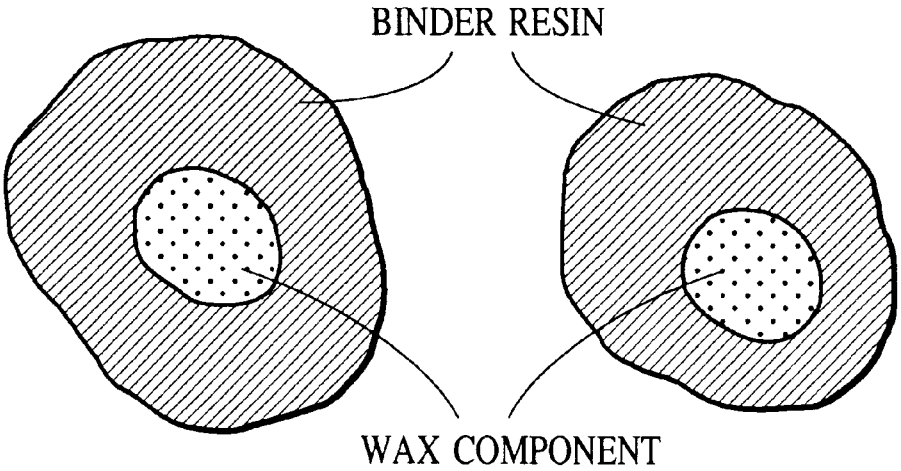
FIGS. 9A and 9B schematic diagrams illustrating sectional faces of a toner particles involving a wax component.
Figure 9B:
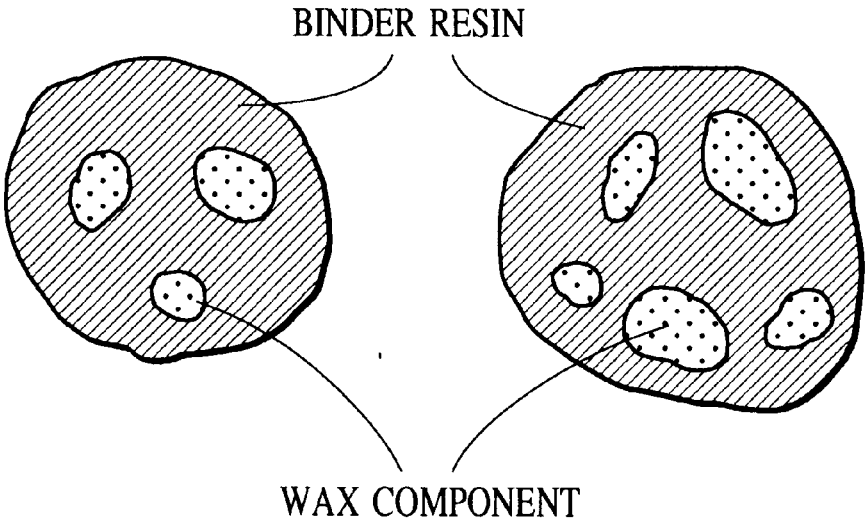

The sectional face of a toner particle can be observed by sufficiently dispersing toner particles in a room-temperature-setting epoxy resin, then causing the mixture to set in an atmosphere of 40° C. for two days, staining the resultant set product with triruthenic tetroxide, and simultaneously with triosmic tetroxide, cutting flake-shaped samples by means of a microtome provided with diamond teeth, and observing the sectional form of the toner particles with the use of a transmission type electron microscope (TEM). The triruthenic tetroxide staining method should preferably be employed to impart a contrast between the different materials by the utilization of a slight difference in degree of crystallinity between the wax and the resin forming the shell. Typical examples are illustrated in FIGS. 9A and 9B.

In the invention, the release agent contact of the toner particles should preferably be within a range of from 2 to 30 wt. %, or preferably, from 2 to 25 wt. %. A release agent content of under 2 wt. % leads to an insufficient improvement of fixability. A release agent content of over 30 wt. % easily causes on the other hand mutual bonding of toner particles during granulation even in the manufacture by the polymerization method, and easy generation of a broad particle size distribution, thus exhibiting unsuitability for the invention.

When a toner having a core-shell structure is prepared according to an embodiment of the invention, it is particularly desirable to further add a polar resin to the resin forming the shell portion to cause the shell portion to include the core portion comprising the wax serving as a release agent.

Preferable polar resins applicable in the invention include a copolymer of styrene and (meth) acrylic acid, a maleic acid copolymer, saturated polyester resin, and epoxy resin.

The polar resin content in the toner particles should preferably be within a range of from 1 to 20 wt. %, or more preferably, from 2 to 16 wt. % (relative to the toner weight).

With a polar resin content of under 1 wt. %, the effect of addition is not fully displayed. With a polar resin content of over 20 wt. %, on the other hand, an adverse effect is exerted in many cases on a charging property of the toner. Particularly, a decrease in the toner charging property is caused in a high-temperature, high-humidity environment.

An outermost shell resin layer may also be provided on the surface of the toner according to an embodiment of the invention.

For further improvement of blocking resistance, the glass transition temperature of the aforesaid outermost shell resin layer should be designed to be above the glass transition temperature of the shell resin layer, and should preferably be crosslinked to an extent not impairing fixability. This outermost shell resin layer should preferably contain a polar resin and a charge control agent for improving charging property.

The method for providing the aforesaid outermost shell layer is not limited to any particular one, but may be any one of the following examples.

1. A method of dissolving a polar resin, a charge control agent, and a binder resin as required in the reaction system in the latter half of, or after the completion of the polymerization reaction, adding a dispersed monomer, causing the added monomer to be adsorbed by polymerization particles, and polymerizing the same by adding a polymerization initiating agent.

2. A method of adding an emulsification-polymerization particles comprising a monomer containing as required a polar resin, a charge control agent, and a binder resin, or a soap-free polymerization particles into the reaction system, causing aggregation on the polymerization particle surface, and fixing the same by heating as required.

3. A method of mechanically dry fixing an emulsification-polymerization particles comprising a monomer containing as required a polar resin, a charge control agent, and a binder resin or soap-free polymerization particles to the surfaces of the toner particles.

When preparing toner particles containing wax and a polar resin by the application of the polymerizing method of preparing toner particles by polymerizing a monomer composition containing a wax serving as a release agent and polar resin, together with a coloring agent and a polymerizable monomer, in an aqueous medium, each of the prepared toner particles has a core-shell structure consisting of a core portion comprising the wax and a shell portion comprising a polymer synthesized from the polymerizable monomer and a polar resin, in which the polar resin is present in the outermost shell resin layer of the shell portion. In the case of toner particles of this form, therefore, a polar group is present on the surface of carbon black and serves as a coloring agent. Carbon black does not therefore penetrate into the non-polar wax, but is located in the shell portion, and tends to lead to a poorer coloring ability as compared with the toner particles in which carbon black is uniformly dispersed. Since the polar resin is present in the outermost shell layer of the shell portion, the ratio of carbon black in the surface portion of the toner particles becomes smaller. The frictional charging property of the toner therefore tends to be lower than that of toner particles not containing a polar resin.

According to this embodiment of the invention, however, the toner particles contain carbon black and a specific azo-based iron compound as described above. As a result, the carbon black dispersibility improving the effect of the azo-based iron compound inhibits the decrease in the coloring ability. It is also possible to inhibit the decrease in frictional charging property of the toner under the effect of dispersibility improvement of carbon black and a high charge control of the azo-based iron compound.

In the image forming method based on the one component contact developing method of the invention, the toner on the toner carrying member is in contact with the surface of the image carrying member. The toner should therefore preferably have durability and adhesion resistance to the surface of the toner carrying member and to the surface of the image carrying member.

As compared with the case using the one component noncontact developing method or the two-component developing method involving the toner and the carriers, the toner of the one component contact developing method is required to have a higher mechanical properties.

The resin component of the toner particles used in the invention should preferably have, in a molecular weight distribution as measured by Gel-Permeatin chromatogram (GPC) of THF(tetrahydrofuran)-soluble fraction, a component A having a molecular weight of under 1,000,000, component B having a molecular weight of over 1,000,000, and a THF-insoluble component C, satisfying the following conditions.

The THF soluble portion of the resin components (corresponding to the aforesaid component A and component B) of the toner particles in the invention should preferably have, in GPC molecular weight distribution, a number average molecular weight (Mn) within a range of from 9,000 to 1,000,000, or more preferably, from 10,000 to 500,000, and a ratio of the weight average molecular weight (Mw) to the number average molecular weight (Mn) (Mw/Mn) within a range of from 5 to 500, or more preferably, from 7 to 400 to achieve well balanced properties for the toner.

Toner particles can suitably be used in the image forming method of the invention when the toner particles, in terms of the weight of the component A, the component B and THF-insoluble component C of the resin components, satisfy the following conditions: (1) a content ($W_A$) of the component A is within a range of from 30 to 95 wt. %, or more preferably, from 50 to 90 wt. %; (2) a content ($W_B$) of the component B is within a range of from 0 to 20 wt. %, or more preferably, from 1 to 20 wt. %; (3) a content ($W_C$) of the THF-insoluble component C is within a range of from 0 to 70 wt. %, or more preferably, from 1 to 70 wt. %; and (4) a total content ($W_B$+$W_C$) of the component B and the THF-insoluble component C is within a range of from 5 to 70 wt. %, or more preferably, from 10 to 50 wt. %.

The resin components of the toner particles used in the invention show satisfactory matching with the image forming apparatus under the condition that the aforesaid component A (THF soluble fraction of a molecular weight under 1,000,000 has a main peak in a region of molecular weight of from 3,000 to 50,000, or more preferably, from 5,000 to 22,000. A main peak in a region of a molecular weight of under 3,000 easily causes deterioration of toner charging property, adhesion at the contact portion with the image forming apparatus or a decrease in high-temperature offset resistance or in blocking resistance. A main peak corresponding to a molecular weight of over 50,000, on the other hand, tends to cause flaws in the contact portion with the image forming apparatus, or a serious decrease in low-temperature fixability.

A content ($W_A$) of the component A of under 30 wt. % tends to cause a decrease in low-temperature fixability, and a content of the component A of over 95 wt. % leads to a poorer matching with the image forming apparatus and tends to cause toner adhesion or deterioration of image quality. A content ($W_B$) of the component B of over 20 wt. % should be avoided because it causes a decrease in low-temperature fixability although there is available an improvement of high-temperature offset resistance.

A content ($W_C$) of the THF-insoluble component C of over 70 wt. % causes a trouble in matching with the image forming apparatus or makes it difficult to achieve low-temperature fixing. Even in the complete absence of the THF-insoluble component C, it is possible to maintain developability and fixability only if the content ($W_B$) of the component B is within a range of from 5 to 20 wt. %, or more preferably, from 10 to 20 wt. %. In the complete absence of the component B, on the other hand, it is also possible to maintain developability and fixability only if the content ($W_C$) of the THF-insoluble component C is within a range of from 5 to 70 wt. %, or more preferably, from 10 to 70 wt. %.

Further, the total content ($W_B$+$W_C$) of the component B and THF-insoluble component C should preferably be within a range of from 5 to 70 wt. %, or more preferably, from 10 to 50 wt. %. A total content ($W_B$+$W_C$) of the component B and THF-insoluble component C of under 5 wt. % leads to deterioration of a charging property or high-temperature offset resistance, or further, of matching with the image forming apparatus and tends to cause adhesion of the toner or degradation of the image quality. A total content ($W_B$+$W_C$) of the component B and THF-insoluble component C of over 70 wt. % is not desirable because of a resultant decrease in low-temperature fixability.

In the invention, the molecular weight and the contents ($W_A$, $W_B$ and $W_C$) of the each components (components A, B and THF-insoluble component C) in the toner particles are measured and calculated by the following method.

The THF-insoluble component C in the invention means a resin component which has become insoluble in THF of the resin components in the toner particles, of which the content serves as a reference showing the extent of crosslinking of the resin composition containing a crosslinking component. This does not, however, mean that crosslinking never occurs even the THF insoluble content is 0 wt. %. The content ($W_C$) of the THF-insoluble component C is defined as a value measured as follows.

First, the contents of additives in the toner particles such as a pigment is previously measured by a known method. The subsequent process comprises the steps of weighing a certain amount of the developer with a range of from 0.5 to 1.0 g ($W_1$g), placing the same in a Soxlet extractor by putting the same in a cylindrical filter paper (made by Toyo Roshi Company; No. 86R), performing extraction for 20 hours by the use of THF as a solvent in an amount within a range of from 100 to 200 ml, evaporating the soluble components thus extracted by the solvent, then vacuum-drying the extract at 100° C. for several hours, and weighing the amount of the THF-soluble resin components ($W_2$g). From among the additives such as the pigment, if the weight of the THF-soluble components is $W_3$g, and the weight of the THF-soluble components is $W_4$g, then the quantity of THF-insoluble components (the component C above) in the resin component can be calculated by the following formula:

$$THF - \text{soluble components (wt. \%)} = \frac{(W_1 - W_2 - W_4)}{(W_1 - W_3 - W_4)} \times 100.$$

On the other hand, the main peak position and the content (WA) of the component A having, in the GPC molecular weight distribution of THF-soluble fraction, a molecular weight of under 1,000,000, and the content ($W_B$) of the component B having a molecular weight of over 1,000,000 (relative to the resin components in weight) are determined from a molecular weight distribution derived from THF-soluble resin components obtained upon the foregoing Soxley extraction used as GPC measuring samples. The measured value is converted into a weight to determine wt. % values of the components A and B, on an assumption that the area % is equal to the weight % in a region of molecular weight under 1,000,000 (component A) and in a region of molecular weight over 1,000,000 (component B).

In the invention, the resin components include the wax component in addition to the binder resins.

In the invention, the molecular weight distribution of the resin components in the toner particles is measured by GPC (Gel Permeation Chromatography) under the following conditions. A sample previously dispersed/dissolved in a solvent and then filtered through a solvent-resistant membrane filter (pore diameter: 0.3 $\mu$m) is employed:

Apparatus: GPC-150C (made by Waters Company)

Column: Seven steps of KF801-7 (made by Showdex Company)

Temperature: 40° C.

Solvent: THF

Flow velocity: 1.0 ml/min.

Sample: A sample of a concentration of 0.05 to 0.06 wt. % Injected in an amount of 0.1 ml.

Measurement is carried out under the foregoing conditions, and upon calculating the molecular weight of the sample, a molecular weight calibration curve prepared by means of a simple-dispersion polystyrene standard sample is used.

Binder resins of the toner applicable in the invention include commonly utilized a styrene-(meth) acryl copolymer, a polyester resin, and epoxy resin, and a styrene-butadiene copolymer. The monomers thereof are appropriately applicable in the method for obtaining a toner by the polymerization method. More specifically, there are suitably applicable styrene-based monomers such as styrene, o(m-, p-)-methylstyrene, m(p-)-ethylstyrene; (meth) acrylic acid ester-based monomers such as methyl (meth) acrylate, ethyl (meth) acrylate, propyl (meth) acrylate, butyl (meth) acrylate, octyl (meth) acrylate, dodecyl (meth) acrylate, .stearyl (meth) acrylate, behenyl (meth) acrylate, 2-ethylhexyl (meth) acrylate, dimethylamonoester (meth) acrylate, and diethylaminoethyl (meth) acrylate; and ene-based monomers such as butadiene, isoprene, cyclohexene, (meth) acrylonitrile, and amide acrylate. These monomers are used singly or in an appropriate combination so that the theoretical glass transition temperature (Tg) as set out in the Polymer Handbook, 2nd ed., pp.139–192 (John Wiley & Sons) exhibits a temperature within a range of from 40 to 75° C. With a theoretical glass transition temperature of under 40° C., problems are encountered regarding storage stability of toner or durable stability of developer, and with a temperature of over 75° C., there occurs an increase in the fixing point.

In the invention, furthermore, a crosslinking agent should preferably be used upon synthesizing a binder resin for the purpose of generating the aforesaid THF insoluble fraction and/or generating components having a molecular weight of over 1,000,000.

Crosslinking agents applicable in the invention include difunctional crosslinking agents such as divinylbenzene, bis (4-acryloxypolyethoxyphenyl) propane, ethyleneglycol diacrylate, 1,3-butyleneglycol diacrylate, 1,4-butadiol diacrylate, 1,5-pentanediol diacrylate, 1,6-hexanediol diacrylate, neopentylglycol diacrylate, diethyleneglycol diacrylate, triethyleneglycol diacrylate, tetraethyleneglycol diacrylate, diacrylates of polyethyleneglycol #200, #400 and #600, dipropyleneglycol diacrylate, polypropyleneglycol diacrylate, polyester-type diacrylates (MANDA made by Nihon Kagaku Company) and ones formed by-replacing diacrylate of the above-enumerated agents with methacrylate.

Applicable polyfunctional crosslinking agents include pentaerythritol triacrylate, trimethylolethane triacrylate, trimethylpropane triacrylate, tetramethylolmethane tetracrylate, oligoester acrylate and methacrylate thereof, 2,2-bis (4-methacryloxy, polyethoxyphenyl) propane, diarylphthalate, triarylcyanelate, triarylisocyanelate, and triaryltrimerytate.

The amount of the crosslinking agent should preferably be within a range of from 0.05 to 10 weight parts, or more preferably, from 0.1 to 5 weight parts relative to 100 weight parts of the other vinyl-based monomers.

When the consumption of the crosslinking agent is under 0.05 weight parts, the crosslinking reaction of the binder resin is not accomplished sufficiently, and with a consumption of over 10 weight parts, the crosslinking reaction of the binder resin proceeds too much. In both cases, it becomes difficult to control the content of THF-insoluble fraction in the toner particles within a range of from 5 to 70 wt. %.

While the azo-based iron compound used in a preferred embodiment of the invention has a function of a charge control agent, another charge control agent may further be used simultaneously. A known charge control agent may be used as this additional charge control agent, which should preferably be able to stably maintain a certain amount of charge with a high charging speed. Further, when preparing toner particles by the polymerization method in the invention, it is particularly desirable to use a charge control agent, which does not have a polymerization preventing effect and is free from substance soluble in an aqueous medium.

Preferable examples of the aforesaid additional charge control agent include, for negative uses, metal compounds of salicylic acid, dicarboxylic acid and derivatives thereof, metal compounds of azo-based pigments and derivatives thereof, polymer type compounds having sulfonic acid or carboxylic acid at a side chain thereof, boron compounds, urea compounds, silicon compounds, and cliscarene. For positive uses, preferable examples include nigrosine, triphenylmethane-based compounds, quaternary ammonium salts, polymer type compounds having a quaternary ammonium salt at a side chain thereof, guanidine compounds, and imidazole compounds.

The content of the additional charge control agent in the toner particles should preferably be within a range of from 0.2 to 10 weight parts, or more preferably, from 0.5 to 5 weight parts relative to 100 weight parts of the binder resin. In a preferred embodiment of the invention, however, addition of the additional charge control agent is not required, and it is not always necessary for the toner to contain the additional charge control agent, even when using the non-magnetic one component blade coating developing method, by positively utilizing frictional charging with a blade member or a sleeve member.

When preparing toner particles by the polymerization method in the invention, applicable polymerization initiators include azo-based polymerization initiators such as 2,2-azobis-(2,4-dimethylvaleronitride), 2,2'-azobisisobutyronitride, 1,1'-azobis (cyclohexane-l-carbonitride), 2,2'-azobis-4-methoxy-2, 4-dimethylvaleronitride, and azobisisobutyronitride; and peroxide-based polymerization initiator such as benzoyl peroxide, methylethylketone peroxide, diisopropyl peroxycarbonate, cumenehydroperoxide, 2,4-dichlorobenzoyl peroxide, and lauroyl peroxide.

The amount of added polymerization initiator should usually be within a range of from 0.5 to 20 wt. % relative to the monomers, varying with the target degree of polymerization. The kind of initiator,. varying with the method of polymerization, may be single or a combination with reference to the 10-hour half-period temperature.

A known crosslinking agent, chain transfer agent, or polymerization inhibitor may further be added to control the degree of polymerization.

When using suspension polymerization for pre preparation of the toner in the invention, inorganic oxides applicable as dispersants include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. Applicable organic compounds include sodium salts of polyvinyl alcohol, gelatine, methylcellulose, methylhydroxypropylcellulose, ethylcellulose, and carboxymethylcellulose, and starch dispersed in an aqueous phase. The consumption of the dispersant should preferably be within a range of from 0.2 to 10 weight parts relative to 100 weights of the polymerizable monomers.

Of these dispersants, a commercially available one may be used as is. In order to obtain dispersed particles having a fine and uniform particle size, the inorganic compound may be. generated during high-speed stirring in a dispersion medium. In the case of tricalcium phosphate, for example, a dispersant suitable for the suspension polymerization method is available by mixing an aqueous sodium phosphate solution and an aqueous calcium chloride solution while stirring at a high speed. A surfactant in an amount within a range of from 0.001 to 0.1 weight parts may be used for refinement of the dispersant. More specifically, a commercially available nonion, anion, or cation type surfactant may be used. Applicable surfactants include dodecyl sodium sulfate, tetradecyl sodium sulfate, pentadecyl sodium sulfate, actyl sodium sulfate, sodium oleate, sodium laurate, potassium stearate, and calcium oleate.

When using the polymerization method for the preparation of toner according to a preferred embodiment of the invention, it is possible to manufacture a toner by the following method.

A polymerizable monomer composition is prepared by adding carbon black and an azo-based iron compound, and as required a charge control agent, a polymerization initiator, and other additives to a polymerizable monomers, and uniformly dissolving or dispersing the mixture by means of a mixer such as a homogenizer or an ultrasonic disperser. The thus prepared polymerizable monomer composition is dispersed in an aqueous phase containing a dispersion stabilizer by an ordinary stirrer or a mixer such as a homo-mixer or a homogenizer. Preferably, granulation is conducted by adjusting the stirring speed and time so that liquid drops comprising the polymerizable monomer composition have a size of the desired toner particles. Thereafter, the particle state is maintained under the effect of the dispersion stabilizer, and it suffices to stir the composition to such extent that precipitation of particles is prevented. The polymerization temperature should be usually set within a range of from 50 to 90° C. Temperature may be raised in the latter half of the polymerization reaction, and further, for the purpose of improving durability in the image forming method using the toner of the invention, the aqueous medium may partially be removed by distillation in the latter half of the polymerization reaction or after the completion of the polymerization reaction to remove not-as-yet reacting polymerizable monomer and by-products. After the completion of the polymerization reaction, the generated toner particles are washed, collected through filtration, and dried. In the suspension polymerization method, water in an amount within a range of from 300 to 3,000 weight parts should preferably be used relative to 100 weight parts of monomers.

In a preferred embodiment of the invention, as described above, the polymerizable monomer composition is prepared via a master batch step with a view to improving dispersibility of carbon black in the toner particles.

It is possible to mix carbon black to a very high concentration with the polymerizable monomers by mixing and dispersing carbon black in an amount within a range of from 4 to 40 weight parts, or more preferable, from 5 to 25 wt. % relative to 100 wt. % of the first polymerizable monomers, and the azo-based iron compound in an amount within a range of from 0.2 to 5 weight parts, or more preferably, from 0.5 to 3 weight parts, thus resulting in a higher viscosity of the dispersion solution, and sufficient share upon mixing. It is therefore possible to remarkably improve dispersibility of carbon black by the combination with dispersion effect of the azo-based iron compound.

When the amount of mixed carbon black is under 4 weight parts, the dispersed solution has a low-viscosity even if the azo-based iron compound is used, thus making it difficult to achieve a sufficient dispersion. With an amount of over 40 weight parts, on the other hand, it becomes difficult to control viscosity of the dispersed solution, resulting in nonuniform dispersion.

An amount of mixed azo-based iron compound of under 0.2 weight parts leads to an insufficient viscosity increasing the effect of the dispersed solution, and an amount of over 5 weight parts tends to cause nonuniform dispersion because of a decrease in viscosity.

The dispersed solution (master batch) containing the first polymerizable monomers, carbon black and azo-based iron compound, and as required, a wax component and/or a charge control agent should preferably have a viscosity within a range of from 100 to 2,000 centipoises, or more preferably, from 150 to 1,600 centipoises.

When the viscosity of this dispersed solution is under 100 centipoises, a share of dispersion is unavailable because of a very low viscosity, thus making it difficult to achieve uniform dispersion of carbon black. A viscosity of over 2,000 centipoises results in a difficulty in keeping the uniform dispersion state because of the very high viscosity, and leads to deterioration of discharge from the manufacturing apparatus and a decrease in productivity.

A polymerizable monomer compared is prepared by mixing this dispersed solution with a second polymerizable monomer, and further as required, a wax component, a polymer containing a polar functional group, a charge control agent, a polymerization initiator and other additives.

The amount of the mixed second polymerizable monomer relative to 100 weight parts of the dispersed solution should preferably be within a range of from 20 to 100 weight parts, or more preferably, from 30 to 70 weight parts, in terms of a uniform dispersion of the master batch components in the second polymerizable monomer.

When the amount of the mixed second polymerizable monomer is under 20 weight parts, uniform dispersion takes much time. When 100 weight parts are exceeded, on the other hand, reaggregation of carbon black tends to occur, taking also much time before uniform dispersion.

The content ratio of carbon black to the weight of the polymerizable monomer composition should preferably be within a range of from 1 to 20 wt. %, or more preferably, from 3 to 15 wt. % with a view to stabilizing coloring ability of the toner and charging thereof.

A content ratio of carbon black in the polymerizable monomer composition of under 1 wt. % makes it difficult to achieve a high image concentration, and a ratio of over 20 wt. % tends to cause low charging of the toner in a high humidity.

The content ratio of the azo-based iron compound to the weight of the polymerizable monomer composition should preferably be within a range of from 0.1 to 3.0 wt. %, or more preferably,. from 0.2 to 2;0 wt. % with a view to maintaining an appropriate state of viscosity of the dispersed solution to improve uniform dispersion of carbon black.

When the content ratio of the azo-based iron compound in the polymerizable monomer composition is under 0.1 wt. %, viscosity of the dispersed solution remains low, and the dispersity improving effect of carbon black cannot be displayed. When the ratio is over 3.0 wt. %, on the other hand, there occurs a decrease in viscosity of the dispersed solution, and this causes also disappearance of the dispersity improving effect of carbon black.

In the invention, it is desirable to adopt a configuration in which appropriate fluidity and charging properties are imparted to the toner particles, cleanability is improved, and stress from the members in contact such as the charging member of the photosensitive member can be alleviated by covering the toner particle surfaces with an additive. The covering ratio of toner surfaces with the additive should preferably be within a range of from 5 to 99%, or more preferably, from 10 to 99%. It is possible to improve transferring efficiency and prevent a hollow character of a line image by the presence of an inorganic fine powder serving as the covering additive on the toner particle surfaces.

The covering ratio of the toner particle surfaces is determined by sampling 100 toners at random by means of an FE-SEM (S-800) made by Hitachi Limited, and carrying out an analysis by entering the image information thereof via an interface into an image analyzer (Luzex 3) made by Nicole Company.

The covering additive used in the invention should preferably have an average particle size smaller than 1/10 the weight average particle size of the toner particle size, taking account of durability upon addition to the toner. The average particle size of the covering additive means the average particle size as determined through surface observation of the toner particles on an electron microscope.

Applicable covering additives include metal oxides (such as aluminum oxide, titanium oxide, strontium titanate, cerium oxide, magnesium oxide, chromium oxide, tin oxide and zinc oxide), nitrides (such as silicon nitride), carbides (such as silicon carbide), metal salts (such as calcium sulfate, barium sulfate, and calcium carbonate), fatty acid metal salts (such as zinc stearate and calcium stearate), carbon black, and silica.

The consumption of the covering additive relative to 100 weight parts of the toner particles should preferably be within a range of from.0.01 to 10 weight parts, or more preferably, from 0.05 to 5 weight parts. Any of the above-enumerated covering additives may be used alone or in combination of two ore more thereof. More preferable is one subjected to a hydrophobic treatment.

At least one component of the inorganic fine powder used in the invention should preferably be a fine powder selected from the group consisting of silica, alumina, titania, double oxides thereof and mixtures thereof to improve charging stability, developability, fluidity, and storage properties. Among others, silica is the most suitable. For example, both dry type or fumed silica generated by vapor phase oxidation of a silicon halide or alkoxide, and wet type silica manufactured from alkoxide water glass are applicable. The dry type silica containing fewer silanol groups on the surface and in silica fine powder and a smaller amount of residual $Na_2O$ and $SO_3^{2-}$ is more preferable. With dry type silica, it is possible to obtain a composite fine powder of silica and other metal oxides by using, in the manufacturing step, other metal halides such as aluminum chloride and titanium chloride together with a silicon halide.

The inorganic fine powder used in the invention should preferably have a specific surface area achieved by nitrogen adsorption as measured by the BET method of at least 30 $m^2/g$, or more preferably, within a range of from 50 to 400 $m^2/g$ to obtain a satisfactory result. The inorganic fine powder should preferably be used in an amount within a range of from 0.1 to 8 weight parts, or more preferably, from 0.5 to 5 weight parts, or further more preferably, from over 1.0 weight parts to 3.0 weight parts relative to 100 weight parts of the toner particles. The inorganic fine powder used in the invention may previously be treated as required with silicone varnish, various kinds of denatured silicone varnish, silicone oil, various kinds of denatured silicon oil, a silane coupling agent, a silane coupling agent having a functional group, other organic silicon compounds, organic titanium compounds and other treatment agents alone or in combination for hydrophobic treatment or charging property control.

In order to maintain a high charge amount and thus to achieve a low consumption and a high transferring ratio, the inorganic fine powder should preferably be previously treated at least with silicone oil.

It is another preferable practice to further add an inorganic or organic fine particle having a shape approximating to a sphere with a primary particle size of at least 50 nm (or preferably a specific surface area of under 30 $m^2/g$). Applicable almost spherical fine particles include, for example, spherical silica particles, spherical polymethylsilcesquioxane particles and spherical resin particles.

Slight amounts of other additives may be added to the toner of the invention to an extent not substantially exerting an adverse effect. Such additives include a smoothening agent powder such as polytetrafluoroethylene powder, zinc stearate powder, and vinylidene polyfluoride; an abrasive such as cerium oxide powder, silicon carbide powder, and strontium titanate powder; a fluidity imparting agent such as titanium oxide powder, and aluminum oxide powder; a caking inhibitor; a conductivity imparting agent such as carbon black powder, zinc oxide powder and tin oxide powder; an organic fine particle of a reverse polarity; and a developability improving agent such as an inorganic fine particle.

In addition to the foregoing polymerization method, there are available the following methods for preparing the toner particles used in the invention: a toner manufacturing method based on a pulverizing method comprising the steps of uniformly dispersing a binder resin, an azo-base iron compound, carbon black, and a release agent by means of a pressure kneader, and extruder or a media dispersing machine, pulverizing the mixture to collide a target mechanically or in a jet air flow, finely pulverizing the same into a desired toner particle size, and then after a classifying step, sharpening the particle size distribution into a toner; a method of obtaining a spherical toner by atomizing a molten mixture in the air by means of a disk or a multi-liquid nozzle, as disclosed in Japanese Patent Publication No. 56-13,945; a dispersing polymerization method of directly generating a toner through polymerization of a polymerizable monomer by the use of an organic solvent in which a polymerizable monomer but a polymer is insoluble; and an emulsifying polymerization method as typically represented by the soap-free polymerization method of generating a toner through direct polymerization in the presence of a water-soluble polar polymerization initiator.

According to a preferred embodiment of the invention, it is desirable to impart strippability to the surface of the photosensitive member, and the contact angle of the surface of the photosensitive member should preferably be at least 85°, or more preferably, at least 90°.

A larger contact angle of the photosensitive member surface corresponds to a high strippability of the surface of the photosensitive member. Under this effect, the amount of residual toner after copying can be considerably reduced. It is also possible to largely reduce the load in the cleaning step, and certainly prevent occurrence of defective cleaning.

As a result of a high strippability of the photosensitive member surface, it is possible to considerably reduce the amount of residual toner after transferring, substantially prevent a negative ghost image under the effect of almost complete absence of light shielding by the residual toner after transferring, and prevent a positive ghost image through improvement of collecting efficiency in the development region of residual toner after transferring during development.

Now, the occurring mechanism of a ghost image will be described below.

A problem to be noted posed by light shielding by the residual toner after transferring is that, when the surface of the photosensitive member is repeatedly used for a single transfer medium, i.e., when the length of a toner of the photosensitive member is shorter than the length of the transfer medium in the forward direction, charging, exposure, and development must be performed in a state in which the residual toner after copying is present on the photosensitive member. As a result, potential on the surface portion of the photosensitive member having the residual toner after transferring does not decrease sufficiently, leading to an insufficient contrast in development, appearing as a ghost on the image, with a concentration lower than that of the surrounding portions in reversal developing.

When the cleaning effect of residual toner after transferring during development, on the other hand, the toner developed onto the surface of the photosensitive member having residual toner after transferring remaining on it has a higher concentration than that of the surrounding portions, thus causing a positive ghost.

The ghost image as described above can substantially be prevented by adopting the configuration of a preferred embodiment of the invention.

The image forming method of a preferred embodiment of the invention is effective in a case where the surface of the photosensitive member mainly comprises a polymer bonding agent, i.e., (i) a case where a protecting film mainly comprising a resin is provided on an inorganic photosensitive member of selenium or amorphous silicon; (ii) a case where there is a surface layer having a charge transfer material an a resin as a charge transfer layer of a function separating type organic photosensitive member; or (iii) a case where a protecting layer as described above is further provided thereon. For imparting strippability to such a surface layer, the following means are available:

(1) Using a resin forming the film, which has a low surface energy;

(2) Adding an additive so as to impart water repellency and lipophilic property; and (3) Dispersing a material having a high strippability in a powdery state.

The process (1) is achieved by introducing a fluorine-containing group and a silicone-containing group into the resin structure. For (2) above, it suffices to add a surfactant. The process (3) uses a compound containing fluorine atoms such as polytetrafluoroethylene, polyvinylidenefluoride, and carbon fluoride.

It is possible to achieve a contact angle of at least 85° between the photosensitive member surface and water by any of these means. A contact angle of the photosensitive member surface to water of under 85° leads to easy occurrence of deterioration of toner and the toner carrier after a long service.

Among others, a fluorine-containing resin such as ethylene polytetrafluoroethylene or polyvinylidenefluoride is the most suitable. In the invention, when using a fluorine-containing resin of (3) as a release powder, dispersion in the outermost surface layer is appropriate.

In order for the surface to contain such a powder, it suffices to provide a layer in which the powder is dispersed in the binder resin on the outermost surface layer of the photosensitive member, or in the case of an organic photosensitive member mainly composed of the resin, to disperse the powder in the outermost surface layer, without the need to provide a new surface layer.

The amount of the powder added to the surface layer should preferably be within a range of from 1 to 60 wt. %, or more preferably, from 2 to 50 wt. % relative to the total weight of the surface layer. An amount under 1 wt. % leads to an insufficient decrease in the amount of residual toner after transferring, an insufficient cleaning efficiency of residual toner after transferring, and a poor ghost preventing effect. An amount of addition of over 60 wt. % results in a decrease in the film strength, and a serious decrease in the amount of light entering the photosensitive member. From the point of view of image quality, the powder should preferably have a particle size of under 1 $\mu$m, or more preferably, under 0.5 $\mu$m. A particle size of over 1 $\mu$m is practicable because disturbance of the incident light results in a poor line distinctness.

A preferred embodiment of the invention is particularly effective in the case of the contact charging method in which the charging means brings the charging member into contact with the photosensitive member. More specifically, a large amount of residual toner after transferring causes adhesion thereof directly to the charging member in the subsequent step, thereby causing defective charging. It is necessary to reduce the amount of residual toner to inhibit adhesion as compared with corona discharge in which the charging means does not come into contact with the photosensitive member.

Now, a preferable embodiment of the photosensitive member used in the invention will be described below.

The conductive substrate comprises a cylinder and a film, and applicable materials thereof include metals such as aluminum and stainless steel; plastics having a coating layer of an aluminum alloy or an indium oxide-tin oxide alloy; paper or plastics impregnated with conductive particles; and plastics having a conductive polymer.

An undercoat layer may be provided on the conductive substrate for the purpose of improving adherence of the photosensitive layer, improving coating property, protecting the substrate, covering defects on the substrate, improving charge injecting property from the substrate, and protecting the photosensitive layer from electrical destruction.

The undercoat layer is formed with a material selected from the group consisting of polyvinyl alcohol, poly-N-vinylimidazole, polyethylene oxide, ethyl cellulose, methyl cellulose, nitrocellulose, ethylene-acrylic acid copolymer, polyvinylbutyral, phenol resin, casein, polyamide, copolymerized nylon, glue, gelatine, and aluminum oxide. The undercoat layer should preferably have a thickness within a range of from 0.1 to 10 $\mu$m, or more preferably, from 1 to 3$\mu$m.

The charge generating layer is formed by dispersing in an appropriate binder and coating, or by depositing by vapor deposition one substance selected from inorganic charge generating substances such as azo-based pigment, phthalocyanine-based pigment, indigo-based pigment, perylene-based pigment, polycyclic quinone-based pigment, squarilium coloring matter, pyrylium salts, thiopyrylium salts, triphenylmethane coloring matter, selenium and non-crystalline silicon. Among others, a phthalocyanine-based pigment is preferable for adjusting the photosensitive member sensitivity to a level suitable for the invention. A binder can be selected from a wide range of binding resins including polycarbonate resin, polyester resin, polyvinylbutyral resin, polystyrene resin, acrylic resin, methacrylic resin, phenol resin, silicone resin, epoxy resin, and vinyl acetate resin. The amount of binding resin contained in the charge generating layer should preferably be under 80 wt. %, or more preferably, within a range of from 0 to 40 wt. %. The charge generating layer should preferably have a thickness of under 5 $\mu$m, or more preferably, within a range of from 0.05 to 2 $\mu$m.

The charge transfer layer has a function of receiving a charge carrier from the charge generating layer in the presence of an electric field, and transferring the same. The charge transfer layer is formed by dissolving a charge transfer material, together with a binding resin as required, into a solvent, and coating the same, with a thickness usually within a range of from 5 to 40 $\mu$m. Applicable charge transfer materials include a polycyclic aromatic compound having anthracene, pyrene, or phenanthrene at a main or side chain, a nitrogen-containing cyclic compound such as indole, carbazole, oxadiazole or pyrazoline; a hydrazone compound; a styryl compound; selenium; selenium-tellurium; non-crystalline silicon; and cadmium sulfate.

Binding resins applicable for dispersion of the charge transfer material include resins such as polycarbonate resin, polyester resin, ester polymethacrylate, polystyrene resin, acrylic resin, and polyamide resin; and organic photoconductive polymers such as poly-N-vinylcarbazole and polyvinyl anthracene.

A protecting layer may be provided as a surface layer. Resins applicable for the protecting layer include polyester, polycarbonate, acrylic resin, epoxy resin, phenol resin, and setting agents of these resins alone or in combination of two or more.

Conductive fine particles may be dispersed in the resin of the protecting layer. Examples of the conductive fine particles include metals and metal oxides preferably such as zinc oxide, titanium oxide, tin oxide, antimony oxide, indium oxide, bismuth oxide, titanium oxide coated with tin oxide, indiums oxide coated with tin, tin oxide coated with antimony, and zirconium oxide fine particles. These may be used alone or in combinations of two or more. When dispersing particles in the protecting layer in general, the particle size of particles must be smaller than the wavelength of the incident light so as to prevent scattering of the incident light caused by dispersed particles. The particle size of the conductive and insulating particles dispersed in the protecting layer should preferably be under 0.5 $\mu$m. The content thereof in the protecting layer should preferably be within a range of from 2 to 90 wt. %, or more preferably, from 5 to 80 wt. % relative to the total weight of the protecting layer. The protecting layer should preferably have a thickness within a range of from 1 to 10 $\mu$m, or more preferably, from 1 to 7 $\mu$m.

Coating of the surface layer can be accomplished by coating the resin dispersed solution by spray coating, beam coating, or dipping.

The condition for the developing step is that the toner layer on the toner carrying member should be in contact with the surface of the photosensitive member.

For the one component developer there is available another method of using an elastic roller as the toner carrying member, and bringing a toner layer formed by coating the toner on the surface of the elastic roller into contact with the surface of the photosensitive member. In this case, it is important that the toner may be either magnetic or non-magnetic, and the toner layer is in contact with the surface of the photosensitive member. The toner carrying member is substantially in contact with the surface of the photosensitive member. This means that, when the toner layer is removed from the toner carrying member, the toner carrying member comes into contact with the surface of the photosensitive member. In order to obtain an image free from the edge effect by an electric field acting between the surface of the photosensitive member and the elastic roller facing the photosensitive member surface via the toner layer, it is necessary that the elastic roller surface or the proximity thereof should have a potential, and there is present an electric field between the photosensitive member surface and the toner carrying member surface. For this purpose, it suffices to maintain the electric field while preventing conduction with the photosensitive member surface through resistance control of the elastic rubber of the elastic roller within the medium resistance region, or to provide a thin insulating layer on the surface layer of the conductive roller. Further, there is available another configuration in which a conductive resin sleeve formed by covering the outer side of the conductive roller facing the photosensitive member surface with an insulating material is provided, or a conductive layer on the inner side of the insulating sleeve not facing the photosensitive member surface is provided. It is also possible to use a configuration in which a rigid roller is used as a toner carrying member, and a flexible photosensitive member such as a belt is used. Electric resistance of the developing roller serving as a toner carrier should preferably be within a range of from $10^2$ to $10^9$ Ω.

Figure 10:
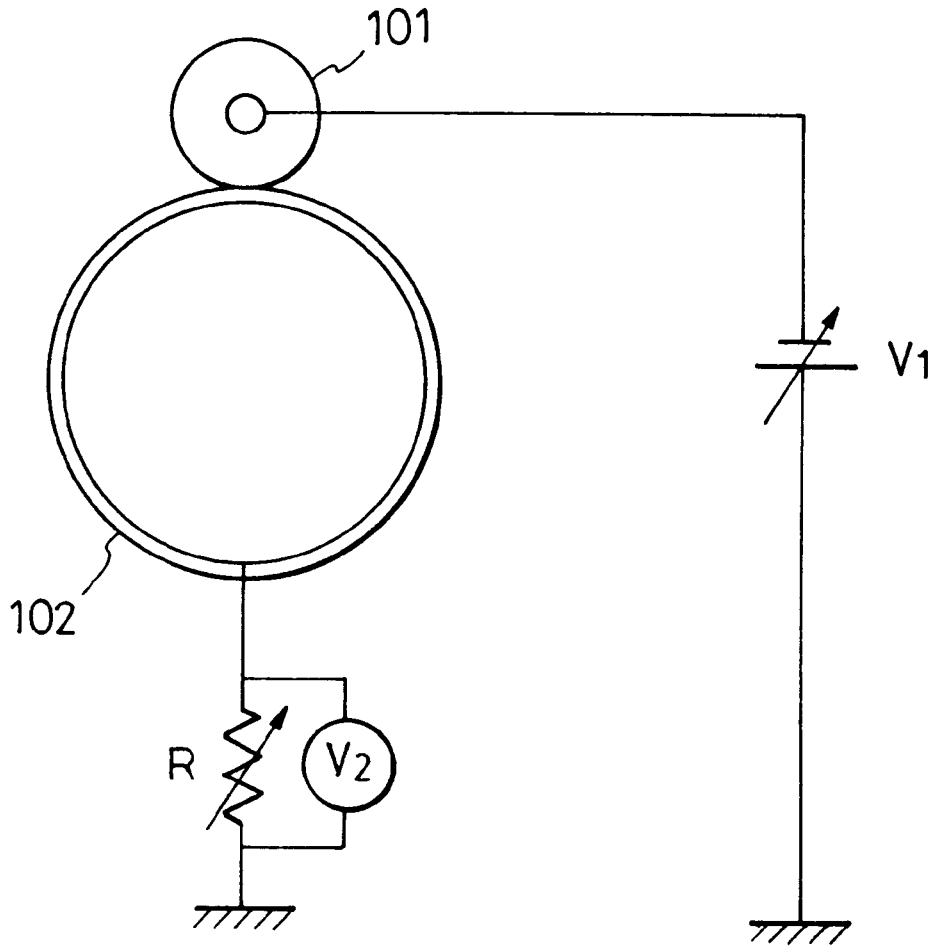
FIG. 10 is a schematic diagram illustrating a measuring unit for measuring electric resistance of a developing roller.

Electric resistance pf the developing roller is measured by a method comprising the steps of bringing an aluminum roller 102 having a diameter of 16 mm as shown in FIG. 10 into contact with the developing roller 101 under a contact load of 4.9 N (500 g), rotating the aluminum roller 102 at 2 rps, applying a DC voltage of V1=400 V to the developing roller 101, arranging a variable resistance R on the earth side, measuring voltage V2 at the both ends thereof while adjusting the resistance value of the variable resistance in response to the developing roller 101, and calculating a current value, thereby determining an electric resistance of the developing roller 101.

When using the one component contact developing method, the developing roller surface carrying the toner may be rotated either in the same-direction as the displacement direction of the photosensitive member surface or in a direction counter thereto. In the case of the same direction, the circumferential speed ratio of rotation should preferably be higher than 100% relative to the circumferential speed of the photosensitive member. A ratio of under 100% leads to a poor image quality. A higher ratio of circumferential speed results in a larger amount of toner supplied to the developing site, and a more frequent deposition/removal of toner onto/from the latent image. As a result of repetition of a cryle comprising scraping of unnecessary portions and deposition of toner onto necessary portions, an accurate image of the latent image is obtained. More specifically, the displacement speed of the toner carrying member surface should preferably be within a range of from 1.05 to 3.0 times as high as the displacement speed of the surface of the photosensitive member.

Now, the transferring step applicable in the image forming method of the invention will described in detail below.

In the transferring step, it is desirable to use the contact transferring method of electrically transferring a toner image onto a transfer medium while bringing transferring means into contact with the surface of the photosensitive member via the transfer medium. The contact pressure of the transferring means against the surface of the photosensitive member in linear pressure should preferably be at least 2.9 N/m (3 g/cm), or more preferably, within a range of from 9.8 to 490 N/m (10 to 500 g/cm). When the contact pressure in linear pressure is under 2.9 N/m (3 g/cm), a shift in the transfer of the transfer medium or a defective transferring easily occurs. When the contact pressure is excessively high, deterioration of the photosensitive member or adhesion of toner may be caused, thus resulting in adherence of toner the surface of the photosensitive member.

An apparatus having a copying roller or a transferring belt is employed as transferring means in the contact transferring step. The transferring roller has at least a core and a conductive elastic layer covering the core. The conductive elastic layer is made of an elastic body having a volume resistivity within a range of from $10^6$ to $10^{10}$ Ω, such as urethane or EPDM containing dispersed conductive fine particles such as carbon.

The invention is effectively applicable particularly in an image forming apparatus in which the surface of the photosensitive member is made of an organic compound. More particularly, when the surface layer of the photosensitive member is formed with an organic compound, adhesion with a bonding resin contained in the toner particles is higher than any other photosensitive member using an inorganic material. This poses a technical problem that copying property tends to be lower. The effect brought about by a high copying property resulting from the toner used in the invention is therefore more apparent.

Applicable surface materials of the photosensitive member in the invention ipclude, for example, silicone resin, vinylidene chloride, ethylene-vinyl chloride, styrene-acrylonitrile, styrene-methylmethacrylate, styrene, polyethyleneterephthalate and polycarbonate. The surface material is not limited to those enumerated above, but any other monomer or a copolymer or a blend of the above-mentioned bonding resins may also be applicable.

The invention can effectively be used particularly in an image forming apparatus having a drum-shaped photosensitive member with a small diameter of up to 50 mm. More specifically, in the case of a small-diameter photosensitive drum, pressure concentration tends to occur at the contact portion of the contact members under the same linear pressure. The same phenomenon is conceivable also in the case of a photosensitive belt. The present invention is applicable even to an image forming apparatus using a photosensitive belt having a radius of curvature of up to 25 mm at the contact portion.

Upon development of the toner in the invention, it is desirable to control the total amount of charge of the toner. For this purpose, the surface of the toner carrier in the invention should preferably be covered with conductive fine particles and/or a resin layer in which a smoothening agent is dispersed.

Charging is accomplished either by a known corona charging method called corotron or scorotron, or by a method using pin electrodes. Further, the contact charging method of conducting charging by bringing the charging member into contact with the photosensitive member surface is also applicable.

The invention is effective particularly for the contact charging method in which the charging means brings the charging member into contact with the surface of the photosensitive member. More specifically, as compared with non-contact corona discharge in which the charging member does not come into contact with the surface of the photosensitive member, the contact charging method tends to cause deterioration of the surface of the photosensitive member, and from the point of view of durability, this method poses a technical problem that the increase in the amount of residual toner after transferring caused by the decrease in transferring property tends to impair cleanability; The effect of a high transferring property of the invention is therefore particularly remarkable.

The preferable process conditions when a charging roller is employed as a contact charging member include a contact pressure of the charging roller within a range of from 4.9 to 490 N/m (5 to 500 g/cm), or more preferably from 9.8 to 392 N/m (10 to 400 g/cm). The polarity of residual toner after transferring should be the same as the charging polarity of the photosensitive member. To ensure easy collection upon developing, a DC voltage should preferably applied. When using an AC voltage in superposition to the DC voltage, the AC voltage should preferably have an inter-peak voltage of under 2×Vth (V) [Vth: discharge initiating voltage (V)upon application of DC]. The AC voltage is therefore preferably less than twice the applied DC voltage.

Other applicable contact charging members include that based on a method using a charging brush and that based on a method using a conductive brush. These contact charging means give advantages of making a high voltage unnecessary and reducing the occurrence of ozone.

When a roller or a blade serves as a contact charging member, a material selected from the group consisting of conductive metals such as iron, copper and stainless steal; a carbon-dispersed resin; and a metal or metal oxide dispersed resin. The blade may be rod-shaped or sheet shaped. The elastic roller should preferably have a configuration in which an elastic layer, a conductive layer and a resistance layer are provided on the conductive substrate.

The elastic layer may be formed with a material selected from the group consisting of rubber or sponge which is an expression of rubber such as chloroprene rubber, isoprene rubber, EPDM rubber, epoxy rubber, and butyl rubber; and thermoplastic elastomer such as styrene-butadiene thermoplastic elastomer, polyurethane-based thermoplastic elastomer, polyester-based thermoplastic elastomer, ethylene-vinylacetate, and thermoplastic elastomer.

The conductive layer should preferably have a volume resistivity of up to $10^7$ Ω·cm, or more preferably, within a range of from $10^1$ Ω to $10^6$ Ω·cm. A metal vapor-deposited film, a conductive particle dispersed resin, or a conductive resin is used as a conductive layer. Concrete examples include vapor-deposited films of conductive metals such as aluminum, indium, nickel, copper and iron; conductive particle dispersed resins formed by dispersing conductive particles such as carbon such as urethane, polyester, vinyl acetate-vinyl chloride copolymer or methyl methacrylate; and conductive resins such as class-4 ammonium salt containing methyl polymethacrylate, polyvinyl aniline, polyvinyl pyrrole, polydiacetylene and polyethylene imine.

The resistance layer should preferably have a volume resistivity within a range of from $10^6$ to $10^{12}$ Ω·cm. A semiconductor resin or a conductive particle dispersed resin may be used as a resistance layer. Applicable semiconductor resins include ethyl cellulose, nitrocellulose, methoxymethylated nylon, ethyoxymethylated nylon, copolymer nylon, polyvinylhydrene and casein. The conductive particle dispersed resin is prepared by dispersing a conductive particle such as carbon, aluminum, indium oxide, or titanium oxide in a slight amount into an insulating resin such as urethane, polyester, vinyl acetate-vinyl chloride copolymer or methyl polymethacrylate.

The conductive brush serving as a contact charging member is prepared by dispersing a conductive material in a commonly used fiber and adjusting resistance thereof. Applicable fibers include generally known fibers such as nylon, acryl, rayon, polycarbonate, or polyester. Applicable conductive materials include commonly known conductive materials such as conductive metals including copper, nickel, iron, aluminum, gold, and silver; conductive metal oxides, such as iron oxide, zinc oxide, tin oxide, antimony oxide, and titanium oxide; and conductive powder such as carbon black. A surface treatment may applied as required to these conductive materials for the purpose of hydrophobicity and resistance adjustment. Selection for use should be conducted, taking account of dispersibility with a fiber and productivity.

Preferable geometric conditions for the conductive brush include a fiber size within a range of from 1 to 20 denier (fiber diameter: about 10 to 500 $\mu$m), a brush fiber length within a range of from 1 to 15 mm, and a brush density within a range of from 10,000 to 300,000 per square inch (corresponding to about $1.5\times10^7$ to $4.5\times10^8$ per square meter).

Now, the image forming method according to a preferred embodiment of the invention will be described below with reference to the attached drawings.

FIG. 1 is a schematic diagram illustrating an image forming apparatus having a process cartridge from which removes a cleaning unit having a cleaning member such as a cleaning blade, as an embodiment of the image forming method of the invention.

A photosensitive member 36 is charged with a charging roller 31 which is contact charging means, and an electrostatic latent image is formed by exposing the image portion by a laser beam 40. A toner 30 stored in a developing unit 32 is coated onto a toner carrying member 34 by means of a toner supplying roller 35 and a coating blade 33. A toner layer on the toner carrying member 34 is brought into contact with the surface of the photosensitive member 36, to develop the electrostatic image on the photosensitive member 36 by the reverse developing method, thereby forming a toner image on the photosensitive member 36. At least a DC bias $V_{41}$ is applied onto the toner carrying member 34 by bias applying means 41. The toner image on the photosensitive member 36 is transferred onto a recording medium 38 as a transfer medium transferred to a transferring position by a transferring roller 37, which is a transferring means applied with a bias $V_{42}$ by bias applying means 42. The toner image transferred onto the recording medium is fixed by heating/pressurizing fixing means 43 having a heating roller and a pressurizing roller.

Residual toner after transferring remaining on the photosensitive member 36 after the transferring step is transferred to a charging roller 31 without being subjected to the cleaning step by a cleaning member such as blade cleaning means. The photosensitive member 36 having residual toner after transferring is charged again by the charging roller 31, and after charging, the electrostatic latent image is formed through exposure by a laser beam 40. The photosensitive member 36 having residual toner after transferring performs collection of residual toner after transferring into the toner carrying member 34, simultaneously with development of the electrostatic latent image by the toner on the toner carrying member 34. The formed toner image on the photosensitive member 36 after the development-simultaneous cleaning step is transferred onto the conveyed recording medium 38 by the transferring roller 37. After the transferring step, the photosensitive member 36 is charged again by the charging roller 31. Subsequently, the same cycle of steps is repeated.

In the reverse developing method, preferably developing conditions for carrying out development-simultaneous cleaning should preferably include a dark potential ($V_d$) and luminance potential ($V_1$) of the surface of the photosensitive member, and DC ($V_{DC}$) applied to the toner carrier satisfy the relationship $|V_d-V_{DC}|>|V_1-V_{DC}|$. More preferably, the same of $|V_d-V_{DC}|$ should larger by more than 10V then the value of $|V_1-V_{DC}|$.

Figure 2:
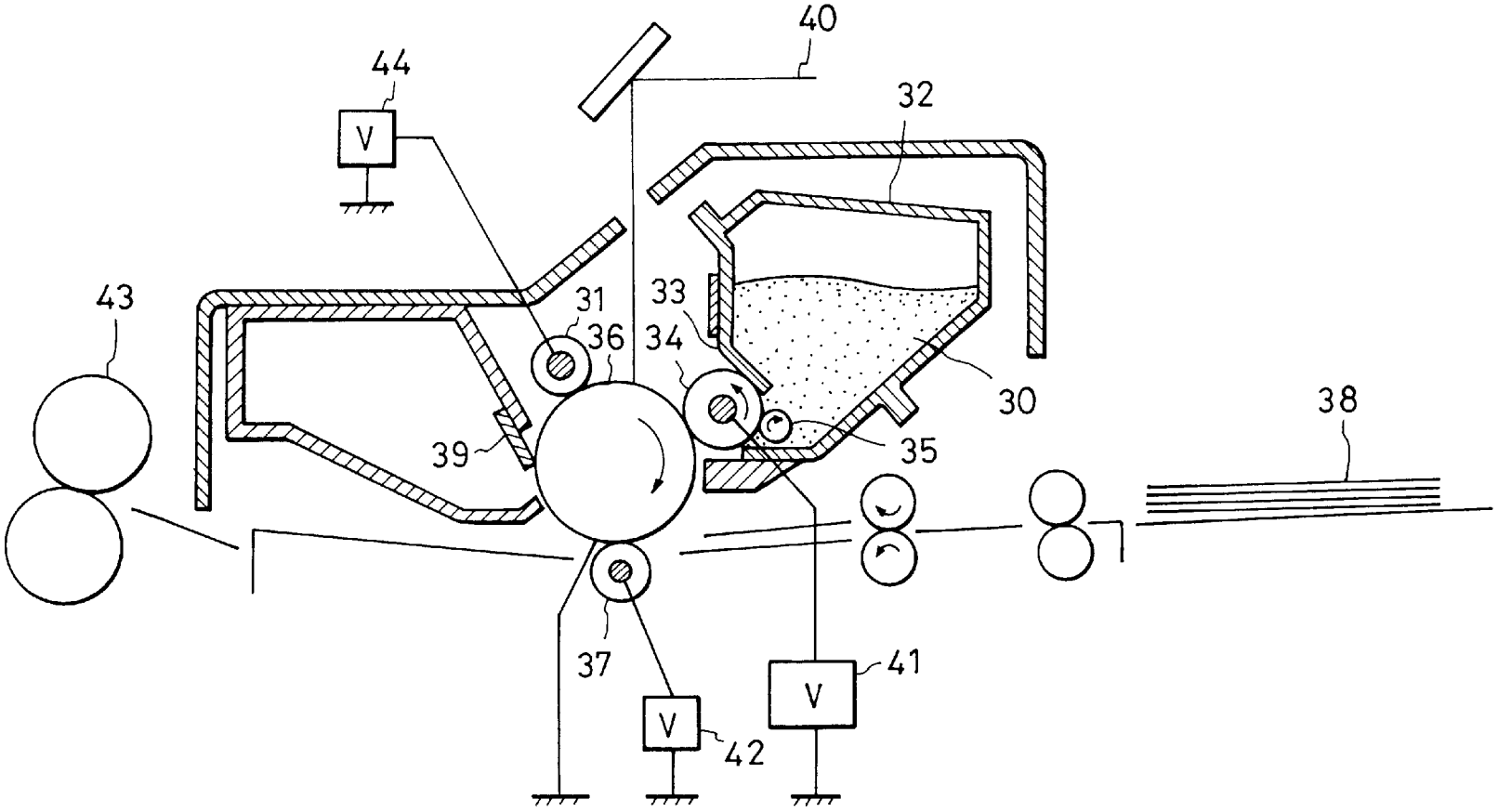
FIG. 2 is a schematic diagram illustrating an image forming apparatus using a contact one component developing unit and adopting the pre-development cleaning method, used in another embodiment of the image forming method of the invention.

FIG. 1 illustrates an image apparatus base on the development-simultaneous cleaning method conducting cleaning simultaneously with development without providing the cleaning member for removing residual toner after transferring on the photosensitive member between the transferring section and the charging section and between the charging section and the developing section. An image forming apparatus based on the pre-development cleaning method, which performs the cleaning step before the developing step is illustrated in FIG. 2. In FIG. 2, the same reference numerals are used for the same components as those in FIG. 1.

The image forming apparatus shown in FIG. 2 has a blade-shaped cleaning member 39 coming into contact with the surface of the photosensitive member 36 between the transferring section having a transferring roller 37 and the charging section having the charging roller 31. Residual toner on the photosensitive member 36 after the transferring step is scraped off by the cleaning member 39 and collected by the cleaner. After removal of the residual toner after transferring, the photosensitive member 36 is charged again by the charging roller 31, and an electrostatic latent image is formed through exposure by a laser beam 40 after charging. The electrostatic latent image on the photosensitive member 36 is developed by the toner on the toner carrying member 34. The toner image on the photosensitive member 36 after the developing step is transferred onto the conveyed recording medium 38 by the transferring roller 37. After the transferring step, the photosensitive member 36 is subjected to removal of residual toner by the cleaning member, and then charged again by the charging roller 31. Subsequently, the same steps are repeated.

Figure 3:
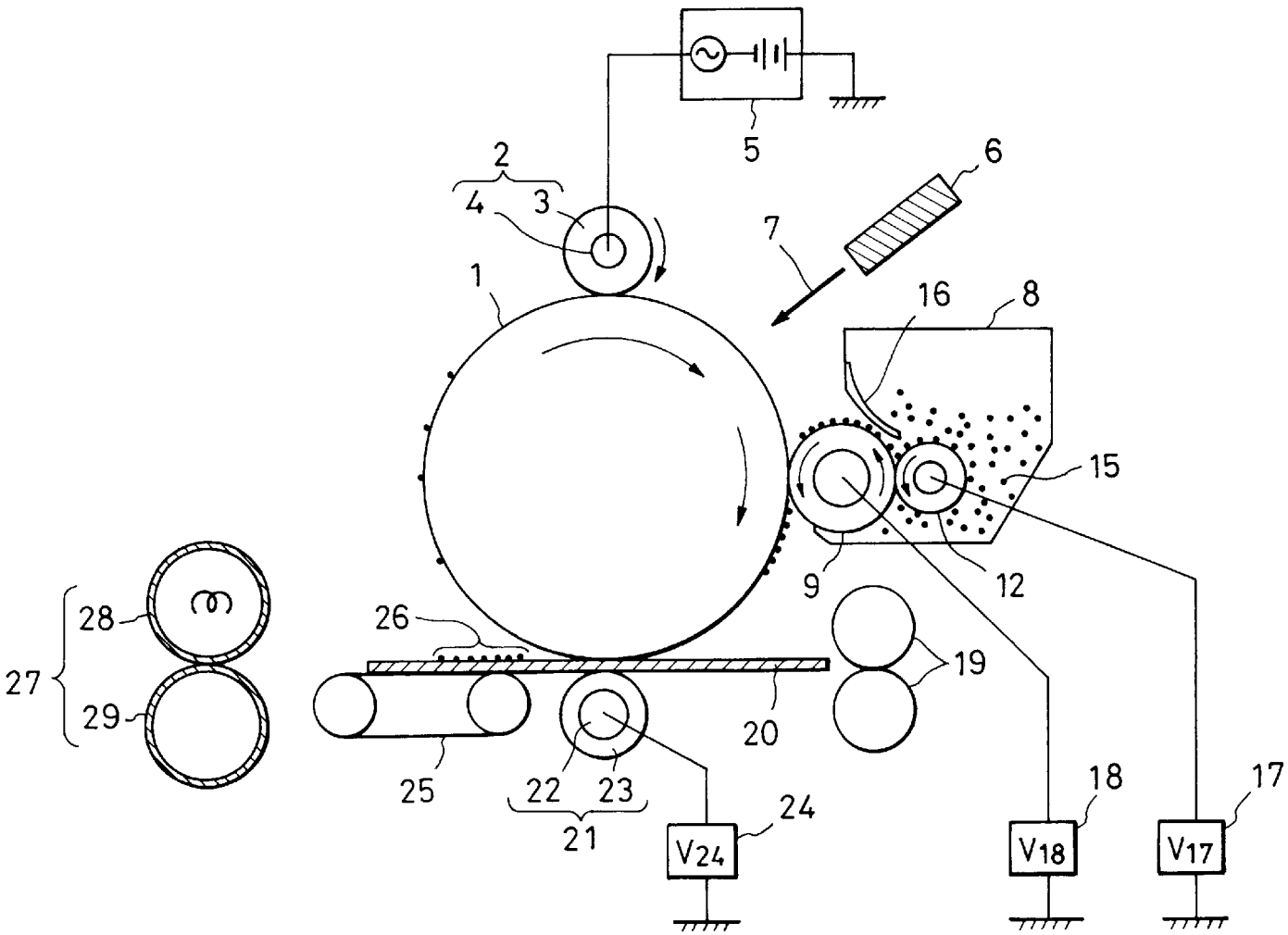
FIG. 3 is a schematic diagram illustrating an image forming method using a contact one component developing unit used in further another embodiment of the image forming method of the invention.

FIG. 3 illustrates another embodiment of the image forming apparatus which permits a smoother peeling of the toner having contributed to development from the developing sleeve, in addition to the supply of the toner to the developing sleeve serving as the toner carrying member.

In FIG. 3, reference numeral 1 depicts a photosensitive drum, around which there are provided a primary charging roller 2 which is contact charging means, a developing unit 8 serving as developing means, a transferring roller 21 serving as contact transferring means, and a register roller 19. The photosensitive drum 1 is charged by the primary charging roller 2 to, for example, −700V. A DC voltage applied by bias applying means 5 is, for example, −1,350V. By irradiating a laser beam 7 from a laser generator 6 onto the photosensitive drum 1, exposure is performed, and a digital electrostatic latent image is formed. The electrostatic latent image on the photosensitive drum 1 is developed with a nonmagnetic one component toner 15 by the developing unit 8, and transferred onto a recording medium 20 as a transfer medium by a transferring roller 21 applied with a bias voltage $V_{24}$ by bias applying means 24 brought via the recording medium 20 into contact with the photosensitive drum 1. The recording medium 20 carrying a toner image 26 is conveyed by a conveying belt 25 to a heating/pressurizing/fixing unit 27 having a heating roller 28 and a pressurizing roller 29, and fixed onto the recording medium 20.

The charging roller 2 basically comprises a core 4 at the center thereof and a conductive elastic layer 3 forming the outer periphery thereof.

Figure 4:
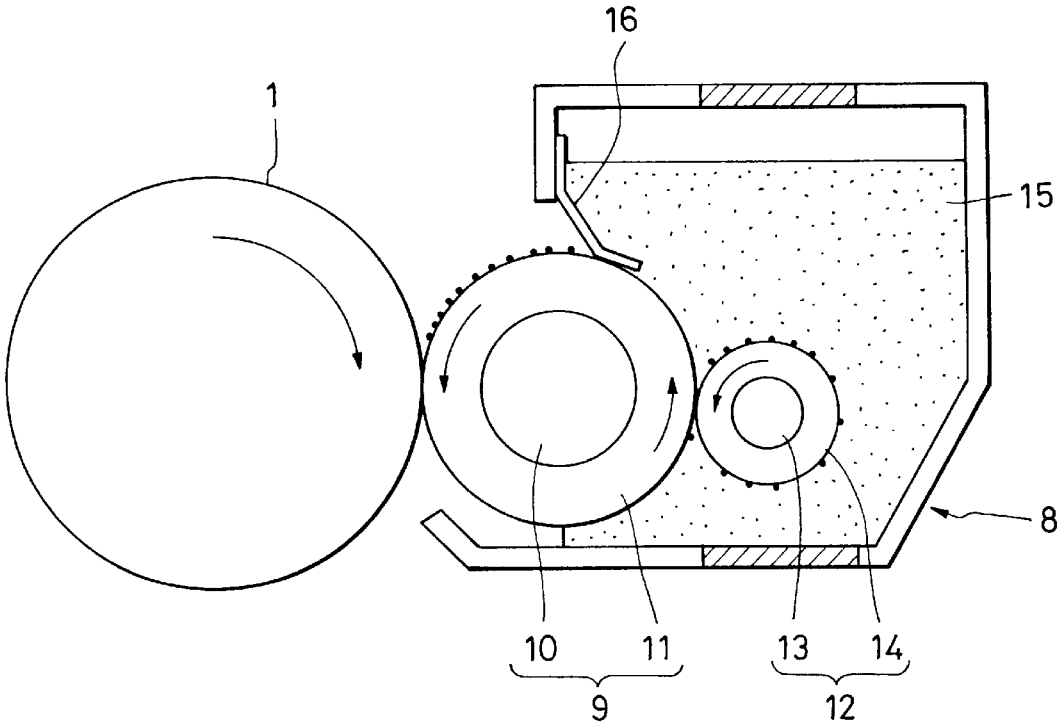
FIG. 4 is an enlarged schematic diagram of a developing unit of the image forming apparatus shown in FIG. 3.

In the developing unit 8, as shown in FIGS. 3 and 4, a toner layer on a developing sleeve 9 serving as a toner carrying member is in contact with the photosensitive drum 1. The developing sleeve 9 serves as the toner carrying member comprising a core 10 applied with a bias $V_{18}$ by the bias applying means 18 and an elastic roller 9 having an elastic layer 11. In the developing unit 8, a core 13 of a toner supplying roller 12 applied with a bias $V_{17}$ by the bias applying means 17 and a toner supplying roller 12 having an elastic layer 14 surface of the core 13 are arranged. A toner regulating blade 16 for regulating the amount of toner transferred in the form of deposit to the developing sleeve 9 is arranged, and the amount of toner (toner layer thickness) transferred into the developing region is controlled by the contact pressure against the developing sleeve 9 of the toner regulating blade 16. In the developing region, at least a DC developing bias is applied to the developing sleeve. The toner layer on the developing sleeve comes into contact with the surface of the photosensitive drum 1, and moves onto the photosensitive drum 1 in response to the electrostatic latent image to from a toner image.

In order to conduct development-simultaneous cleaning, when the photosensitive drum 1 has a luminance potential within a range of from 0 to 250V and a dark potential within a range of from 300 to 1000V, the supplied bias voltage $V_{17}$ applied by the bias applying means 17 should preferably be within a range of from 100 to 900V and the development bias voltage $V_{18}$ applied by the bias applying means 18, from 100 to 900V. Further, the supplied bias voltage $V_{17}$ applied by the bias applying means 17 should preferably be higher in absolute value by 10 to 400V more than the developing bias voltage $V_{18}$ applied by the bias applying means 18 for the smooth supply of the nonmagnetic toner 15 to the developing sleeve 9 and smooth peeling of the nonmagnetic toner from the developing sleeve 9.

The displacement direction of the toner supplying roller 12 should preferably be counter to the rotating direction of the developing sleeve 9 (which rotating in the same direction) from the point of view of supply and peeling of the nonmagnetic toner.

The image forming apparatus shown in FIGS. 1 to 3 adopts the image forming method of transferring a toner image formed on the image carrying member directly on the recording medium without the use of an intermediate transfer member.

Now, the image forming method of subjecting a toner image formed on a image carrying member to a first transferring onto an intermediate transfer member and then performing a second transferring of the toner image transferred onto the intermediate transfer member onto a recording medium will be described below with reference to an image forming apparatus shown in FIG. 5.

Figure 5:
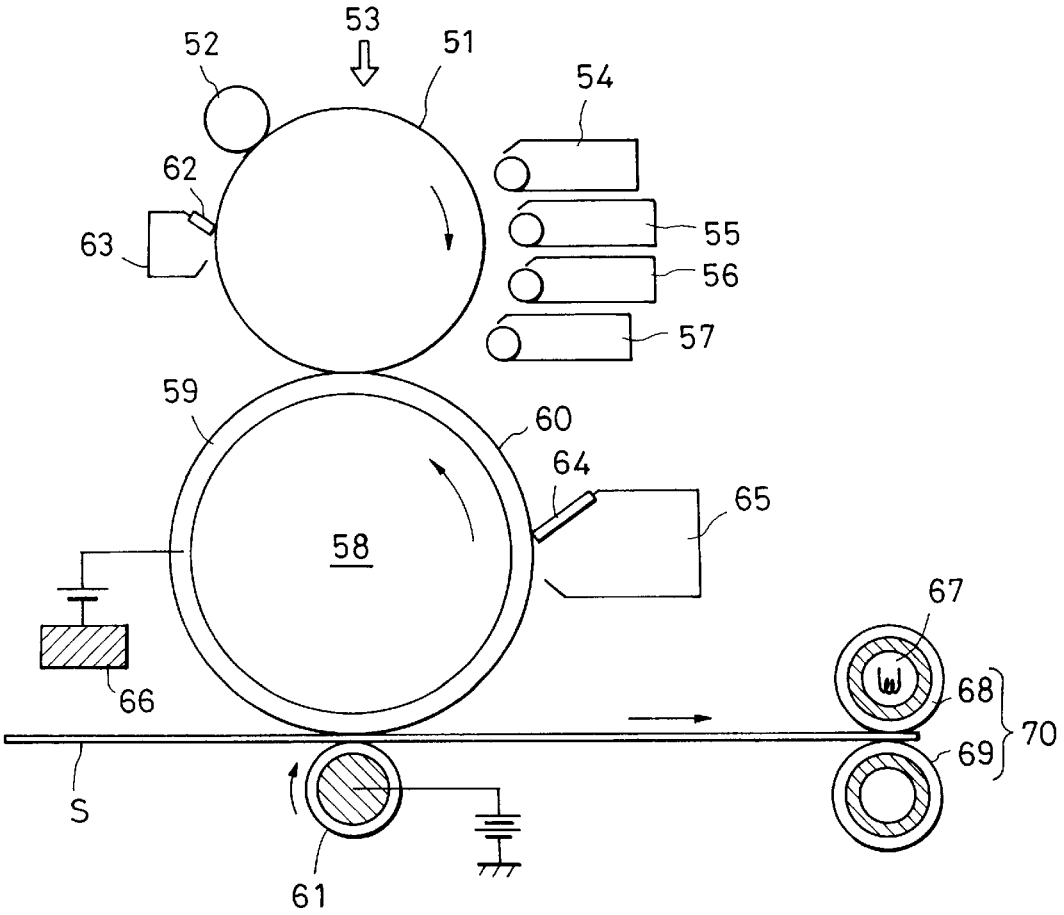
FIG. 5 is a schematic diagram illustrating an image forming apparatus using an intermediate transfer member.

In FIG. 5, a surface potential is imparted onto a photosensitive drum 51 by means of a charging roller 52 which contact-rotates with the photosensitive drum 51 serving as the image carrying member, and an electrostatic latent image is formed by exposure means 53. The electrostatic latent image is developed by four color toners including a magenta toner, a cyan toner, a yellow toner, and a black toner through developing units 54, 55, 56, and 57, respectively, of the one component contact developing type, thereby forming a full-color toner image. Upon developing, any one of the developing units 54, 55, 56, and 57 displaces to bring the toner carrying member of the developing unit into contact with the surface of the photosensitive drum 51 for development. After the completion of development, the developing unit moves back to the original position to keep the toner carrying member apart from the surface of the photosensitive drum 51. This operation is repeated four times for each developing unit. The toner image is transferred onto the intermediate transfer member 58 for each color, and repetition for a plurality of times forms a multiple toner image.

The intermediate transfer member 58 is drum-shaped, of which the outer peripheral surface is lined with a holding member, or comprises a substrate covered with an elastic layer (for example, nitrilebutadiene rubber) having a conductivity imparting material such as carbon black, zinc oxide, tin oxide, silicon carbide, or titanium oxide dispersed sufficiently. A belt-shaped intermediate transfer member may be used.

The intermediate transfer member 58 should preferably comprise a drum-shaped supporting member 59 having an elastic layer 60 having a hardness within a range of from 10 to 50° (JIS K-6301) formed on the surface thereof, or in the case of a transferring belt, a supporting member having an elastic layer 150 having this hardness at the transferring section to the transfer medium (recording medium).

Transferring of the toner image from the photosensitive drum 51 to the intermediate transfer member 58 is accomplished by imparting a bias $V_{66}$ applied by the bias applying means 66 to a core 59 serving as a supporting member for the intermediate transfer member 58, which gives a transferring current. Corona discharge or roller charging from the back of the supporting member or the belt may be used.

The multiple toner image on the intermediate transfer member 58 is transferred at once onto a recording medium S by transferring means 61. The transferring member may be a corona charger, or contact electrostatic transferring means using a transferring roller, or a transferring belt.

The recording medium S having the toner image formed thereon passes through a contact nip section between a fixing roller 68 serving as a fixing member having a heater and a heating/fixing unit 70 having a pressurizing roller 69 in contact with the fixing roller 68, whereby fixing of the toner image onto the recording medium S is accomplished.

The toner containing carbon black used in the invention is used in a developing unit selected from the developing units 54, 55, 56 and 57 of the foregoing image forming apparatus as a black toner, and three color toners are used for the three remaining developing units. The black toner in the invention is used in combination with color toners for the formation of a color image or a full color image, or for the formation of a monochromic image by the use of the black toner alone.

In FIG. 5, reference numeral 63 depicts is a cleaner (first cleaning means) having a cleaning member 62 for removing residual toner remaining on the surface of this photosensitive drum 51 after the first transferring. The cleaning member 62 is in contact with the surface of the photosensitive drum 51. Also in FIG. 5, 65 is another cleaner (second cleaning means) having a cleaning member 64 for removing residual toner remaining on the surface of the intermediate transfer member 58 after the second transferring.

Cleaner 63, serving as the fourth cleaning means, is removed from the image forming apparatus when adopting the development simultaneous cleaning method.

An excellent developing property even in contact one component development is available because of a satisfactory charge controllability of the toner on the toner carrying member in which excessive charging is inhibited. This is attributable to the synergetic effect of the charge control effect brought about by a satisfactory dispersion of carbon black resulting from simultaneous use of a specific carbon black and a specific azo-based iron compound of the invention, on the one hand, and the charge control effect of inhibiting excessive charging of the azo-based iron compound itself.

When using the development-simultaneous cleaning method, it is possible to present a decrease in cleanability caused by excessive charge of residual toner after transferring through appropriate control of the amount of charge of the developed toner on the photosensitive member. Cleanability of a toner having a high sphericity such as a toner manufactured by the suspension polymerization method, which has conventionally been difficult, is consequently improved to a large extent.

When adopting the development-simultaneous cleaning method, charge polarity control and charge amount control of residual toner after transferring on the photosensitive member by the charging member are more surely and more uniformly accomplished, and a stable collectivity of residual toner after transferring and a higher developability are available in the developing step.

EXAMPLES

Now, the present invention will be described further in detail by means of the manufacturing method, examples and comparative examples of the toner and the photosensitive drum.

Carbon black samples as shown in Table 1 were prepared.

TABLE 1

List of carbon black samples

| No. | Particles size [nm] | Specific surface area [$m^2/g$] | DBP oil absorption [ml/100 g] | Volatile matters [%] |
|---|---|---|---|---|
| a | 66 | 28 | 66 | 1.0 |
| b | 35 | 45 | 70 | 1.0 |
| c | 75 | 25 | 70 | 0.5 |
| d | 27 | 80 | 123 | 0.9 |
| e | 40 | 50 | 140 | 1.5 |
| f | 56 | 45 | 45 | 0.6 |
| g | 58 | 45 | 115 | 1.6 |
| h | 30 | 70 | 60 | 3.0 |
| i | 29 | 110 | 115 | 7.0 |
| j | 20 | 135 | 110 | 0.8 |
| k | 18 | 265 | 120 | 1.2 |
| l | 95 | 20 | 105 | 1.0 |

(Preparation of master batch dispersed solutions 1 to 19)

As shown in the following Table 2, combinations of a styrene monomer in an amount of 2,000 g with carbon black samples (a) to (l) and a dispersant of the kinds and in the amounts shown in Table 2, respectively, were added to ATLITER 1S (made by Mitsui Kozan Company). The resultant mixtures were stirred, with the use of 2 mm zirconia beads, at 200 rpm at a temperature of 25° C. for 180 minutes to prepare master batch dispersed solutions 1 to 19 formed by dispersing carbon black and the dispersant in the styrene monomer. Values of viscosity of the resultant master batch dispersed solutions 1 to 19 are shown in Table 2.

TABLE 2

List of particulars for predispersion step

| Master batch dispersed solution No. | Quantity of added styrene monomer [g] | Kind of carbon black | Quantity of added carbon black [g] | Kind of dispersant | Quantity of added dispersant [g] | A/B | Viscosity [centipoise] |
|---|---|---|---|---|---|---|---|
| 1 | 2000 | a | 160 | Azo-based iron compound (1) | 40 | 4.0 | 270 |
| 2 | 2000 | a | 160 | Azo-based iron compound (1) | 60 | 2.7 | 180 |
| 3 | 2000 | a | 160 | Azo-based iron compound (1) | 20 | 8.0 | 250 |
| 4 | 2000 | a | 160 | Azo-based iron compound (1) | 100 | 1.6 | 110 |
| 5 | 2000 | a | 160 | Azo-based iron compound (1) | 4 | 40.0 | 80 |
| 6 | 2000 | a | 160 | (None) | — | — | 10 |
| 7 | 2000 | b | 160 | Azo-based iron compound (2) | 40 | 4.0 | 500 |
| 8 | 2000 | c | 160 | Azo-based iron compound (1) | 40 | 4.0 | 300 |
| 9 | 2000 | d | 160 | Azo-based iron compound (1) | 40 | 4.0 | 560 |
| 10 | 2000 | e | 160 | Azo-based iron compound (1) | 40 | 4.0 | 470 |
| 11 | 2000 | f | 160 | Azo-based iron compound (1) | 40 | 4.0 | 150 |
| 12 | 2000 | g | 160 | Azo-based iron compound (1) | 40 | 4.0 | 460 |
| 13 | 2000 | h | 160 | Azo-based iron compound (1) | 40 | 4.0 | 180 |
| 14 | 2000 | i | 160 | Azo-based iron compound (1) | 40 | 4.0 | 380 |
| 15 | 2000 | j | 160 | Azo-based iron compound (1) | 40 | 4.0 | 620 |
| 16 | 2000 | k | 160 | Azo-based iron compound (1) | 40 | 4.0 | *1— |
| 17 | 2000 | l | 160 | Azo-based iron compound (1) | 40 | 4.0 | 100 |
| 18 | 2000 | a | 160 | Azo-based chromium compound expressed by the following formula *2 | 40 | 4.0 | 300 |
| 19 | 2000 | a | 160 | Zinc compound di-tertiary butylsalicytate | 40 | 4.0 | 220 |

*1: In No. 16, the master batch dispersed solution had too high viscosity to take out in a normal state, making it impossible to use the same.
*2: Azo-based chromium compound (following formula)

TABLE 2-continued

| List of particulars for predispersion step | | | | | | | |
|---|---|---|---|---|---|---|---|
| Master batch dispersed solution No. | Quantity of added styrene monomer [g] | Kind of carbon black | Quantity of added carbon black [g] | Kind of dispersant | Quantity of added dispersant [g] | A/B | Viscosity [centipoise] |

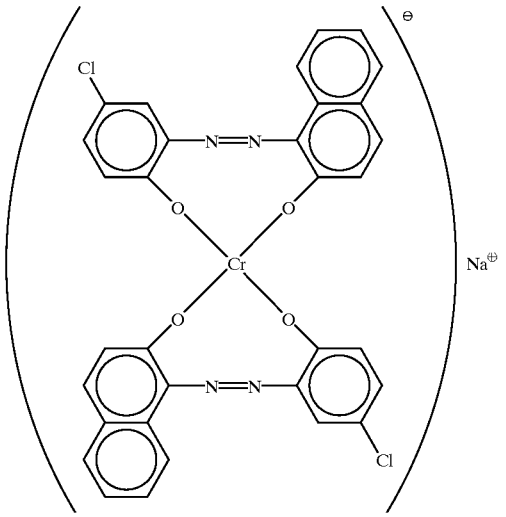

Example A of manufacture of polymerized toner

An aqueous 0.1 M-$Na_3Po_4$ solution in an amount of 500 g was added to 700 g ion-exchange water in a four-mouth flask for 2 liter. After to 60° C., the mixture was stirred at 12,000 rpm by the use of a high-speed stirrer TK-type homomixer (made by Tokushu Kika Kogyo Company). An aqueous 1.0 M-$CaCl_2$ solution in an amount of 76 g was gradually added to the stirred mixture, and an aqueous medium containing a fine hard-water-soluble dispersion stabilizer was obtained.

| | |
|---|---|
| (Predispersion solution) | |
| master batch dispersed solution No. 1: | 110 g |
| (Monomer 1) | |
| styrene: | 66 g |
| n-butylacrylate (n-BA): | 34 g |
| (Polar resin) | |
| Saturated polyester (condensate with propoxylated bisphenol and terephthatic acid, acid number: 14, peak molecular weight: 7000) | 8 g |
| (Release agent) | |
| ester wax (melting point: 65° C.): | 30 g |

The above composition was heated to 60° C., dissolved uniformly, and dispersed. A polymerization initiator 2,2-azobis (2,4-dimethylvaleronitrile) in an amount of 10 g was added to the composition to prepare a polymerizable monomer compound.

The foregoing polymerizable monomer composition was placed in the aqueous medium, and stirred at 60° C. in an $N_2$ atmosphere, in a TK-type homomixer, at 12,000 rpm for 10 minutes, thereby granulating a polymerizable monomer composition. The, the composition was subjected to a reaction at the same temperature for five hours while stirring (50 rpm) with a paddle stirring blade. Then, the composition was heated to 80° C. to cause a reaction for another five hours. After the completion of the polymerization reaction, residual monomer was distillation-removed in vacuum, and after cooling, hydrochloric acid was added to dissolve calcium phosphate. Then, the composition was filtered, water-rinsed, and dried, thereby obtaining sharp black suspension particles (black toner particles) having a weight average particle size of about 6.9.

Hydrophobic silica having a specific surface area by the BET method of 140 $m^2/g$ in an amount of 1.6 weight parts was added relative to 100 weight parts of the resultant black toner, thereby obtaining a polymerized toner A. The physical properties of the resultant toner are shown in Table 4.

Examples B to F of manufacture of polymerized toner

Polymerized toner samples B to F were prepared in the same manner as in the Example A of manufacture of polymerized toner except that master batch dispersed solutions 2–6 in which the amount of added azo-based iron compound (1) was altered as shown in Table 2. The physical properties of the resultant toner are shown in Table 4.

Example G of manufacture of polymerized toner

A polymerized toner G was prepared in the same manner as in the Example A of manufacture of polymerized toner except that the carbon black b shown in Table 1 was used in place of the carbon black a and a master batch dispersed solution 7 was used. The physical properties of the resultant toner are shown in Table 4.

Examples H and I of manufacture of polymerized toner

Polymerized toner samples H and I having different particle sizes were prepared in the same manner as in the Example G of manufacture of polymerized toner by adjusting the amount of an aqueous 0.1 M-$Na_3PO_4$ solution and an aqueous 1.0 M-$CaCl_2$ solution. The physical properties of the resultant toner samples are shown in Table 4.

Examples J to R of manufacture polymerized toner

Polymerized toner samples J to R were prepared in the same manner as in the Example A of manufacture of polymerized toner except that the carbon black samples c to l shown in Table 1 were used in place of the carbon black a and the master batch dispersed solutions 8 to 17 were used. The master batch dispersed solution 16 has too high a viscosity to take out, and therefore a toner could not be obtained. The physical properties of the resultant toner are shown in Table 4.

Examples S and T of manufacture of polymerized toner

Polymerized toner samples S and T were prepared in the same manner as in the Example A of manufacture of polymerized toner except that there were used master batch dispersed solutions 18 and 19 in which an azo-based chromium compound and a zinc compound of ditertiary butyl salicylic acid were used in place of the azo-based iron compound (1). The physical properties of the resultant toner are shown in Table 4.

Examples U and V of manufacture of polymerized toner

Polymerized toner samples U and V prepared in the same manner as in the Example A of manufacture of polymerized toner except that the composition of the polymerizable monomer composition was changed as shown in Table 3. The physical properties of the resultant toner are shown in Table 4.

Examples W to Z of manufacture of polymerized toner

Polymerized toner samples W to Z were prepared in the same manner as in the Example A of manufacture of polymerized toner except that a part of the styrene monomer contained in the polymerizable monomer composition was changed to divinylbenzene. The physical properties of the resultant toner are shown in Table 4.

Examples AA and BB of manufacture of polymerized toner

Polymerized toner samples AA and BB were prepared in the same manner as in the Example G of manufacture of polymerized toner except that the amount of added polymerization initiator and the temperature conctition for polymerization reaction were changed. The physical properties of the resultant toner are shown in Table 4.

The compositions of the foregoing polymerized toner samples A to Z, AA and BB are shown in Table 3.

TABLE 3

List of particulars for toner

| Toner | Kind of master batch dispersed solution | Quantity of added master batch dispersed solution [g] | Quantity of added styrene monomer [g] | Quantity of added n-BA monomer [g] | Quantity of added divinylbenzene [g] | Quantity of added polyester resin [g] | Quantity of added stripping agent [g] |
|---|---|---|---|---|---|---|---|
| A | 1 | 110.0 | 66.0 | 34.0 | 0 | 8.0 | 30.0 |
| B | 2 | 111.0 | 66.0 | 34.0 | 0 | 8.0 | 30.0 |
| C | 3 | 109.0 | 66.0 | 34.0 | 0 | 8.0 | 30.0 |
| D | 4 | 113.0 | 66.0 | 34.0 | 0 | 8.0 | 30.0 |
| E | 5 | 108.2 | 66.0 | 34.0 | 0 | 8.0 | 30.0 |
| F | 6 | 108.0 | 66.0 | 34.0 | 0 | 8.0 | 30.0 |
| G | 7 | 110.0 | 66.0 | 34.0 | 0 | 8.0 | 30.0 |
| H | 7 | 110.0 | 66.0 | 34.0 | 0 | 8.0 | 30.0 |
| I | 7 | 110.0 | 66.0 | 34.0 | 0 | 8.0 | 30.0 |
| J | 8 | 110.0 | 66.0 | 34.0 | 0 | 8.0 | 30.0 |
| K | 9 | 110.0 | 66.0 | 34.0 | 0 | 8.0 | 30.0 |
| L | 10 | 110.0 | 66.0 | 34.0 | 0 | 8.0 | 30.0 |
| M | 11 | 110.0 | 66.0 | 34.0 | 0 | 8.0 | 30.0 |
| N | 12 | 110.0 | 66.0 | 34.0 | 0 | 8.0 | 30.0 |
| O | 13 | 110.0 | 66.0 | 34.0 | 0 | 8.0 | 30.0 |
| P | 14 | 110.0 | 66.0 | 34.0 | 0 | 8.0 | 30.0 |
| Q | 15 | 110.0 | 66.0 | 34.0 | 0 | 8.0 | 30.0 |
| R | 17 | 110.0 | 66.0 | 34.0 | 0 | 8.0 | 30.0 |
| S | 18 | 110.0 | 66.0 | 34.0 | 0 | 8.0 | 30.0 |
| T | 19 | 110.0 | 66.0 | 34.0 | 0 | 8.0 | 30.0 |
| U | 1 | 110.0 | 66.0 | 34.0 | 0 | 8.0 | 0 |
| V | 1 | 110.0 | 66.0 | 34.0 | 0 | 0 | 30.0 |
| W | 1 | 110.0 | 65.9 | 34.0 | 0.06 | 8.0 | 30.0 |
| X | 1 | 110.0 | 65.9 | 34.0 | 0.1 | 8.0 | 30.0 |
| Y | 1 | 110.0 | 65.8 | 34.0 | 0.25 | 8.0 | 30.0 |
| Z | 1 | 110.0 | 65.5 | 34.0 | 0.5 | 8.0 | 30.0 |
| AA | 1 | 110.0 | 66.0 | 34.0 | 0 | 8.0 | 30.0 |
| BB | 1 | 110.0 | 66.0 | 34.0 | 0 | 8.0 | 30.0 |

TABLE 4

| | | | | | | | Toner physical properties | | | | Resin components of toner | | | | | |
|---|---|---|---|---|---|---|---|---|---|---|---|---|---|---|---|---|
| | | | | | | | | | | | | THF-soluble component | | | | |
| | Master batch dispersed solution No. | Carbon black | Carbon black content (wt. %) | Dispersant content (wt. %) | Polyester resin content (wt. %) | Stripping agent content (wt. %) | Weight average particle size of toner particles (μm) | Coefficient of variation (%) | Shape factor SF −1 | Shape factor SF −2 | THF insoluble Component C (wt. %) | Component B of molecular weight over a million (wt. %) | Main peak molecular weight of Compo-nent A | Number average molecular weight (Mn) | Mw/Mn | Presence of core-shell structure |
| Toner A | 1 | a | 3.2 | 0.8 | 3.2 | 12.1 | 6.9 | 18 | 109 | 107 | 0 | 9 | 18,000 | 17,000 | 72 | Present |
| Toner B | 2 | a | 3.2 | 1.2 | 3.2 | 12.0 | 6.7 | 17 | 112 | 110 | 0 | 7 | 17,000 | 16,000 | 79 | Present |
| Toner C | 3 | a | 3.2 | 0.4 | 3.2 | 12.1 | 7.0 | 20 | 112 | 109 | 0 | 10 | 19,000 | 18,000 | 84 | Present |
| Toner D | 4 | a | 3.2 | 2.0 | 3.2 | 12.0 | 6.5 | 17 | 125 | 119 | 0 | 7 | 17,000 | 17,000 | 68 | Present |
| Toner E | 5 | a | 3.2 | 0.1 | 3.2 | 12.2 | 6.7 | 17 | 115 | 109 | 0 | 11 | 19,000 | 18,000 | 80 | Present |
| Toner F | 6 | a | 3.3 | 0 | 3.3 | 12.2 | 6.9 | 19 | 118 | 114 | 0 | 10 | 19,000 | 18,000 | 80 | Present |
| Toner G | 7 | b | 3.2 | 0.8 | 3.2 | 12.1 | 3.7 | 26 | 111 | 108 | 0 | 8 | 18,000 | 18,000 | 71 | Present |
| Toner H | 7 | b | 3.2 | 0.8 | 3.2 | 12.1 | 4.9 | 20 | 109 | 104 | 0 | 8 | 18,000 | 17,000 | 69 | Present |
| Toner I | 7 | b | 3.2 | 0.8 | 3.2 | 12.1 | 8.8 | 34 | 124 | 115 | 0 | 8 | 18,000 | 17,000 | 65 | Present |
| Toner J | 8 | c | 3.2 | 0.8 | 3.2 | 12.1 | 6.9 | 19 | 108 | 105 | 0 | 12 | 19,000 | 19,000 | 94 | Present |
| Toner K | 9 | d | 3.2 | 0.8 | 3.2 | 12.1 | 6.8 | 15 | 113 | 107 | 0 | 5 | 17,000 | 15,000 | 51 | Present |
| Toner L | 10 | e | 3.2 | 0.8 | 3.2 | 12.1 | 6.7 | 17 | 109 | 105 | 0 | 8 | 18,000 | 17,000 | 66 | Present |
| Toner M | 11 | f | 3.2 | 0.8 | 3.2 | 12.1 | 6.7 | 16 | 108 | 104 | 0 | 10 | 18,000 | 17,000 | 64 | Present |
| Toner N | 12 | g | 3.2 | 0.8 | 3.2 | 12.1 | 6.7 | 19 | 109 | 106 | 0 | 9 | 18,000 | 17,000 | 60 | Present |
| Toner O | 13 | h | 3.2 | 0.8 | 3.2 | 12.1 | 3.9 | 24 | 115 | 109 | 0 | 6 | 17,000 | 17,000 | 55 | Present |
| Toner P | 14 | i | 3.2 | 0.8 | 3.2 | 12.1 | 7.7 | 32 | 120 | 115 | 0 | 7 | 17,000 | 17,000 | 77 | Present |
| Toner Q | 15 | j | 3.2 | 0.8 | 3.2 | 12.1 | 7.6 | 38 | 142 | 127 | 0 | 0.8 | 17,000 | 14,000 | 32 | Present |
| Toner R | 17 | l | 3.2 | 0.8 | 3.2 | 12.1 | 6.5 | 27 | 120 | 112 | 0 | 11 | 19,000 | 19,000 | 97 | Present |
| Toner S | 18 | a | 3.2 | 0.8 | 3.2 | 12.1 | 7.4 | 19 | 116 | 109 | 0 | 4 | 15,000 | 13,000 | 46 | Present |
| Toner T | 19 | a | 3.2 | 0.8 | 3.2 | 12.1 | 5.2 | 44 | 133 | 120 | 0 | 7 | 17,000 | 15,000 | 53 | Present |
| Toner U | 1 | a | 3.6 | 0.9 | 3.6 | 1.4 | 9.8 | 26 | 129 | 115 | 0 | 8 | 18,000 | 17,000 | 78 | None |
| Toner V | 1 | a | 3.3 | 0.8 | 0 | 12.5 | 11.2 | 31 | 143 | 126 | 0 | 7 | 18,000 | 16,000 | 56 | Present |
| Toner W | 1 | a | 3.2 | 0.8 | 3.2 | 12.1 | 7.0 | 18 | 110 | 108 | 3 | 16 | 18,000 | 20,000 | 190 | Present |
| Toner X | 1 | a | 3.2 | 0.8 | 3.2 | 12.1 | 6.9 | 20 | 110 | 107 | 7 | 12 | 19,000 | 22,000 | 130 | Present |
| Toner Y | 1 | a | 3.2 | 0.8 | 3.2 | 12.1 | 7.9 | 29 | 116 | 111 | 50 | 5 | 21,000 | 19,000 | 46 | Present |
| Toner Z | 1 | a | 3.2 | 0.8 | 3.2 | 12.1 | 8.0 | 34 | 127 | 118 | 65 | 2 | 23,000 | 18,000 | 7.0 | Present |
| Toner AA | 1 | a | 3.2 | 0.8 | 3.2 | 12.1 | 6.4 | 32 | 148 | 130 | 0 | 10 | 4,200 | 4,000 | 99 | Present |
| Toner BB | 1 | a | 3.2 | 0.8 | 3.2 | 12.1 | 8.6 | 27 | 134 | 122 | 0 | 18 | 28,000 | 25,000 | 300 | Present |

Example 1 of manufacture of photosensitive member

An aluminum cylinder having a diameter of 30 mm and a length of 254 mm was used as a substrate. Layers having the following configurations were sequentially laminated on this substrate by dip-coating, thereby preparing a photosensitive member 1.

(1) Conductive covering layer: mainly comprising tin oxide and titanium oxide powder was dispersed in phenol resin. Thickness: 15 μm.

(2) Undercoat layer: mainly comprising denatured nylon and copolymer nylon. Thickness: 0.6 μm.

(3) Charge generating layer: mainly comprising an azo-based pigment having an absorption in the long wavelength region, dispersed in butyral resin. Thickness: 0.6 μm.

(4) Charge transfer layer: mainly comprising Hall transferrable triphenylamine compound dissolved in a polycarbonate resin (molecular weight based on Ostwald viscosity method: 20,000) at a weight ratio of 8:10, added with ethylene polytetrafluoride powder (particle diameter: 0.2 μm) in an amount of 10 wt. % relative to the total solid which was uniformly dispersed. Thickness: 25 μm.

The surface of the resultant photosensitive member 1 had a contact angle with water of 95°.

The contact angle was measured with pure water by means of a contact angle meter CA-DS manufactured by Kyowa Kaimen Kagaku Company.

Example 2 of manufacture of photosensitive member

A photosensitive member 2 was manufactured by forming a charge transfer layer having a thickness of 25 μm in the same manner as in the Example 1 of manufacture of photosensitive member except that ethylene polytetrafluoride powder (particle size: 0.2 μm) was not added to the charge transfer layer. The surface of the resultant photosensitive member 2 had a contact angle to water of 79°.

Example 1

A 600 dpi laser printer (made by Canon: LBP-8Mark IV) was provided as an image forming apparatus. This apparatus was modified so as to have a process speed of 80 mm/s (variable toner carrier speed) and to be capable of printing 12 sheet of LTR (letter) size paper per minute. As shown in FIG. 2, the apparatus uniformly charges a photosensitive member 36 (30 ϕ) with the use of a charging roller 32 charged with DC and AC components. The DC component is controlled to a constant voltage, and the AC component is controlled to a constant current. Following charging, an electrostatic image is formed by exposing the image portion to a laser beam 40. After forming a toner image as a visual image with the toner 30, the toner image is transferred to a recording medium 38 by means of a transferring roller 37 applied with a voltage.

Then, a developing vessel 32 in a process cartridge was modified. In a medium-resistance rubber roller (16 ϕ) comprising silicone rubber, resistance was adjusted by dispersing carbon black in place of an aluminum sleeve involving a magnet serving as a toner supply member. The medium-resistance rubber roller was used as a toner carrying member 34, and was brought into contact with the photosensitive member 36. The toner carrying member 34 was driven so that the surface of the toner carrying member 34 displaces in the same direction at the contact portion with the photosensitive member surface at a circumferential speed 150% of that of the photosensitive member. That is, the toner carrying member stated at a circumferential speed of 120 mm/s and had a relative speed of 80 mm/s to the surface of the photosensitive member.

A supplying roller 35 was provided at the developed portion as means for supplying the toner onto the toner carrying member, and was brought into contact with the toner carrying member. At the contact portion, the toner was coated onto the toner carrying member by rotating the supplying roller 35 as that the surface of the supplying roller 35 rotated in a direction counter to the displacement direction of the toner carrying member. Further, for the control of a coated layer of the toner on the toner carrying member, a blade 33 made of stainless steel coated with a resin was attached. A blade made of urethane rubber was used as a cleaning member 39.

The photosensitive member 1 was employed as the photosensitive member, with the toner A, and process conditions were set so as to satisfy the following developing conditions:

| | |
|---|---|
| Potential at dark portion of the photosensitive member: | −700 V |
| Potential at luminous portion of the photosensitive member: | −150 V |
| Developing bias: | −450 V (only for DC component) |

A continuous image copying test of 1,000 sheets was carried out while supplying the toner to evaluate the image quality. The result was satisfactory in image density, splash inhibition, fog inhibition and transferring property, with occurrence of no defective cleaning. An image quality equivalent to that of the original image was obtained. Observation of the photosensitive member and the developing roller did not show the need for replacement without any adhesion.

(Method for evaluation)

(1) Image density:

A solid black image of a 5 mm square was prepared, and the image density of the solid black image was measured by the use of an image density measuring unit RD918 made by Macbeth Company.

(2) Toner splashing:

Toner splashing was evaluated as follows by means of fine lines associated with the quality of a graphical image: rather than splashing in character lines, reproducibility of lines upon printing out a 1-dot line image tending to produce splashing and the splashing of toner in line peripheries were evaluated by visual observation.

A: There is almost no toner splashing, showing a good line reproducibility;

B: Slight toner splashes are observed;

C: Toner splashes are observed, but with slight influence on line reproducibility;

D: Serious toner splashes are observed leading to a poorer line reproducibility.

(3) Transferring property:

Transferring property was evaluated by, upon developing a solid black image, peeling off residual toner on the photosensitive member through taping of a Mylar tape, and evaluating the result from a value obtained by subtracting the Macbeth concentration of the Mylar tape alone applied onto paper from the Macbeth concentration of the tape peeled. Mylar tape applied onto paper. A smaller value therefore represents a better transferring property.

(4) Fogging:

Fogging was evaluated by, upon forming a solid white image, peeling off residual toner on the photosensitive member through taping of a Mylar tape, and evaluating the result from a value obtained by subtracting the Macbeth concentration of the tape alone applied onto paper from the Macbeth concentration of the tape peeled Mylar tape applied onto paper. A smaller value therefore represents a better fog inhibition.

Figure 6:
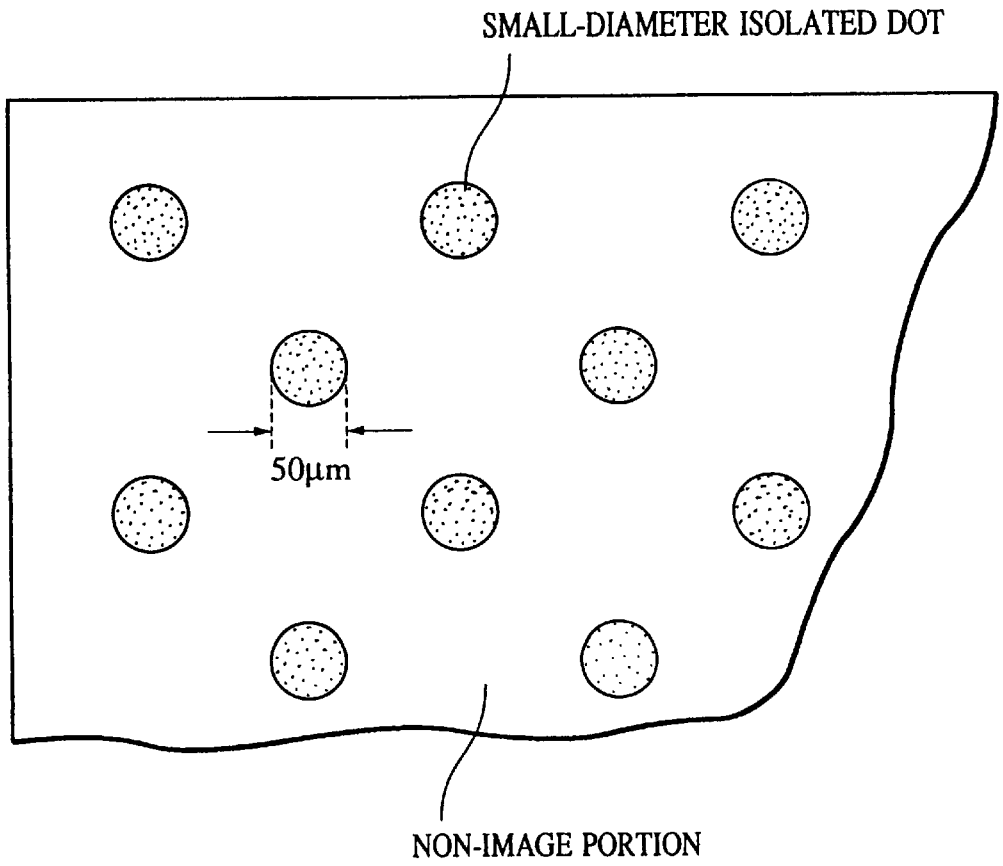
FIG. 6 is a pictorial view illustrating an isolated dot pattern for evaluating resolution.

(5) Resolution:

Resolution was evaluated from reproducibility of 50 μm small-diameter dots of 600 dpi as shown in FIG. 6 of which the electric field tends to be easily close by the latent image electric field and which is therefore difficult to reproduce.

A: Five or less faults among 100;

B: Six to ten faults among 100;

C: 11 to 20 faults among 100;

D: More than 20 faults among 100.

(6) Matching with developing roller:

After the completion of the printout test, the extent of residual toner adhering to the surface of the developing roller and effect on the printout image were evaluated through visual observation:

A: Very good (no occurrence)

B: Good (almost no occurrence)

C: Fair (adherence is observed, but no effect on image)

D: Bad (many spots of deposit, resulting in image blurs)

(7) Matching with photosensitive drum:

After the completion of the printout test, flaws on the surface of the photosensitive drum, occurrence of residual toner adherence, and effect on the printout image were evaluated through visual observation:

A: Very good (no occurrence)

B: Good (a few flaws are observed, but no effect on image)

C: Fair (adherence or flaws are observed, but slight effect on image)

D: Bad (many spots of deposit, resulting in longitudinal stripe-shaped image defects).

(8) Matching with fixing unit:

After the completion of the printout test, flaws and adherence of residual toner on the fixing roller surface were evaluated through visual observation:

A: Very good (no occurrence)

B: Good (a few spots of adherence are observed, but no effect on image)

C: Fair (adherence or flaws are observed, but slight effect on image)

D: Bad (many spots of adherence, resulting in image defects).

The results of evaluation are shown in Table 5.

Example 2

The Example 2 was carried out in the same manner as in the Example 1 except for the following points:

The toner carrier was rotated so that the displacing direction was the same as that of the surface of the photosensitive member at the contact portion therewith, and the rotating circumferential speed was 200% of that of the photosensitive member. The toner carrier was rotated at a circumferential speed of 160 mm/s, with a relative speed with the surface of the photosensitive member of 80 mm/s.

The toner B was used, and process conditions were set so as to satisfy the following developing conditions:

Developing bias: −500 V (DC component only)

A durability test of 1,000 sheets was carried out while replenishing the toner. The results were satisfactory in image density, fog inhibition and transferring property, with no occurrence of a cleaning defect, giving the same image quality as the original image. Observation of the photosensitive member and the developing roller revealed the adherence of necessity for replacement, with no adherence. The results of evaluation are shown in Table 5.

Examples 3 to 6

The results were evaluated in the same manner as in the Example 1 except for the use of the polymerized toners B to E. Substantially satisfactory results were obtained as shown in Table 5.

Comparative Example 1

The same tests were carried out as in the Example 1 except that a polymerized toner F and the photosensitive member 2 were employed.

Process conditions were set so as to satisfy the following developing conditions:

Developing bias: −350 V (DC component only)

Upon copying the five hundredth sheet, a cleaning defect occurred. Upon every occurrence of a cleaning defect, operations was continued while cleaning the cleaning blade, white spots caused by toner adhesion occurred at intervals equal to turns of the photosensitive member at parts of a solid black image.

White spots disappeared as a result of replacement of the photosensitive member, but the image density did not restore to the initial level. Reproduction of 50 μm isolated dots was insufficient and splashes were serious in the line image. The results are shown in Table 5.

Example 7 to 14

Evaluation was performed in the same manner as in the Example 1 except that the polymerized toners G, and J to P were employed. As shown in Table 5, the results were substantially satisfactory.

Comparative Examples 2 and 3

Evaluation was performed in the same manner as in the Example 1 except that the polymerized toners Q and R were used. As is clear from the results shown in Table 5, satisfactory results were not obtained because the carbon black used as the toner was not the specific carbon black of the invention. For the polymerized toner Q, serious staining of the image was caused by a cleaning defect, and for the polymerized toner R, a slight cleaning defect occurred at the 1,000th copy, with a low image concentration.

Comparative Examples 4 and 5

Evaluation was made in the same manner as in the Example 1 except that the polymerized toners S and T were used. As is clear from the results shown in Table 5, good results were not obtained since the dispersant used in the toner was not the specific azo-based iron compound of the invention. The polymerized toner S, being satisfactory in the initial stage, exhibited a decrease in the image density at the 1,000th copy. The polymerized toner T gave only a low image density, with insufficient properties.

Examples 15 to 22

Evaluation was conducted in the same manner as in the Example 1 except that the polymerized toners AA and BB were employed. The results are shown in Table 5.

TABLE 5

List of evaluation results

| | | | Initial 100 copies | | | | | After 1,000 copies | | | | | | |
|---|---|---|---|---|---|---|---|---|---|---|---|---|---|---|
| | Toner | Photosensitive member | Image density | Splash | Copy property | Fogging | Resolution | Image density | Splash | Copy property | Fogging | Matching with developing roller | Matching with photosensitive drum | Matching with fixing unit |
| Example 1 | A | Manufacturing example 1 | 1.41 | A | 0.03 | 0.05 | A | 1.43 | A | 0.03 | 0.06 | A | A | A |
| Example 2 | B | Manufacturing example 1 | 1.46 | A | 0.06 | 0.08 | A | 1.44 | A | 0.06 | 0.07 | A | A | A |
| Example 3 | B | Manufacturing example 1 | 1.40 | A | 0.04 | 0.03 | A | 1.42 | A | 0.04 | 0.04 | A | A | A |
| Example 4 | C | Manufacturing example 1 | 1.40 | A | 0.04 | 0.04 | A | 1.42 | A | 0.04 | 0.05 | A | A | A |
| Example 5 | D | Manufacturing example 1 | 1.36 | A | 0.04 | 0.05 | B | 1.40 | A | 0.05 | 0.06 | A | A | A |
| Example 6 | E | Manufacturing example 1 | 1.37 | A | 0.06 | 0.08 | B | 1.38 | A | 0.06 | 0.09 | A | A | A |
| Comparative Example 1 | F | Manufacturing example 2 | 1.32 | C | 0.18 | 0.21 | C | 1.35 | D | 0.38 | 0.32 | B | D | B |
| Example 7 | G | Manufacturing example 1 | 1.42 | A | 0.05 | 0.06 | A | 1.44 | A | 0.05 | 0.05 | A | A | A |
| Example 8 | J | Manufacturing example 1 | 1.37 | A | 0.04 | 0.06 | B | 1.40 | A | 0.05 | 0.07 | A | A | A |
| Example 9 | K | Manufacturing example 1 | 1.39 | A | 0.07 | 0.07 | A | 1.40 | B | 0.07 | 0.08 | A | A | A |
| Example 10 | L | Manufacturing example 1 | 1.41 | A | 0.04 | 0.05 | A | 1.39 | A | 0.04 | 0.07 | A | A | A |
| Example 11 | M | Manufacturing example 1 | 1.37 | A | 0.04 | 0.05 | A | 1.43 | A | 0.05 | 0.06 | A | A | A |
| Example 12 | N | Manufacturing example 1 | 1.38 | A | 0.04 | 0.07 | A | 1.41 | A | 0.07 | 0.08 | A | A | A |
| Example 13 | O | Manufacturing example 1 | 1.43 | A | 0.08 | 0.07 | A | 1.37 | B | 0.08 | 0.08 | A | A | A |
| Example 14 | P | Manufacturing example 1 | 1.41 | A | 0.09 | 0.08 | A | 1.38 | B | 0.08 | 0.11 | A | A | A |
| Comparative Example 2 | Q | Manufacturing example 1 | 1.42 | C | 0.16 | 0.25 | B | 1.28 | D | 0.25 | 0.42 | C | D | C |
| Comparative Example 3 | R | Manufacturing example 1 | 1.16 | A | 0.13 | 0.09 | B | 1.22 | C | 0.14 | 0.18 | C | C | C |
| Comparative Example 4 | S | Manufacturing example 1 | 1.45 | B | 0.06 | 0.05 | B | 1.10 | D | 0.10 | 0.20 | C | B | B |
| Comparative Example 5 | T | Manufacturing example 1 | 1.37 | C | 0.09 | 0.07 | B | 1.20 | D | 0.11 | 0.12 | C | C | B |
| Example 15 | U | Manufacturing example 1 | 1.36 | B | 0.07 | 0.06 | B | 1.32 | B | 0.08 | 0.04 | B | C | C |
| Example 16 | V | Manufacturing example 1 | 1.39 | B | 0.06 | 0.08 | B | 1.30 | B | 0.05 | 0.09 | C | C | B |

TABLE 5-continued

List of evaluation results

| | Toner | Photosensitive member | Initial 100 copies: Image density | Splash | Copy property | Fogging | Resolution | After 1,000 copies: Image density | Splash | Copy property | Fogging | Matching with developing roller | Matching with photosensitive drum | Matching with fixing unit |
|---|---|---|---|---|---|---|---|---|---|---|---|---|---|---|
| Example 17 | W | Manufacturing example 1 | 1.42 | A | 0.03 | 0.05 | A | 1.44 | A | 0.03 | 0.04 | A | A | A |
| Example 18 | X | Manufacturing example 1 | 1.42 | A | 0.03 | 0.06 | A | 1.43 | A | 0.03 | 0.04 | A | A | A |
| Example 19 | Y | Manufacturing example 1 | 1.41 | B | 0.05 | 0.07 | A | 1.40 | B | 0.06 | 0.06 | B | B | C |
| Example 20 | Z | Manufacturing example 1 | 1.40 | B | 0.04 | 0.07 | B | 1.39 | B | 0.08 | 0.07 | B | C | C |
| Example 21 | AA | Manufacturing example 1 | 1.31 | B | 0.08 | 0.05 | C | 1.30 | C | 0.05 | 0.06 | C | C | B |
| Example 22 | BB | Manufacturing example 1 | 1.35 | B | 0.06 | 0.07 | B | 1.37 | B | 0.04 | 0.09 | B | B | C |

Examples 23 to 31

Evaluation was made in the same manner as in the Example 1 except that the polymerized toners G to I and the amount of the additive (hydrophobic silica having a specific surface area of 140 $m^2/g$ by the BET method) was altered to 0.5%, 1.8% and 3.0%. As is clear from the results shown in Table 6, the amount of residual toner resulting from an increase in fogging was somewhat larger with an amount of additive of 0.5%. An amount of 3.0%, leading to a slightly lower fixability, gave generally good results.

TABLE 6

| | | Weight average particle size, D4 [μm] | Covering additive Quantity of addition [wt. %] | Covering additive Covering ratio [%] | Photosensitive member | List of evaluation results: Initial 100 copies Image density | Splash | Transferring property | Fogging | Resolution | After 1,000 copies Image density | Splash | Transferring property | Fogging |
|---|---|---|---|---|---|---|---|---|---|---|---|---|---|---|
| Example 23 | G | 6.7 | 0.5 | 15 | Manufacturing example 1 | 1.36 | A | 0.07 | 0.08 | B | 1.41 | A | 0.09 | 0.12 |
| Example 24 | G | 6.7 | 1.8 | 50 | Manufacturing example 1 | 1.41 | A | 0.04 | 0.05 | A | 1.43 | A | 0.05 | 0.06 |
| Example 25 | G | 6.7 | 3.0 | 80 | Manufacturing example 1 | 1.35 | A | 0.03 | 0.04 | A | 1.37 | A | 0.05 | 0.03 |
| Example 26 | H | 4.9 | 0.5 | 10 | Manufacturing example 1 | 1.35 | A | 0.08 | 0.09 | A | 1.38 | A | 0.12 | 0.13 |
| Example 27 | H | 4.9 | 1.8 | 40 | Manufacturing example 1 | 1.41 | A | 0.05 | 0.06 | A | 1.42 | A | 0.07 | 0.09 |
| Example 28 | H | 4.9 | 3.0 | 75 | Manufacturing example 1 | 1.44 | A | 0.03 | 0.06 | A | 1.43 | A | 0.04 | 0.08 |
| Example 29 | I | 8.8 | 0.5 | 20 | Manufacturing example 1 | 1.34 | A | 0.08 | 0.08 | B | 1.39 | A | 0.08 | 0.10 |
| Example 30 | I | 8.8 | 1.8 | 60 | Manufacturing example 1 | 1.37 | A | 0.04 | 0.05 | B | 1.39 | A | 0.05 | 0.05 |
| Example 31 | I | 8.8 | 3.0 | 95 | Manufacturing example 1 | 1.34 | A | 0.05 | 0.03 | B | 1.36 | A | 0.05 | 0.06 |

Example 32

An image was formed and evaluation was conducted in the same manner as in the Example 1 except that a single-layer-structured sponge roller was used as a toner coating roller 35 in the developing vessel 32 in the electrophotography unit used in the example 1, and a bias voltage was applied from bias applying means (not shown) to the toner supplying roller 35.

Only a DC component of −300 V was applied as a developing bias voltage to the developing roller 34 during development, and only a DC component of −450 V was applied as a supplying bias voltage to the toner supplying roller 35.

Evaluation was made in the same manner as in the Example 1: both image density and fog inhibition were satisfactory, with no occurrence of a cleaning defect, thus giving an excellent image quality. Matching with the image forming apparatus was also ratio factory.

(Preparation of master batch dispersed solutions 20 to 38)

As shown in the following Table 7, combinations of a styrene monomer in an amount of 2,000 g with carbon black samples (a) to (l) and a dispersant of the kinds and in the amounts shown in Table 7, respectively, were added to ATLITER 1S "made by Mitsui Kozan Company". The resultant mixtures were stirred, with the use of 2 mm zirconia beads, at 200 rpm at a temperature of 25° C. for 180 minutes to prepare master batch dispersed solutions 20 to 38 formed by dispersing carbon black and the dispersant in the styrene monomer. Values of viscosity of the resultant master batch dispersed solutions 20 to 38 are shown in Table 7.

TABLE 7

List of particulars for pre-dispersion step

| Master batch dispersed solution No. | Quantity of added styrene monomer [g] | Kind of carbon black | Quantity of added carbon black [g] | Kind of dispersant | Quantity of added dispersant [g] | A/B | Viscosity [centipoise] |
|---|---|---|---|---|---|---|---|
| 20 | 2000 | a | 200 | Azo-based iron compound (1) | 40 | 5.0 | 300 |
| 21 | 2000 | a | 200 | Azo-based iron compound (1) | 80 | 2.5 | 180 |
| 22 | 2000 | a | 200 | Azo-based iron compound (1) | 20 | 10.0 | 280 |
| 23 | 2000 | a | 200 | Azo-based iron compound (1) | 120 | 1.7 | 90 |
| 24 | 2000 | a | 200 | Azo-based iron compound (1) | 5 | 40.0 | 100 |
| 25 | 2000 | a | 200 | (None) | — | — | 10 |
| 26 | 2000 | b | 200 | Azo-based iron compound (2) | 40 | 5.0 | 520 |
| 27 | 2000 | c | 200 | Azo-based iron compound (1) | 40 | 5.0 | 320 |
| 28 | 2000 | d | 200 | Azo-based iron compound (1) | 40 | 5.0 | 600 |
| 29 | 2000 | e | 200 | Azo-based iron compound (1) | 40 | 5.0 | 500 |
| 30 | 2000 | f | 200 | Azo-based iron compound (1) | 40 | 5.0 | 160 |
| 31 | 2000 | g | 200 | Azo-based iron compound (1) | 40 | 5.0 | 480 |
| 32 | 2000 | h | 200 | Azo-based iron compound (1) | 40 | 5.0 | 180 |
| 33 | 2000 | i | 200 | Azo-based iron compound (1) | 40 | 5.0 | 400 |
| 34 | 2000 | j | 200 | Azo-based iron compound (1) | 40 | 5.0 | 650 |
| 35 | 2000 | k | 200 | Azo-based iron compound (1) | 40 | 5.0 | *3— |
| 36 | 2000 | 1 | 200 | Azo-based iron compound (1) | 40 | 5.0 | 120 |
| 37 | 2000 | a | 200 | Azo-based chromium compound expressed by the following formula *4 | 40 | 5.0 | 330 |
| 38 | 2000 | a | 200 | Zinc compound di-tertiary butylsalicytate | 40 | 5.0 | 250 |

*1: In No. 35, the master batch dispersed solution had too high viscosity to take out in a normal state, making it impossible to use the same.

*2: Azo-based chromium compound (following formula)

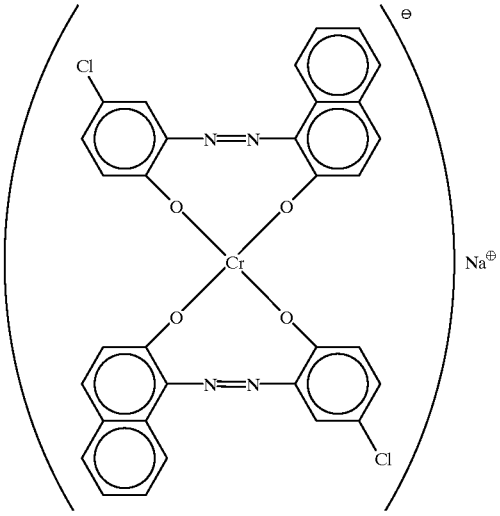

Example (a) of manufacture of polymerized toner

An aqueous 0.1 M-$Na_3PO_4$ solution in an amount of 500 g was added to 700 g of ion-exchange water in a four-mouth flask for 2 liter. After heating to 60° C., the mixture was stirred at 12,000 rpm by the use of a high-speed stirrer TK-type homomixer (made by Tokushu Kika Kogyo Company). An aqueous 1.0 M-$CaCl_2$ solution in an amount of 76 g was gradually added to the stirred mixture, and an aqueous medium containing a fine hard-water-soluble dispersion stabilizer was obtained.

| | |
|---|---|
| (Pre-dispersion solution) | |
| master batch dispersed solution No. 20: | 112 g |
| (Monomer) | |
| styrene: | 66 g |
| n-butylacrylate (n-BA) | 34 g |
| (Polar resin) | |
| saturated polyester (condensate with propoxylated bisphenol and terepthalic acid, Acid number: 14, peak molecular weight: 7,000) | 8 g |
| (Release agent) | |
| ester wax (melting point: 58° C.) | 30 g |

The above composition was heated to 60° C. dissolved uniformly, and dispersed. A polymerization initiator 2,2-azobis (2,4-dimethylvaleronitrile) in an amount of 10 g was added to the composition to prepare a polymerizable monomer compound.

The foregoing polymerizable monomer composition was placed in the aqueous medium, and stirred at 60° C. in an $N_2$ atmosphere, in a TK-type homomixer, at 12,000 rpm for 10 minutes, thereby granulating a polymerizable monomer composition. Then, the composition was subjected to a reaction at the same temperature for five hours while stirring (50 rpm) with a paddle stirring blade. Then, the composition was heated to 80° C. to cause a reaction for another five hours. After the completion of the polymerization reaction, residual monomer was distillation-removed in vacuum, and after cooling, hydrochloric acid was added to dissolve calcium phosphate. Then, the composition was filtered, water-rinsed, and dried, thereby obtaining sharp black suspension particles (black toner particles) having a weight average particle size of about 6.7 $\mu$m.

Hydrophobic silica having a specific surface area by the BET method of 140 $m^2/g$ in an amount of 1.8 weight parts was added relative to 100 weight parts of the resultant back toner, thereby obtaining a polymerized toner (a). The physical properties of the resultant toner (a) are shown in Table 9.

Examples (b) to (f) of manufacture of polymerized toner

Polymerized toners (b) to (f) were prepared in the same manner as in the Example (a) of manufacture of polymerized toner except that master batch dispersed solutions 21–25 in which the amount of added azo-based iron compound (1) was altered as shown in Table 7. The physical properties of the resultant toners (b) to (f) are shown in Table 9.

Example (g) of manufacture of polymerized toner

The polymerized toner (g) was prepared in the same manner as in the Example (a) of manufacture of polymerized toner except that the carbon black b shown in Table 1 was used in place of the carbon black a and a master batch dispersed solution 26 was used. The physical properties of the resultant toner (g) are shown in Table 9.

Examples (h) and (i) of manufacture of polymerized toner

Polymerized toners (h) and (i) having different particle sizes were prepared in the same manner as in the Example (g) of manufacture of polymerized toner by adjusting the amount of an aqueous 0.1 M-Na3PO4 solution and an aqueous 1.0 M-CaCl2 solution. The physical properties of the resultant toners (h) and (i) are shown in Table 9.

Examples (j) to (r) of manufacture of polymerized toner

Polymerized toners (j) to (r) were prepared in the same manner as in the Example (a) of manufacture of polymerized toner except that the carbon black samples c to l shown in Table 1 were used in place of the carbon black a and the master batch dispersed solutions 27 to 36 were used. The master batch dispersed solution 35 has too high a viscosity to take out, and therefore a toner could not be obtained. The physical properties of the resultant toners (j) to (r) are shown in Table 9.

Examples (s) and (t) of manufacture of polymerized toner

Polymerized toners (s) and (t) were prepared in the same manner as in the Example (a) of manufacture of polymerized toner except that there were used master batch dispersed solutions 37 and 38 in which an azo-based chromium compound and a zinc compound of ditertiary butyl salicylic acid were used in place of the azo-based iron compound (1). The physical properties of the resultant toners (s) and (t) are shown in Table 9.

Examples (u) and (v) of manufacture of polymerized toner

Polymerized toners (u) and (v) were prepared in the same manner as in the Example (b) of manufacture of polymerized toner except that the composition of the polymerizable monomer composition was charged as shown in Table 3. The physical properties of the resultant toners (u) and (v) are shown in Table 9.

Examples (aa) and (bb) of manufacture of polymerized toner

Polymerized toners (aa) and (bb) were prepared in the same manner as in the Example (b) of manufacture of polymerized toner except that the amount of added polymerization initiator and the temperature conditions for polymerization reaction were changed. The physical properties of the resultant toners (aa) and (bb) are shown in Table 9.

Examples (w) to (z) of manufacture of polymerized toner

Polymerized toners (w) to (z) were prepared in the same manner as in the Example (b) of manufacture of polymerized toner except that a part of the styrene monomer contained in the polymerizable monomer composition was changed to a mixture of divinylbenzene and diethylene glycol dimethacrylate. The physical properties of the resultant toners (w) to (z) are shown in Table 9.

The compositions of the foregoing polymerized toner (a) to (z), (aa) and (bb) are shown in Table 8.

Example (cc) of manufacture of pulverized toner

| | |
|---|---|
| (Binder resin) Styrene butylacrylate copolymer: (weight average molecular weight: 300,000, Tg: 60° C.) | 100 weight parts |
| (Coloring agent) Carbon black e: | 7 weight parts |
| (Charge control agent) Azo-based iron compounds (1): | 2 weight parts |
| (Release agent) Ester wax: | 3 weight parts |

The aforesaid materials were previously mixed, and melted and kneaded at 130° C. in a bioxial extruder. The resultant molten kneaded product was roughly pulverized on a hammer mill, and a 1 mm mesh-pass roughly pulverized toner. This roughly crushed product was further finely pulverized in an impact-type mill using a jet air flow. The product was classified by blast to obtain black toner particles having a weight average particle size of about 6.7 $\mu$m. Hydrophobic silica having a specific surface area by the BET method of 140 $m^2/g$ in an amount of 1.5 weight parts was added to 100 weight parts of the resultant black toner particles, thereby obtaining a pulverized toner (cc). The physical properties of the resultant toner (cc) are shown in Table 9.

Example (dd) of manufacture of pulverized toner

A pulverized toner (dd) was obtained in the same manner as in the Example (cc) of manufacture of pulverized toner except for the use of carbon black j shown in Table 1 in place of the carbon black e. The physical properties of the resultant toner (dd) are shown in Table 9.

TABLE 8

List of particulars for toner

| Toner | Kind of master batch dispersed solution | Quantity of added master batch dispersed solution [g] | Quantity of added styrene monomer [g] | Quantity of added n-BA monomer [g] | Quantity of added mixture of divinylbenzene and diethylglycol dimethacrylate [g] | Quantity of added polyester resin [g] | Quantity of added stripping agent [g] |
|---|---|---|---|---|---|---|---|
| (a) | 20 | 112.0 | 66.0 | 34.0 | 0 | 8.0 | 30.0 |
| (b) | 21 | 114.0 | 66.0 | 34.0 | 0 | 8.0 | 30.0 |
| (c) | 22 | 111.0 | 66.0 | 34.0 | 0 | 8.0 | 30.0 |
| (d) | 23 | 116.0 | 66.0 | 34.0 | 0 | 8.0 | 30.0 |
| (e) | 24 | 110.3 | 66.0 | 34.0 | 0 | 8.0 | 30.0 |
| (f) | 25 | 110.0 | 66.0 | 34.0 | 0 | 8.0 | 30.0 |
| (g) | 26 | 112.0 | 66.0 | 34.0 | 0 | 8.0 | 30.0 |
| (h) | 26 | 112.0 | 66.0 | 34.0 | 0 | 8.0 | 30.0 |
| (i) | 26 | 112.0 | 66.0 | 34.0 | 0 | 8.0 | 30.0 |
| (j) | 27 | 112.0 | 66.0 | 34.0 | 0 | 8.0 | 30.0 |
| (k) | 28 | 112.0 | 66.0 | 34.0 | 0 | 8.0 | 30.0 |
| (l) | 29 | 112.0 | 66.0 | 34.0 | 0 | 8.0 | 30.0 |
| (m) | 30 | 112.0 | 66.0 | 34.0 | 0 | 8.0 | 30.0 |
| (n) | 31 | 112.0 | 66.0 | 34.0 | 0 | 8.0 | 30.0 |
| (o) | 32 | 112.0 | 66.0 | 34.0 | 0 | 8.0 | 30.0 |
| (p) | 33 | 112.0 | 66.0 | 34.0 | 0 | 8.0 | 30.0 |
| (q) | 34 | 112.0 | 66.0 | 34.0 | 0 | 8.0 | 30.0 |
| (r) | 36 | 112.0 | 66.0 | 34.0 | 0 | 8.0 | 30.0 |
| (s) | 37 | 112.0 | 66.0 | 34.0 | 0 | 8.0 | 30.0 |
| (t) | 38 | 112.0 | 66.0 | 34.0 | 0 | 8.0 | 30.0 |
| (u) | 21 | 112.0 | 66.0 | 34.0 | 0 | 8.0 | 0 |
| (v) | 21 | 112.0 | 66.0 | 34.0 | 0 | 0 | 30.0 |
| (w) | 21 | 112.0 | 65.5 | 34.0 | 0.5 | 8.0 | 30.0 |
| (x) | 21 | 112.0 | 65.3 | 34.0 | 0.75 | 8.0 | 30.0 |
| (y) | 21 | 112.0 | 65.0 | 34.0 | 1.0 | 8.0 | 30.0 |
| (z) | 21 | 112.0 | 64.5 | 34.0 | 1.5 | 8.0 | 30.0 |
| (aa) | 21 | 112.0 | 66.0 | 34.0 | 0 | 8.0 | 30.0 |
| (bb) | 21 | 112.0 | 66.0 | 34.0 | 0 | 8.0 | 30.0 |

TABLE 9

| | | | | | | | Toner physical properties | | | | Resin components of toner | | | | | |
|---|---|---|---|---|---|---|---|---|---|---|---|---|---|---|---|---|
| | | | | | | | | | | | | THF-soluble Component | | | | |
| | Master batch dispersed solution No. | Carbon black | Carbon black content (wt. %) | Dispersant content (wt. %) | Polyester resin content (wt. %) | Stripping agent content (wt. %) | Weight average particle size of toner particles (μm) | Coefficient of variation (%) | Shape index SF −1 | Shape index SF −2 | THF insoluble Component C (wt. %) | Component B of molecular weight over a million (wt. %) | Main peak molecular weight of Component A | Number average molecular weight (Mn) | Mw/Mn | Presence of core-shell structure |
| Toner (a) | 20 | a | 4.0 | 0.8 | 3.2 | 12.0 | 6.7 | 16 | 108 | 107 | 0 | 7 | 16,000 | 15,000 | 66 | Present |
| Toner (b) | 21 | a | 4.0 | 1.6 | 3.2 | 11.9 | 6.6 | 16 | 110 | 108 | 0 | 6 | 16,000 | 14,000 | 70 | Present |
| Toner (c) | 22 | a | 4.0 | 0.4 | 3.2 | 12.0 | 7.0 | 18 | 110 | 110 | 0 | 8 | 18,000 | 16,000 | 80 | Present |
| Toner (d) | 23 | a | 3.9 | 2.4 | 3.1 | 11.8 | 6.6 | 16 | 122 | 118 | 0 | 7 | 15,000 | 15,000 | 62 | Present |
| Toner (e) | 24 | a | 4.0 | 0.1 | 3.3 | 12.5 | 6.8 | 17 | 108 | 106 | 0 | 9 | 17,000 | 16,000 | 73 | Present |
| Toner (f) | 25 | a | 4.0 | 0 | 3.3 | 12.5 | 6.9 | 18 | 111 | 112 | 0 | 9 | 17,000 | 16,000 | 75 | Present |
| Toner (g) | 26 | b | 4.0 | 0.8 | 3.2 | 12.0 | 6.8 | 18 | 109 | 108 | 0 | 5 | 16,000 | 16,000 | 63 | Present |
| Toner (h) | 26 | b | 4.0 | 0.8 | 3.2 | 12.0 | 4.7 | 21 | 107 | 103 | 0 | 6 | 16,000 | 15,000 | 60 | Present |
| Toner (i) | 26 | b | 4.0 | 0.8 | 3.2 | 12.0 | 8.9 | 30 | 113 | 109 | 0 | 6 | 16,000 | 15,000 | 58 | Present |
| Toner (j) | 27 | c | 4.0 | 0.8 | 3.2 | 12.0 | 6.8 | 17 | 108 | 106 | 0 | 14 | 17,000 | 17,000 | 93 | Present |
| Toner (k) | 28 | d | 4.0 | 0.8 | 3.2 | 12.0 | 6.7 | 16 | 110 | 110 | 0 | 5 | 15,000 | 13,000 | 50 | Present |
| Toner (l) | 29 | e | 4.0 | 0.8 | 3.2 | 12.0 | 6.8 | 16 | 108 | 104 | 0 | 7 | 16,000 | 15,000 | 59 | Present |
| Toner (m) | 30 | f | 4.0 | 0.8 | 3.2 | 12.0 | 6.9 | 19 | 110 | 108 | 0 | 9 | 16,000 | 15,000 | 59 | Present |
| Toner (n) | 31 | g | 4.0 | 0.8 | 3.2 | 12.0 | 6.9 | 17 | 109 | 110 | 0 | 10 | 16,000 | 15,000 | 55 | Present |
| Toner (o) | 32 | h | 4.0 | 0.8 | 3.2 | 12.0 | 6.6 | 18 | 119 | 116 | 0 | 5 | 14,000 | 15,000 | 60 | Present |
| Toner (p) | 33 | i | 4.0 | 0.8 | 3.2 | 12.0 | 8.2 | 22 | 125 | 119 | 0 | 6 | 15,000 | 15,000 | 72 | Present |
| Toner (q) | 34 | j | 4.0 | 0.8 | 3.2 | 12.0 | 7.3 | 17 | 142 | 124 | 0 | 0.7 | 15,000 | 14,000 | 31 | Present |
| Toner (r) | 36 | l | 4.0 | 0.8 | 3.2 | 12.0 | 7.0 | 19 | 116 | 117 | 0 | 12 | 17,000 | 17,000 | 96 | Present |
| Toner (s) | 37 | a | 4.0 | 0.8 | 3.2 | 12.0 | 7.0 | 18 | 109 | 108 | 0 | 2 | 13,000 | 11,000 | 52 | Present |
| Toner (t) | 38 | a | 4.0 | 0.8 | 3.2 | 12.0 | 5.1 | 40 | 130 | 127 | 0 | 4 | 15,000 | 13,000 | 64 | Present |
| Toner (u) | 21 | a | 4.5 | 0.9 | 3.6 | 1.3 | 9.5 | 22 | 128 | 122 | 0 | 3 | 16,000 | 15,000 | 33 | None |
| Toner (v) | 21 | a | 4.1 | 0.8 | 0 | 12.4 | 10.8 | 27 | 144 | 125 | 0 | 6 | 16,000 | 16,000 | 40 | Present |
| Toner (w) | 21 | a | 4.0 | 0.8 | 3.2 | 12.0 | 7.3 | 20 | 120 | 114 | 32 | 21 | 18,000 | 19,000 | 150 | Present |
| Toner (x) | 21 | a | 4.0 | 0.8 | 3.2 | 12.0 | 7.3 | 26 | 122 | 115 | 41 | 9 | 18,000 | 20,000 | 94 | Present |
| Toner (y) | 21 | a | 4.0 | 0.8 | 3.2 | 12.0 | 7.9 | 29 | 129 | 119 | 63 | 4 | 20,000 | 22,000 | 86 | Present |
| Toner (z) | 21 | a | 4.0 | 0.8 | 3.2 | 12.0 | 8.1 | 32 | 129 | 120 | 77 | 1 | 22,000 | 25,000 | 44 | Present |
| Toner (aa) | 21 | a | 4.0 | 0.8 | 3.2 | 12.0 | 5.5 | 27 | 143 | 131 | 0 | 4 | 2,900 | 2,800 | 32 | Present |
| Toner (bb) | 21 | a | 4.0 | 0.8 | 3.2 | 12.0 | 10.6 | 24 | 130 | 122 | 0 | 17 | 52,000 | 50,000 | 240 | Present |
| Toner (cc) | — | e | 6.3 | 1.8 | 0 | 2.7 | 6.7 | 22 | 153 | 138 | 0 | 0.5 | 16,000 | 14,000 | 49 | None |
| Toner (dd) | — | e | 6.3 | 1.8 | 0 | 2.7 | 6.8 | 39 | 167 | 145 | 0 | 0.5 | 16,000 | 13,000 | 47 | None |

Example 33

A 600 dpi laser beam printer (made by Canon; LBP-860) was provided to achieve a process speed of 94 mm/s.

The cleaning rubber blade was removed from the process cartridge, contact charging bringing the rubber roller in to contact was adopted for the apparatus, the applied voltage being accomplished by a DC component (−1,400 V). Because the process speed was higher, conditions are more severe for uniform charging of the photosensitive member.

A photosensitive member 1 was employed as the photosensitive member.

The, the developing section in the process cartridge was modified, a medium-resistance rubber roller (16 ϕ; hardness ASKER: C45°:; resistance: $10^5$ Ω·cm) comprising foam urethane was used in place of the stainless steel sleeve serving as the toner carrying member, and was brought into contact with the photosensitive member. The surface of the toner carrying member displaces in the same direction as the displacing direction of the surface of the photosensitive member, and is driven so as to achieve 130% of the rotating circumferential speed of the photosensitive member.

As means for supplying the toner onto the toner carrying member, a supplying roller was provided at the developing section so as to be in contact with the toner carrying member. Further, a blade made of stainless steel coated with a resin was attached for the control of the toner coat layer on the toner carrying member. During development, only DC component (−450V) of the developing bias voltage to the toner carrier.

The image forming apparatus was modified and process conditions were set so as to match with the modification of the process cartridge.

The photosensitive member had a luminous portion potential of −800V and a dark portion potential of −150V for charging, and 75 g/$m^2$ paper was used for the recording medium.

An image was formed in this image forming apparatus using a polymerized toner a to make 2,000 sheets of image continuously. In the result, a high-density high-quality image free from staining was obtained. No problem was encountered as to fixability.

The image was evaluated for the image density and image staining of the image after continuous printing of 100 sheets and after continuous printing of 2,000 sheets of a character image having a printing area ratio of 4%.

The image concentration was evaluated in the same manner as in the Example 1.

(9) Image staining

The image staining of the image was evaluated by visually observing the image after fixing in accordance with the following criteria of evaluation:

A: No image staining

B: Slight image staining not impaining quality

C: Poor quality with slight occurrence of image staining

D: Serious occurrence of image staining.

Further, 100 sheets of a character image having a printing area ratio of 47% were continuously printed, and then, evaluation was conducted in terms of image staining of the charging roll, transferring properties, fogging and resolution. Evaluation of transferring property, for and resolution was performed in the same manner as in the Example 1.

Stain of the charging roller was evaluated by measuring the weight of adhering toner per unit area (mg/$cm^2$) on the charging roller as derived from the increase in weight of the charging roller between before and after evaluation. The results of evaluation are shown in Table 10.

Example 34

Evaluation was made in the same manner as in the Example 33 except that the process speed was raised to 120 mm/s. As is clear from the results shown in Table 10, through the results were slightly inferior to the Example 33 since the increase in the process speed imposed severer conditions, the results were generally satisfactory.

Examples 35 to 46

Evaluation was conducted in the same manner as in the Example 33 except that polymerized toner samples (b) to (e) and (g) were employed. The results are shown in Table 10.

Comparative Example 6

Evaluation was made in the same manner as in the Example 33 except for the use of the polymerized toner (f). As is clear from the results shown in Table 10, serious stains of the image occurred from the initial stage, and it was difficult to carry out continuous printing of 2,000 sheets. Evaluation was therefore discontinued.

Comparative Examples 7 and 8

Evaluation was made in the same manner as in the Example 33 except for the use of the polymerized toners (q) and (r). As is clear from the results shown in table 10, good results were not obtained because the specific azo-based iron compound of the invention was not used, of because carbon black used in the toner was not the specific carbon black of the invention.

Comparative Examples 9 and 10

Evaluation was conducted in the same manner as in the Example 33 except for the use of the polymerized toners (s) and (t). As is known from the results shown in Table 10. Satisfactory results could not be obtained since the dispersant used for the toner was not the specific azo-base iron compound of the invention. The polymerized toner (s) led to a decrease in the image density from the initial stage. The polymerized toner (t), while showing a satisfactory image density in the initial stage, resulted in a decrease in the image density, and further, in fogging and serious stains of the image after printing 2,000 sheets. Matching with the image forming apparatus was not sufficient.

Examples 47 to 54

Evaluation was made in the same manner as in the Example 33 except for the use of the polymerized toners (u) to (z), (aa) and (bb). The results are shown in Table 10.

Example 55

Evaluation was made in the same manner as in the Example 33 except for the use of the pulverized toner (cc). As is known from the results shown in Table 10, satisfactory results were obtained as a whole.

Comparative Example 11

Evaluation was conducted in the ssame manner as in the Example 33 except for the use of the pulverized toner (dd). As is evident from the results shown in Table 10, serious stains occurred on the image from the initial stage, and it was difficult to continue printing 2,000 sheets. Evaluation was therefore discontinued.

TABLE 10

List of evaluation results

| | | | Initial 100 copies | | | | | | After 2,000 copies | | | | |
|---|---|---|---|---|---|---|---|---|---|---|---|---|---|
| | Toner | Photosensitive member | Image density | Resolution | Copy property | Fogging | Image staining | Charging roller contamination | Image density | Image staining | Matching with developing roller | Matching with photosensitive drum | Matching with fixing unit |
| Example 33 | (a) | Manufacturing example 1 | 1.36 | A | 0.03 | 0.04 | B | 0.29 | 1.42 | B | A | A | A |
| Example 34 | (a) | Manufacturing example 1 | 1.37 | B | 0.05 | 0.08 | B | 0.45 | 1.41 | B | A | A | A |
| Example 35 | (b) | Manufacturing example 1 | 1.43 | A | 0.02 | 0.04 | A | 0.19 | 1.44 | A | A | A | A |
| Example 36 | (c) | Manufacturing example 1 | 1.30 | B | 0.05 | 0.06 | A | 0.29 | 1.36 | B | A | A | A |
| Example 37 | (d) | Manufacturing example 1 | 1.37 | B | 0.04 | 0.05 | B | 0.27 | 1.39 | B | A | A | A |
| Example 38 | (e) | Manufacturing example 1 | 1.32 | C | 0.09 | 0.14 | B | 0.49 | 1.30 | C | A | A | A |
| Comparative Example 6 | (f) | Manufacturing example 1 | 1.25 | C | 0.09 | 0.20 | D | 0.90 | — | — | — | — | — |
| Example 39 | (g) | Manufacturing example 1 | 1.39 | A | 0.07 | 0.07 | B | 0.41 | 1.44 | B | A | A | A |
| Example 40 | (j) | Manufacturing example 1 | 1.35 | A | 0.04 | 0.03 | B | 0.33 | 1.39 | B | A | A | A |
| Example 41 | (k) | Manufacturing example 1 | 1.37 | A | 0.08 | 0.06 | B | 0.43 | 1.44 | B | A | A | A |
| Example 42 | (l) | Manufacturing example 1 | 1.38 | A | 0.06 | 0.06 | B | 0.37 | 1.43 | B | A | A | A |
| Example 43 | (m) | Manufacturing example 1 | 1.36 | A | 0.05 | 0.05 | B | 0.33 | 1.41 | B | A | A | A |
| Example 44 | (n) | Manufacturing example 1 | 1.35 | A | 0.06 | 0.06 | B | 0.36 | 1.40 | B | A | A | A |
| Example 45 | (o) | Manufacturing example 1 | 1.37 | B | 0.07 | 0.07 | B | 0.44 | 1.41 | B | A | A | A |
| Example 46 | (p) | Manufacturing example 1 | 1.32 | B | 0.09 | 0.09 | B | 0.51 | 1.37 | B | A | A | A |
| Comparative Example 7 | (q) | Manufacturing example 1 | 1.39 | B | 0.18 | 0.13 | C | 0.67 | 1.42 | D | C | C | C |
| Comparative Example 8 | (r) | Manufacturing example 1 | 1.28 | B | 0.11 | 0.09 | B | 0.56 | 1.32 | C | A | A | A |
| Comparative Example 9 | (s) | Manufacturing example 1 | 1.15 | C | 0.04 | 0.19 | B | 0.33 | 1.09 | C | B | C | B |
| Comparative Example 10 | (t) | Manufacturing example 1 | 1.35 | C | 0.09 | 0.16 | C | 0.71 | 1.18 | D | B | D | B |
| Example 47 | (u) | Manufacturing example 1 | 1.30 | B | 0.04 | 0.05 | B | 0.35 | 1.31 | C | B | C | C |
| Example 48 | (v) | Manufacturing | 1.35 | B | 0.07 | 0.09 | B | 0.39 | 1.30 | C | C | C | B |

TABLE 10-continued

List of evaluation results

| | | | Initial 100 copies | | | | | | After 2,000 copies | | | | |
|---|---|---|---|---|---|---|---|---|---|---|---|---|---|
| | Toner | Photosensitive member | Image density | Resolution | Copy property | Fogging | Image staining | Charging roller contamination | Image density | Image staining | Matching with developing roller | Matching with photosensitive drum | Matching with fixing unit |
| | | example 1 | | | | | | | | | | | |
| Example 49 | (w) | Manufacturing example 1 | 1.37 | B | 0.05 | 0.07 | A | 0.28 | 1.38 | A | B | B | B |
| Example 50 | (x) | Manufacturing example 1 | 1.38 | B | 0.07 | 0.05 | B | 0.44 | 1.36 | A | B | C | B |
| Example 51 | (y) | Manufacturing example 1 | 1.35 | B | 0.06 | 0.08 | B | 0.59 | 1.34 | B | B | C | C |
| Example 52 | (z) | Manufacturing example 1 | 1.34 | B | 0.07 | 0.09 | C | 0.66 | 1.32 | C | C | C | C |
| Example 53 | (aa) | Manufacturing example 1 | 1.33 | C | 0.09 | 0.09 | C | 0.72 | 1.30 | C | C | C | C |
| Example 54 | (bb) | Manufacturing example 1 | 1.37 | C | 0.05 | 0.09 | B | 0.57 | 1.31 | B | B | C | C |
| Example 55 | (cc) | Manufacturing example 1 | 1.40 | A | 0.17 | 0.02 | B | 0.58 | 1.42 | B | C | C | C |
| Comparative Example 11 | (dd) | Manufacturing example 1 | 1.41 | B | 0.26 | 0.05 | D | 0.89 | — | — | — | — | — |

Example 56 to 64

Evaluation was made in the same manner as in the Example 33 except that the polymerized toners (g) to (i) were used and the amounts of additives (hydrophobic silica having a BET specific surface area of 140 $m^2/g$) were changed to 0.5%, 1.8% and 3.0%, respectively. As is known from the results shown in Table 11, with an amount of addition of 0.5%, there were more image staining of the charging roller along with an increase in fogging. With an addition of 3.0%, development simultaneous cleaning was achieved, and the results were almost satisfactory, although fixability was slightly poor.

TABLE 11

| | Toner | Weight average particle size, D4 [μm] | Covering additive: Quantity of addition [wt. %] | Covering additive: Covering ratio [%] | Photosensitive member | Initial 100 copies: Image density | Initial 100 copies: Resolution | Initial 100 copies: Transferring property | Initial 100 copies: Fogging | Initial 100 copies: Image staining | Initial 100 copies: Charging roller contamination | After 2,000 copies: Image density | After 2,000 copies: Image staining |
|---|---|---|---|---|---|---|---|---|---|---|---|---|---|
| Example 56 | (g) | 6.8 | 0.5 | 15 | Manufacturing example 1 | 1.37 | B | 0.06 | 0.08 | B | 0.43 | 1.41 | B |
| Example 57 | (g) | 6.8 | 1.8 | 50 | Manufacturing example 1 | 1.40 | A | 0.04 | 0.04 | B | 0.38 | 1.42 | B |
| Example 58 | (g) | 6.8 | 3.0 | 85 | Manufacturing example 1 | 1.36 | A | 0.02 | 0.02 | B | 0.32 | 1.38 | B |
| Example 59 | (h) | 4.7 | 0.5 | 10 | Manufacturing example 1 | 1.33 | A | 0.07 | 0.09 | B | 0.49 | 1.39 | B |
| Example 60 | (h) | 4.7 | 1.8 | 40 | Manufacturing example 1 | 1.39 | A | 0.05 | 0.06 | B | 0.39 | 1.39 | B |
| Example 61 | (h) | 4.7 | 3.0 | 70 | Manufacturing example 1 | 1.42 | A | 0.03 | 0.04 | B | 0.31 | 1.41 | B |
| Example 62 | (i) | 8.9 | 0.5 | 20 | Manufacturing example 1 | 1.35 | B | 0.06 | 0.06 | B | 0.47 | 1.39 | B |
| Example 63 | (i) | 8.9 | 1.8 | 60 | Manufacturing example 1 | 1.38 | B | 0.05 | 0.05 | B | 0.42 | 1.40 | B |
| Example 64 | (i) | 8.9 | 3.0 | 95 | Manufacturing example 1 | 1.34 | B | 0.04 | 0.06 | B | 0.40 | 1.35 | B |

Example 65

An image was formed and evaluation was conducted in the same manner as in the Example 33 except that a single-layer-structured sponge roller was used as a toner supplying roller 35 in the developing vessel 32 in the image forming apparatus used in the Example 33, and a bias voltage was applied from bias applying means (not shown) to the toner supplying roller 35.

Only a DC component of −300 V was applied as a developing bias voltage to the developing roller 34 during development, and only a DC component of −480 V was applied as a supplying bias voltage to the toner supplying roller 35.

The results of evaluation, as compared with those of the Example 33, included more stable and satisfactory image density and fog inhibition. Development simultaneous cleaning was achieved, resulting in an excellent image quality.

Matching with the image forming apparatus was also satisfactory.

Example 66

An image was formed by using the polymerized toner A prepared in the Example A of manufacture of polymerized toner in the development unit 57 of the image forming apparatus shown in FIG. 5.

In the image forming apparatus, as shown in FIG. 5, a cleaner having a cleaning member coming into contact with the surface of the photosensitive member is provided, between the first transferring section and the charging section for charging the photosensitive member, as first cleaning means for removing residual toner remaining on the surface of the photosensitive member after the first transferring step. Further, after the second transferring step, another cleaner having a cleaning member coming into contact with the surface of an intermediate transfer member is provided, in the downstream of the second transferring section and in the upstream of the first transferring section, as second cleaning means for removing residual toner remaining on the surface of the intermediate transfer member.

A developing unit 57 had the same configuration of the developing unit 8 shown in FIGS. 3 and 4.

A medium-resistance rubber roller (16 ϕ) comprising silicone rubber of which the resistance was adjusted by dispersing carbon black was used as a toner carrying member 9, and brought into contact with the photosensitive member. The displacement of the surface of the toner carrying member 9 was in the same direction at the contact portion with the photosensitive member as that of the photosensitive member, and the rotational circumferential speed thereof corresponded to 150% of the rotational circumferential speed of the photosensitive member. More particularly, the toner carrying member had a circumferential speed of 120 mm/s and a speed of 80 mm/s relative to the surface of the photosensitive member.

A single-layer-structured sponge roller was provided as the supplying roller 12 so as to serve as means for supplying the toner onto the toner carrying member and brought into contact with the toner carrying member. At the contact portion, the toner was supplying onto the toner carrying member by rotating the same so that the surface of the supplying roller 12 displaces in a direction counter to the displacing direction of the toner carrying member. Further, a stainless steel blade coated with a resin was attached for controlling the coat layer of toner on the toner carrying member.

A photosensitive member 1 was used as the photosensitive member, with the toner A as the toner, and image forming conditions were set so as to satisfy the following developing and transferring conditions:

Photosensitive member dark portion potential: −700 V

Photosensitive member luminous portion potential: −150 V

Developing bias applied to developing roller: −450 V (DC component only)

Dias applied to toner supplying roller: −300 V (DC component only)

Transferring bias applied to intermediate copying member in the first transferring step: 300 V (DC component only)

Transferring bias applied to transferring roller in the second transferring step: 1,000 V (DC component only)

Under the above image forming conditions, the toner image transferred onto the recording medium was heated and fixed onto the recording medium by the following heating/fixing unit.

A thermal roll type fixing unit not having an oil coating function was used as the heating/fixing unit 70. An upper roller 68 and a lower roller 69 had surface layers of a fluorine-based resin, with a roller diameter of 55 mm. The fixing temperature was set at 140° C., and the nip width was set to 7 mm.

A test of continuous image printing test of 2,000 sheets was carried out while replenishing the toner, using the an image forming apparatus having the foregoing configuration, and the resultant image was evaluated. The results were satisfactory in terms of image density, splash control, fog inhibition and transferring property, with no occurrence of a cleaning defect, and an image quality equal to that in the initial stage was obtained. Observation of the photosensitive member, the developing roller and the intermediate transfer member revealed that there was no adherence and replacement was not necessary.

Example 64

An image was formed by using the polymerized toner (b) prepared in the Example (b) of manufacture of polymerized toner in the developing unit 57 of the image forming apparatus shown in FIG. 5.

In the image forming apparatus, the cleaner 63 having a first cleaning member 62 serving as first cleaning means was not provided. A cleaner having a cleaning member in contact with the surface of the intermediate transfer member serving as cleaning means for removing residual toner remaining on the surface of the intermediate transfer member after the second transferring step was provided in the downstream of the second transferring section and in the upstream of the first transferring section.

A developing unit 57 had the same configuration of the developing unit 8 shown in FIGS. 3 and 4. The residual toner remaining on the surface of the photosensitive drum after the first transferring was removed by converting the charging property of the toner into negative polarity by the application of charging bias in the charging section, and upon development, only the toner present on non-image portions was collected into the developing unit in the developing section.

In the developing unit 8, a medium-resistance rubber roller (16 ϕ) comprising silicone rubber of which the resistance was adjusted by dispersing carbon black was used as a toner carrying member 9, and brought into contact with the photosensitive member. The displacement of the surface of the toner carrying member 9 was in the same direction at the contact portion with the photosensitive member as that of the photosensitive member, and the rotational circumferential speed thereof corresponds to 150% of the rotational circumferential speed of the photosensitive member. More particularly, the toner carrying member has a circumferential speed of 120 mm/s and a speed of 80 mm/s relative to the surface of the photosensitive member.

A single-layer-structured sponge roller was provided as the supplying roller 12 so as to serve as means for supplying the toner onto the toner carrying member and grought into contact with the toner carrying member. At the contact portion, the toner was supplied onto the toner carrying member by rotating the same so that the surface of the supplying roller 12 displaces in a direction counter to the displacing direction of the toner carrying member. Further, a stainless steel blade coated with a resin was attached for controlling the coat layer of toner on the toner carrying member.

A photosensitive member 1 was used as the photosensitive member, with the toner (b) as the toner, and image forming conditions were set so as to satisfy the following developing and copying conditions:

Photosensitive member dark portion potential: −700 V

Photosensitive member luminous portion potential: −150 V

Developing bias applied to developing roller: −450 V (DC component only)

Bias applied to toner supplying roller: −300 V (DC component only)

Transferring bias applied to intermediate copying member in the first transferring step: 350 V (DC component only)

Transferring bias applied to copying roller in the second transferring step: 1,100 V (DC component only)

Under the above image forming conditions, the toner image transferred onto the recording medium is heated and fixed onto a recording medium by the following heating/fixing unit.

A thermal roll type fixing unit not having an oil coating function was used as the heating/fixing unit 70. An upper roller 68 and a lower roller 69 had surface layers of a fluorine-based resin, with a roller diameter of 60 mm. The fixing temperature was set at 150° C., and the nip width was set at 7 mm.

A continuous printing test of 2,000 sheets was carried out by the use of an image forming apparatus having the above configuration. A high-quality image free from image staining was obtained at a high density. The amount of toner adhering to the charging roller was as slight as 0.41 mg/cm$^2$, and a satisfactory matching with the image forming apparatus was achieved.

What is claimed is:

1. An image forming method comprising the following steps:

(a) charging an image carrying member for carrying an electrostatic latent image;

(b) forming an electrostatic latent image on the charged image carrying member;

(c) developing said electrostatic latent image with a toner by contacting a toner layer on a surface of a toner carrying member with a surface of the image carrying member to form a toner image on the surface of said image carrying member;

(d) transferring the toner image formed on the surface of said image carrying member onto a recording medium via or without via an intermediate transfer member;

wherein said toner comprises toner particles containing at least a binder resin, carbon black and an azo-based iron compound, and inorganic fine powder;

said carbon black has an average primary particle size from 25 to 80 nm;

said azo-based iron compound comprises a compound expressed by the following general formula:

General Formula (1):

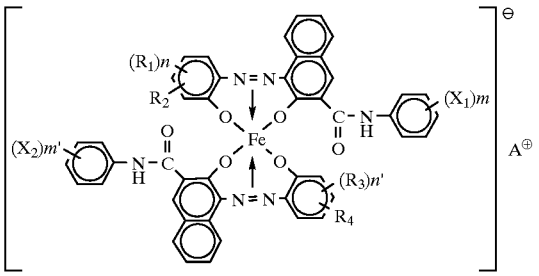

wherein $X_1$ and $X_2$ are each selected from the group consisting of hydrogen atom, lower alkyl group, lower alkoxy group, nitro group and halogen atom; $X_1$ and $X_2$ are the same or different; m and m' are integers from 1 to 3; $R_1$ and $R_3$ are each selected from the group consisting of hydrogen atom, $C_1$–$C_{18}$ alkyl group, $C_2$–$C_{18}$ alkenyl group, sulfonamide group, mesyl group, sulfonic acid group, carboxyester group, hydroxy group, $C_1$–$C_{18}$ alkoxy group, acetylamide group, benzoylamino group and halogen atom; $R_1$ and $R_3$ are the same or different; n and n' are integers from 1 to 3; $R_2$ and $R_4$ are each hydrogen atom or nitro group; and $A^+$ is a cation selected from the group consisting of ammonium ion, hydrogen ion, sodium ion, potassium ion and ion mixture thereof.

2. The image forming method according to claim 1, wherein said carbon black has an average primary particle size from 25 to 55 nm.

3. The image forming method according to claim 1, wherein said carbon black has a DBP oil absorption from 40 to 150 ml/100 g.

4. The image forming method according to claim 1, wherein said carbon black has a specific surface area upon nitrogen adsorption up to 100 $m^2/g$ and a volatile matter content up to 2% by weight of the total weight of said carbon black.

5. The image forming method according to claim 1, wherein a relationship between weight percentage A of the carbon black and weight percentage B of the azo-based iron compound satisfies the following condition:

$$2 \leqq A/B \leqq 35.$$

6. The image forming method according to claim 1, wherein said toner has shape factors SF-1 and SF-2 which satisfy the following relationship:

$$100 < SF\text{-}1 \leqq 160$$

$$100 < SF\text{-}2 \leqq 140.$$

7. The image forming method according to claim 1, wherein said toner has shape factors SF-1 and SF-2 which satisfy the following relationship:

$$100 < SF\text{-}1 \leqq 140$$

$$100 < SF\text{-}2 \leqq 120.$$

8. The image forming method according to claim 1, wherein said toner particles are formed by polymerizing a polymarizable monomer composition containing at least a polymarizable monomer, said carbon black and said azo-based iron compound in an aqueous medium.

9. The image forming method according to claim 1, wherein said toner particles are formed by polymerizing a polymarizable monomer composition containing at least a polymarizable monomer, said carbon black, said azo-based iron compound, a release agent, and a polar resin in an aqueous medium.

10. The image forming method according to claim 8, wherein said polymarizable monomer composition is prepared by mixing a second polymarizable monomer with a dispersed solution formed by dispersing said carbon black and said azo-based iron compound in said first polymarizable monomer.

11. The image forming method according to claim 9, wherein said polymarizable monomer composition is prepared by mixing a second polymarizable monomer, said release agent and said polar resin with a dispersed solution formed by dispersing said carbon black and said azo-based iron compound in said first polymarizable monomer.

12. The image forming method according to claim 1, wherein said toner particles include a wax as a release agent and said toner particles have a core-shell structure having a core formed of said wax and a shell formed of a binder resin covering the surface of said core.

13. The image forming method according to claim 1, wherein said toner particles include a wax as a release agent and a polar resin; said toner particles have a core-shell structure having a core formed of said wax and a shell formed of a binder resin covering the surface of said core and a shell resin layer comprising said polar resin formed on the surface of said shell.

14. The image forming method according to claim 1, wherein said toner particles include a wax as a release agent in an amount from 2 to 30 wt. % based on said toner particles.

15. The image forming method according to claim 1, wherein said toner particles include a wax as a release agent in an amount from 2 to 25 wt. % based on said toner particles.

16. The image forming method according to claim 1, wherein said toner particles include a wax as a release agent in an amount from 2 to 30 wt. %, and a polar resin from 1 to 20 wt. %, respectively, based on said toner particles.

17. The image forming method according to claim 1, wherein said toner particles include a wax having a maximum endothermic peak in a temperature region from 40° C. to 90° C. on an endothermic curve as measured through a DSC measurement as a release agent.

18. The image forming method according to claim 1, wherein said toner particles include a resin component having a THF-insoluble component C and a THF-soluble component, said THF-soluble component contains a component A in the molecular weight region of a molecular weight of under 1,000,000, and a component B in the molecular weight region of a molecular weight of at least 1,000,000, in a molecular weight distribution as measured by gel permeation chromatogram (GPC), and said component A, B and THF-insoluble component C satisfies the following conditions:

$$30 \leqq W_A \leqq 95$$

$0 \leqq W_B \leqq 20$ $0 \leqq W_C \leqq 70$ and $5 \leqq W_B + W_C \leqq 70$, wherein $W_A$ is a weight % component A, $W_B$ is a weight % of component B and $W_C$ is a weight % of THF-insoluble component C.

19. The image forming method according to claim 1, wherein said toner particles include a resin component having a THF-insoluble component C and a THF-soluble component, said THF-soluble component contains a component A in the molecular weight region of a molecular weight of under 1,000,000, and a component B in the molecular weight region of a molecular weight of at least 1,000,000, in a molecular weight distribution as measured by gel permeation chromatogram (GPC) said component A, B and THF-insoluble component C satisfies the following conditions:

$50 \leqq W_A \leqq 90$ $1 \leqq W_B \leqq 20$ $1 \leqq W_C \leqq 70$ and $10 \leqq W_B + W_C \leqq 50$, wherein $W_A$ is a weight % of component A, $W_B$ is a weight % of component B and $W_C$ is a weight % of THF-insoluble component C.

20. The image forming method according to claim 1, wherein said toner particles include a resin component having a THF-soluble component, said THF-soluble component has a number average molecular weight (Mn) from 9,000 to 1,000,000, and the ratio of weight average molecular weight (Mw) to number average molecular weight (Mn) of (Mw/Mn) from 5 to 500, in a molecular weight distribution as measured by gel permeation chromatogram (GPC).

21. The image forming method according to claim 1, wherein said toner particles include a resin component having a THF-soluble component, said THF-soluble component has a number average molecular weight (Mn) from 10,000 to 500,000 and the ratio of weight average molecular weight (Mw) to number average molecular weight (Mn) of (Mw/Mn) from 7 to 400 in a molecular weight distribution as measured by gel permeation chromatogram (GPC).

22. The image forming method according to claim 1, wherein said toner is covered with an additive comprising said inorganic fine powder, wherein from 5 to 99% of exterior surfaces of said toner particles are covered with said additive.

23. The image forming method according to claim 22, wherein said inorganic fine powder is selected from the group consisting of a metal oxide, a nitride, a carbide, a metal salt, a fatty acid metal salt, carbon black, silica and mixtures thereof.

24. The image forming method according to claim 1, wherein said inorganic fine powder is selected from the group consisting of silica, titania, alumina, a double oxide thereof and mixtures thereof.

25. The image forming method according to claim 1, wherein said inorganic fine powder has a specific surface area based on a BET method of up to 30 $cm^2/g$.

26. The image forming method according to claim 1, wherein said inorganic fine powder has a specific surface area based on a BET method from 50 to 400 $m^2/g$.

27. The image forming method according to claim 1, wherein said toner contains said inorganic fine powder in an amount from 0.1 to 8 weight parts based on 100 weight parts of said toner particles.

28. The image forming method according to claim 1, wherein said inorganic fine powder is treated with silicone oil.

29. The image forming method according to claim 1, wherein said toner particles have a weight average particle size from 3 to 9 $\mu$m.

30. The image forming method according to claim 1, wherein said toner particles have a weight average particle size from 4 to 8 $\mu$m.

31. The image forming method according to claim 1, wherein said toner particles have a coefficient of variation of up to 35%.

32. The image forming method according to claim 1, wherein said toner particles have a coefficient of variation of up to 25%.

33. The image forming method according to claim 1, wherein said image carrying member comprises an electrophotographic photosensitive member and the surface of said electrophotographic photosensitive member has a contact angle relative to water of at least 85°.

34. The image forming method according to claim 33, wherein said electrophotographic photosensitive member has a surface layer comprising a powdery compound containing fluorine atoms dispersed in a resin.

35. The image forming method according to claim 34, wherein said powdery compound is a powdery fluororesin.

36. The image forming method according to claim 1, wherein said developing step (c) is conducted by mutual displacement of the surface of the image carrying member and the surface of the toner carrying member and a direction of displacement of the toner carrying member surface is the same as a direction of displacement of the image carrying member surface.

37. The image forming method according to claim 36, wherein a speed of displacement of the toner carrying member surface in the developing step is from 1.05 to 3.0 times a speed of displacement of the image carrying member surface.

38. The image forming method according to claim 1, including controlling thickness of said toner layer formed on the surface of said toner carrying member by contacting a toner thickness regulating member with the toner carried by said toner carrying member during the developing step (c).

39. The image forming method according to claim 36, including employing a toner supplying member for supplying the toner to said toner carrying member.

40. The image forming method according to claim 39, wherein said developing step (c) is conducted by contacting a toner coating roller of said toner supplying member with the surface of the toner carrying member, and a direction of displacement of the surface of said toner coating roller is set to a direction counter to a direction of displacement of the surface of said toner carrying member.

41. The image forming method according to claim 40, wherein a developing bias voltage is applied to said toner carrying member during said developing of said electrostatic latent image, and a supplying bias voltage is applied to said toner carrying member during said supplying of the toner.

42. The image forming method according to claim 41, wherein the supplying bias voltage applied to said toner coating roller is set to an absolute value larger than the developing bias voltage applied to said toner carrying member, and said toner coating roller (i) supplies the toner onto the surface of said toner carrying member, and, after said developing step (c), (ii) strips off residual toner remaining on the surface of said toner carrying member.

43. The image forming method according to claim 41, wherein the electrostatic latent image on said image carrying member has a luminous portion potential from 0 to 250 V in absolute value; has a dark portion potential from 300 to 1000 V in absolute value; has a supplying bias voltage applied to said toner coating roller from 100 to 900 V in absolute value; has a developing bias voltage applied to said toner carrying member from 100 to 900 V in absolute value; said coating bias voltage is set to an absolute value larger by 10 to 400 V than said developing bias voltage; and said toner coating roller (i) supplies the toner onto the surface of said toner carrying member and (ii) after said developing step (c) strips off the residual toner remaining on the surface of said toner carrying member.

44. The image forming method according to claim 1, including conducting the step of transferring said toner image formed on said image carrying member on said recording medium by contacting a transfer member supplied with a voltage with said image carrying member through said recording medium.

45. The image forming method according to claim 1, wherein, in said transferring step, said toner image transferred on said recording medium is fixed to said recording medium.

46. The image forming method according to claim 1, wherein said transferring step comprises (i) performing a first transferring of said toner image formed on said image carrying member onto said intermediate transfer medium and (ii) performing a second transferring said toner image transferred on said intermediate transfer medium onto said recording medium, wherein said toner image transferred on said recording medium is fixed to said recording medium.

47. The image forming method according to claim 1, wherein in said charging step, said image carrying member is charged by contacting charging member supplied with voltage with said image carrying member.

48. The image forming method according to claim 1, wherein, in the charging step, a DC voltage is supplied to said charging member.

49. The image forming method according to claim 1, wherein, in the charging step, a DC voltage and an AC voltage of less than twice the charging potential upon application of said DC voltage are applied.

50. The image forming method according to claim 1, wherein, after the transferring step, there is further provided a cleaning step for collecting the toner remaining on the surface of said image carrying member.

51. The image forming method according to claim 50, including a pre-development cleaning step of cleaning the surface of said image carrying member prior to said developing step by contacting a cleaning member with the surface of said image carrying member after said transferring step.

52. The image forming method according to claim 51, wherein said pre-development cleaning step is carried out after the transferring step and prior to the charging step.

53. The image forming method according to claim 50, wherein said cleaning step is conducted by cleaning the surface of said image carrying member by causing the toner carrying member to collect the toner remaining on the surface of said image carrying member during the developing step.

54. The image forming method according to claim 53, wherein a transferring means in the transferring step, a charging means in said charging step, and a developing means in said developing step are arranged in the order of the transferring means, the charging means and the developing means along a direction of displacement said image carrying member, and no cleaning member is provided between the transferring means and the charging means and between the charging means and the developing means to collect the toner remaining after transferring step, on the surface of said image carrying member by contacting the surface of said image carrying member.

* * * * *

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 1:

Line 54, "small" should read --smaller--; and
Line 57, "2-284,6156," should read --2-284,156--.

COLUMN 2:

Line 4, "increased" should read --greater--; and
Line 38, "there" should read --these--.

COLUMN 3:

Line 8, "why" should read --while--;
Line 26, "63-133,179" should read --63-133,179,--;
Line 29, "nor" should read --or--; and
Line 51, "factors," should read --factor,--

COLUMN 5:

Line 26, "in cleaning" should read --in the cleaning step--.

COLUMN 6:

Line 22,"electrostatically" should be deleted; and
Line 31, "cause" should read --causes--.

COLUMN 7:

Line 21, "an" should read --a--; and
Line 58, "member ;" should read --member,--.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 10:

Line 11, "remaining" should read --the toner remaining--;
Line 36, "used" should read --for use--; and
Line 61, "with," should read --with--.

COLUMN 11:

Line 12, "chargeing" should read --charging--;
Line 27, "several" should read --reversal developing--;
Line 53, "further" should read --further that--; and
Line 55, "causes" should read --causing--.

COLUMN 12:

Line 36, "unless" should read --occurs unless--.

COLUMN 19:

Line 64,"by" should read --be--.

COLUMN 22:

Line 22, "has" should read --have--.

COLUMN 24:

Line 8, "an" should be deleted; and
Line 62, "a" should be deleted.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 25:

Line 54, "a" should be deleted.

COLUMN 26:

Line 20, "even" should read --even when--; and
Line 24, "is" should read --are--.

COLUMN 27:

Line 52, "by-replacing" should read --by replacing--.

COLUMN 28:

Line 55, "initiator,." should read --initiator,--.

COLUMN 29:

Line 12, "be." should read --be--; and
Line 32, "monomers," should read --monomer,--.

COLUMN 30:

Line 63, "preferably,." should read --preferably,-- and
"2;0" should read --2.0--.

COLUMN 31:

Line 43, "from.0.01" should read --from 0.01--; and
Line 46, "ore" should read --or--.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 32:

Line 20, "to" should be deleted.

COLUMN 33:

Line 29, "when the cleaning effect" should read --The effect--;
Line 30, "hand," should read --hand is such,--; and
Line 45, "an" should read --and--.

COLUMN 35:

Line 45, "indiums" should read --indium--.

COLUMN 36:

Line 35, "pf" should read --of--; and
Line 49, "same-direction" should read --same direction--.

COLUMN 37:

Line 14, "the" should read --to the--; and
Line 36, "ipclude," should read --include--.

COLUMN 38:

Line 11, "ity; The" should read --ity. The--; and
Line 33, "steal;" should read --steel;--.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 39:

Line 36, "is contact" should read --is the contact--.

COLUMN 40:

Line 7, "preferably" should read --preferable--; and
Line 15, "base" should read --based--.

COLUMN 41:

Line 30, "from" should read --form--.

COLUMN 42:

Line 56, "is" should be deleted.

COLUMN 44:

Table 2, "butylsalicytate" should read
--butylsalicylate--.

COLUMN 45:

Line 1, "TABLE 2-continued" etc. should be deleted;
Line 33, "After" should read --After heating--; and
Line 65, "The," should read --Then,--.

COLUMN 51:

Line 42, "sheet" should read --sheets--.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 52:

Line 6, "as that the" should read --such that the--; and
Line 62, "peeled." should read --peeled--.

COLUMN 54:

Line 24, "was" should read --were--.

COLUMN 63:

Line 17, "ratio factory." should read --satisfactory--.

COLUMN 64:

Table 7, "butylsalicytate" should read
--butylsalicylate--.

COLUMN 66:

Line 60, "(Charge Control agent) 2 weight parts
Azo-based iron compounds (1):" should read
--(charge control agent)
Azo-based iron compounds (1): 2 weight parts--.

COLUMN 71:

Line 5, "in to" should read --in to--;
Line 12, "The," should read --Then,--;
Line 14, "C45°:;" should read --C45°;--; and
Line 54, "impaining" should read --impairing--.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 72:

Line 29, "of" should read --or--;
Line 37, "(t).As" should read --(t) as--; and
Line 61, "ssame" should read --same--.

COLUMN 77:

Line 8, "were" should read --was--.

COLUMN 78:

Line 61, "supplying" should read --supplied--.

COLUMN 79:

Line 29, "the an" should read --an--.

COLUMN 80:

Line 12, "grought" should read --brought--.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 82:

Line 5, "polymarizable" should read --polymerizable--;
Line 6, "polymarizable" should read --polymerizable--;
Line 10, "polymarizable" should read --polymerizable--;
Line 11, "polymarizable" should read --polymerizable--;
Line 15, "polymarizable" should read --polymerizable--;
Line 16, "polymarizable" should read --polymerizable--;
Line 18, "polymariz-" should read --polymeriz- --;
Line 21, "polymarizable" should read --polymerizable--;
Line 22, "polymarizable" should read --polymerizable--; and
Line 25, "polymarizable" should read --polymerizable--.

COLUMN 85:

Line 29, "said" should read --of said--.

UNITED STATES PATENT AND TRADEMARK OFFICE

CERTIFICATE OF CORRECTION

PATENT NO. : 5,976,755

DATED : November 2, 1999

INVENTOR(S) : SATOSHI YOSHIDA ET AL.

It is certified that error appears in the above-identified patent and that said Letters Patent is hereby corrected as shown below:

COLUMN 86:

Line 30, "said" should read --of said--;
Line 35, ""transferring" should read --the transferring--.

Signed and Sealed this

Second Day of January, 2001

*Attest:*

*Attesting Officer*

Q. TODD DICKINSON

*Commissioner of Patents and Trademarks*